US007827812B2

(12) United States Patent
Yabu et al.

(10) Patent No.: US 7,827,812 B2
(45) Date of Patent: Nov. 9, 2010

(54) HUMIDITY CONTROLLER

(75) Inventors: Tomohiro Yabu, Osaka (JP); Shuji Ikegami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 915 days.

(21) Appl. No.: 11/662,357

(22) PCT Filed: Sep. 8, 2005

(86) PCT No.: PCT/JP2005/016510

§ 371 (c)(1),
(2), (4) Date: Mar. 8, 2007

(87) PCT Pub. No.: WO2006/028167

PCT Pub. Date: Mar. 16, 2006

(65) Prior Publication Data

US 2008/0092565 A1 Apr. 24, 2008

(30) Foreign Application Priority Data

Sep. 9, 2004 (JP) ..... 2004-262707
Jan. 31, 2005 (JP) ..... 2005-022955

(51) Int. Cl.
*F25D 17/04* (2006.01)
*F25B 17/00* (2006.01)
*G05D 22/00* (2006.01)

(52) U.S. Cl. ..... 62/186; 62/232; 236/44 A

(58) Field of Classification Search ..... 62/94, 62/186, 232, 238.3, 271; 236/44 A
See application file for complete search history.

(56) References Cited

U.S. PATENT DOCUMENTS 6,604,374 B2 * 8/2003 Ito et al. ..... 62/238.3

FOREIGN PATENT DOCUMENTS

| | | | |
|---|---|---|---|
| JP | 4-148163 | A | 5/1992 |
| JP | 7-265649 | A | 10/1995 |
| JP | 2003-35436 | A | 2/2003 |
| JP | 2003-161465 | A | 6/2003 |
| JP | 2003-202128 | A | 7/2003 |
| JP | 2003-227626 | A | 8/2003 |
| JP | 2003-232540 | A | 8/2003 |
| JP | 2004-11926 | A | 1/2004 |
| JP | 2004-60958 | A | 2/2004 |
| JP | 2004-60966 | A | 2/2004 |
| JP | 2004-353887 | A | 12/2004 |

* cited by examiner

*Primary Examiner*—Marc E Norman
(74) *Attorney, Agent, or Firm*—Birch, Stewart, Kolasch & Birch, LLP

(57) ABSTRACT

A humidity controller (1) has a configuration composed of a cold/hot water circuit (10) through which cold/hot water circulates, an adsorption heat exchanger (20) that is provided in the cold/hot water circuit (10) and supports an adsorbent on its surface, and an air passage (30) that supplies air that has passed through the adsorption heat exchanger (20) at the time of hot water circulation to the inside of a room.

17 Claims, 29 Drawing Sheets

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

(A)

(B)

HUMIDITY CONTROLLER

TECHNICAL FIELD

The present invention relates to a humidity controller, and more particularly to a humidity controller configured to be capable of a humidifying operation.

BACKGROUND ART

Conventionally, as a humidity controller capable of at least a humidifying operation, there is one that is composed of an adsorption element whose honeycomb base member has an air passage supporting an adsorbent on its surface, and a heat pump apparatus using a refrigerant circuit (for example, see patent document 1 and patent document 2). This humidity controller is equipped with a pair of adsorption elements each capable of adsorbing moisture in air and discharging moisture to air. The humidity controller is configured to humidify the inside of a room by alternately changing the following two operations: an operation in which the controller adsorbs moisture from first air with a first adsorption element and discharges the moisture outdoors, and at the same time, gives moisture to second air with a second adsorption element and supplies the moisture to the inside of the room; and an operation in which the controller adsorbs moisture from the first air with the second adsorption element and discharges the moisture outdoors and at the same time, gives moisture to the first air with the first adsorption element and supplies the moisture to the inside of the room.

In the above-mentioned controller, in order to heat air that is to be supplied to the inside of the room before flowing the air to the adsorption element, the above-mentioned heat pump apparatus is used.

Patent document 1: JP 2003-227626

Patent document 2: JP 2003-232540

However, the controller needs to be provided with the adsorption elements and the heat pump apparatus, which poses a problem that the controller becomes complex in configuration and large-sized.

DISCLOSURE OF THE INVENTION

The present invention has been accomplished in view of such problems, and it is an object of the present invention to simplify the configuration of a humidity controller capable of at least a humidifying operation and to make possible the miniaturization of the humidity controller.

This invention constructs a humidity controller capable of a humidifying operation by making heat exchangers (21, 22) of a cold/hot water circuit (10) support an adsorbent on the surfaces of the heat exchangers (21, 22).

Specifically, a first invention is premised on a humidity controller capable of at least a humidifying operation. This humidity controller is characterized by having a cold/hot water circuit (10) through which cold/hot water circulates, an adsorption heat exchanger (20) that is installed in the cold/hot water circuit (10) and supports an adsorbent on the surface of the adsorption heat exchanger (20), and an air passage (30) for supplying air that has passed through the adsorption heat exchanger (20) to the inside of the room or outdoors selectively.

In the first invention, when hot water is flowed through the cold/hot water circuit (10) to heat the adsorption heat exchanger (20), moisture is desorbed from the adsorbent of the adsorption heat exchanger (20), and thereby the adsorbent is recycled. At this time, supplying air that has passed through the adsorption heat exchanger (20) to the inside of the room can humidify the inside of the room. At this time, when moisture no longer desorbs from the adsorption heat exchanger (20), processing of replenishing the adsorbent with moisture is carried out by conducting an operation of halting the circulation of hot water to the adsorption heat exchanger (20) or an operation, for example, of transmitting another air containing moisture through the adsorption heat exchanger (20) while cooling the adsorbent by flowing cold water through the adsorption heat exchanger (20), so that the next operation of humidification is prepared. By doing so, moisture can be supplied to the inside of the room intermittently, which enables the humidity controller to perform a humidifying operation.

According to a second invention, in the humidity controller of the first invention, the adsorption heat exchanger (20) is composed of a first adsorption heat exchanger (21) and a second adsorption heat exchanger (22) as shown in, for example, FIG. 1 and FIG. 2. The first cold/hot water circuit (10) is configured to be switchable between a first cold/hot water circulation state (a state shown in FIG. 1A and FIG. 2A) in which hot water passes through the first adsorption heat exchanger (21) and cold water passes the second adsorption heat exchanger (22) and a second cold/hot water circulation state (a state shown in FIG. 1B and FIG. 2B) in which hot water passes through the second adsorption heat exchanger (22) and cold water passes through the first adsorption heat exchanger (21). The air passage (30) is configured to be switchable between a first air circulation state (a state shown in FIG. 1A and FIG. 2B) in which the air passage (30) supplies air that has passed through the first adsorption heat exchanger (21) to the inside of the room and discharges air that has passed through the second adsorption heat exchanger (22) to the outdoors and a second air circulation state (a state shown in FIG. 1B and FIG. 2A) in which the air passage (30) supplies air that has passed through the second adsorption heat exchanger (22) to the inside of the room and discharges air that has passed through the first adsorption heat exchanger (21) to the outdoors.

In the second invention, when the cold/hot water circuit (10) is switched to the first cold/hot water circulation state and the air passage (30) is switched to the first air circulation state, as shown in FIG. 1A, it becomes possible to recycle the adsorbent of the first adsorption heat exchanger (21) while giving moisture to the adsorbent of the second adsorption heat exchanger (22). By supplying this recycling-side air to the inside of the room, the inside of the room can be humidified. Moreover, when the cold/hot water circuit (10) is switched to the second cold/hot water circulation state and the air passage (30) is switched to the second air circulation state, as shown in FIG. 1B, it becomes possible to recycle the adsorbent of the second adsorption heat exchanger (22) while giving moisture to the adsorbent of the first adsorption heat exchanger (21). By supplying this recycling-side air to the inside of the room, the inside of the room can be humidified. Then, the inside of the room can be continuously humidified by alternately switching the above two operating states.

Moreover, when the cold/hot water circuit (10) is switched to the second cold/hot water circulating state and the air passage (30) is switched to the first air circulation state, as shown in FIG. 2B, moisture is adsorbed by the adsorbent of the first adsorption heat exchanger (21) while recycling the adsorbent of the second adsorption heat exchanger (22). By supplying this adsorption-side air to the inside of the room, the inside of the room can be dehumidified. Moreover, when the cold/hot water circuit (10) is switched to the first cold/hot water circulation state and the air passage (30) is switched to the second air circulation state, as shown in FIG. 2A, moisture is adsorbed by the adsorbent of the second adsorption heat exchanger (22) while recycling the adsorbent of the first adsorption heat exchanger (21). By supplying this adsorption-side air to the inside of the room, the inside of the room can be and dehumidified. Then, by alternately switching the above two operating states, the inside of the room can be continuously dehumidified.

Moreover, when either hot water or cold water is flowed through the cold/hot water circuit (10) and air that has passed through one of the heat exchangers (21, 22) through which the hot water or cold water flows is supplied to the inside of the room, air that carries out a latent heat change at the beginning finally comes to carry out a sensible heat change due to saturation of the adsorbent, and therefore it becomes possible to perform an operation of only heating or cooling.

According to a third invention, in the humidity controller of the second invention, the air passage (30) is configured to supply room air to the adsorption heat exchangers (21, 22) as air to be supplied to the inside of the room after passing through one of the first adsorption heat exchanger (21) and the second adsorption heat exchanger (22) and supply outdoor air to the adsorption heat exchangers (22, 21) as air to be discharged to the outdoors after passing through the other one of the first adsorption heat exchanger (21) and the second adsorption heat exchanger (22).

In the third invention, room air is processed by one of the first adsorption heat exchanger (21) and the second adsorption heat exchanger (22) and subsequently is supplied to the inside of the room again as supply air, while outdoor air is processed by the other one of the first adsorption heat exchanger (21) and the second adsorption heat exchanger (22) and subsequently is discharged to the outdoors again as exhaust air. That is, the humidity controller of this invention serves as what is called a circulation-fan type humidity controller, through which air circulates via one of the adsorption heat exchangers (21, 22) on the indoor side and air also circulates via the other one of the adsorption heat exchangers (21, 22) on the outdoor side.

According to a fourth invention, in the humidity controller of the second invention, as shown in FIG. 3 and FIG. 4, the air passage (30) is configured to supply outdoor air to the adsorption heat exchangers (21, 22) as air to be supplied to the inside of the room after passing through one of the first adsorption heat exchanger (21) and the second adsorption heat exchanger (22) and supply room air to the adsorption heat exchangers (21, 22) as air to be discharged to the outdoors after passing through the other one of the first adsorption heat exchanger (21) and the second adsorption heat exchanger (22).

In the fourth invention, the outdoor air is processed by one of the first adsorption heat exchanger (21) and the second adsorption heat exchanger (22) and subsequently is supplied to the inside of the room as supply air, while the room air is processed by the other one of the first adsorption heat exchanger (21) and the second adsorption heat exchanger (22) and subsequently is discharged to the outdoors as exhaust air. That is, the humidity controller of this invention serves as what is called a ventilation-fan type (the first-kind ventilation system) humidity controller, which conducts charging and discharging of air forcibly by mechanical ventilation.

According to a fifth invention, in the humidity controller of the fourth invention, the air passage (30) is configured to supply outdoor air that has passed through one of the first adsorption heat exchanger (21) and the second adsorption heat exchanger (22) to the inside of the room and discharge room air that has passed through the other one of the first adsorption heat exchanger (21) and the second adsorption heat exchanger (22) to the outdoors in a state in which the cold/hot water circuit (10) is halted, as shown in FIG. 5.

The fifth invention can conduct simply only ventilation in a state in which cold/hot water does not flow through the cold/hot water circuit (10). Moreover, this invention makes possible what is called an outside air cooling operation in which the inside of the room is cooled by supplying outdoor air as it is to the inside of the room when, for example, the outdoor air is lower in temperature than the room air. In this case, outdoor air after simply passing through one of the first adsorption heat exchanger (21) and the second adsorption heat exchanger (22) is supplied to the inside of the room as supply air, while room air after simply passing through the other one of the first adsorption heat exchanger (21) and the second adsorption heat exchanger (22) is discharged to the outdoors as exhaust air.

According to a sixth invention, in the humidity controller of the second invention, the air passage (30) is configured to supply outdoor air to the adsorption heat exchangers (21, 22) as air to be supplied to the inside of the room after passing through one of the first adsorption heat exchanger (21) and the second adsorption heat exchanger (22), and supply outdoor air to the adsorption heat exchangers (22, 21) as air to be discharged to the outdoors after passing through the other one of the first adsorption heat exchanger (21) and the second adsorption heat exchanger (22).

In the sixth invention, the outdoor air is processed by one of the first adsorption heat exchanger (21) and the second adsorption heat exchanger (22) and subsequently is supplied to the inside of the room as supply air, and the outdoor air is processed by the other one of the first adsorption heat exchanger (21) and the second adsorption heat exchanger (22) and subsequently is discharged again to the outdoors as exhaust air. That is, the humidity controller of this invention is a humidity controller of what is called a supply-fan type (the second kind of ventilation system) that supplies air forcefully by mechanical ventilation and discharges air by natural discharge.

According to a seventh invention, in the humidity controller of the second invention, the cold/hot water circuit (10) is configured to be capable of an operation in which only one of cold water and hot water circulates therethrough and circulation of the other one of them is halted.

In the seventh invention, only one of hot water and cold water is flowed in the cold/hot water circuit (10) while switching is conducted between the first cold/hot water circulation state and the second cold/hot water circulation state of the cold/hot water circuit (10) and switching is conducted between the first air circulation state and the second air circulation state of the air passage (30), whereby either a humidifying operation or a dehumidifying operation is performed.

According to an eighth invention, in the humidity controller of the second invention, as shown in, for example, FIG. 1 and FIG. 2, the cold/hot water circuit (10) is equipped with a first four-way selector valve (11) and a second four-way selector valve (12). The each four-way selector valve (11, 12) is configured to be switchable between a first state in which a first port (P1) and a second port (P2) communicate with each other and a third port (P3) and a fourth port (P4) communicate with each other and a second state in which the first port (P1) and the third port (P3) communicate with each other and the second port (P2) and the fourth port (P4) communicate with each other. A hot water inflow pipe (13) is connected to the first port (P1) of the first four-way selector valve (11). A first circulating pipe (14) that communicates with a heat exchange pipe of the first adsorption heat exchanger (21) is connected to the second port (P2) of the first four-way selector valve (11) and the third port (P3) of the second four-way selector valve (12). A hot water outflow pipe (15) is connected to the fourth port (P4) of the second four-way selector valve (12). A cold water inflow pipe (16) is connected to the first port (P1) of the second four-way selector valve (12). A second circulating pipe (17) that communicates with a heat exchange pipe of the second adsorption heat exchanger (22) is connected to the second port (P2) of the second four-way selector valve (12) and the third port (P3) of the first four-way selector valve (11). A cold water outflow pipe (18) is connected to the fourth port (P4) of the first four-way selector valve (11).

In the eighth invention, when the each four-way selector valve (11,12) is switched to the first state, as shown in FIG. 1A and FIG. 2A, the cold/hot water circuit (10) turns into the first cold/hot water circulation state. In this state, hot water passes through the hot water inflow pipe (13) and the first circulating pipe (14), flows through the first adsorption heat exchanger (21), and subsequently is discharged from the hot water outflow pipe (15), while cold water passes through the cold water inflow pipe (16) and the second circulating pipe (17), flows through the second adsorption heat exchanger (22), and subsequently is discharged from the cold water outflow pipe (18). Moreover, when the each four-way selector valve (11,12) is switched to the second state, as shown in FIG. 1B and FIG. 2B, the cold/hot water circuit (10) turns into the second cold/hot water circulation state. In this state, the hot water passes through the hot water inflow pipe (13) and the second circulating pipe (17), flows through the second adsorption heat exchanger (22), and subsequently is discharged from the hot water outflow pipe (15), while the cold water passes through the cold water inflow pipe (16) and the first circulating pipe (14), flows through the first adsorption heat exchanger (21), and subsequently is discharged from the cold water outflow pipe (18).

In the eighth invention, when the cold/hot water circuit (10) is switched to the first cold/hot water circulation state or the second cold/hot water circulation state by switching the each four-way selector valve (11, 12) to the first state or the second state, the hot water flows through the circulating pipes (17, 14) and the adsorption heat exchanger (22, 21) through which the cold water flowed till that time, and conversely the cold water flows through the circulating pipes (17, 14) and the adsorption heat exchanger (22, 21) through which the hot water flowed till that time.

According to a ninth invention, the humidity controller of the second invention, as shown in FIG. 9 and FIG. 10, further includes a first adsorption cooling element (41) and a second adsorption cooling element (42). Each of the adsorption cooling elements (41, 42) is equipped with a humidity control passage (40*a*) capable of adsorbing and desorbing moisture in/to air and a cooling passage (40*b*) for absorbing adsorption heat produced when moisture is adsorbed in the humidity control passage (40*a*) with cooling air. The air passage (30) is configured to be able to set an air passage for humidifying operation and an air passage for dehumidifying operation. The air passage for humidifying operation is configured to be switchable between the following two states: the first air circulation state (a state of FIG. 9A) in which the air passage supplies air that has passed through the cooling passage (40*b*) of the second adsorption cooling element (42), the first adsorption heat exchanger (21), and the humidity control passage (40*a*) of the first adsorption cooling element (41) to the inside of the room and also discharges air that has passed through the second adsorption heat exchanger (22) and the humidity control passage (40*a*) of the second adsorption cooling element (42) to the outdoors; and the second air circulation state in which the air passage supplies air that has passed through the cooling passage (40*b*) of the first adsorption cooling element (41), the second adsorption heat exchanger (22), and the humidity control passage (40*a*) of the second adsorption cooling element (42) to the inside of the room and also discharges air that has passed through the first adsorption heat exchanger (21) and the humidity control passage (40*a*) of the first adsorption cooling element (41) to the outdoors. The air passage for dehumidifying operation is configured to be switchable between the following two states: the first air circulation state (a state of FIG. 10B) in which the air passage supplies air that has passed through the first adsorption heat exchanger (21) and the humidity control passage (40*a*) of the first adsorption cooling element (41) to the inside of the room and also discharges air that has passed through the cooling passage (40*b*) of the first adsorption heat exchanger (41), the second adsorption heat exchanger (22), and the humidity control passage (40*a*) of the second adsorption cooling element (42) to the outdoors; and the second air circulation state (a state of FIG. 10A) in which the air passage supplies air that has passed through the second adsorption heat exchanger (22) and the humidity control passage (40*a*) of the second adsorption cooling element (42) to the inside of the room and also discharges air that has passed through the cooling passage (40*b*) of the second adsorption cooling element (42), the first adsorption heat exchanger (21), and the humidity control passage (40*a*) of the first adsorption cooling element (41) to the outdoors.

In the ninth invention, as shown in FIG. 9A, when the cold/hot water circuit (10) is switched to the first cold/hot water circulation state and the air passage (30) for humidifying operation is switched to the first air circulation state, the adsorbent of the first adsorption heat exchanger (21) and the first adsorption cooling element (41) is recycled while moisture is given to the adsorbent of the second adsorption heat exchanger (22) and the second adsorption cooling element (42). By supplying this recycling-side air to the inside of the room, the inside of the room can be humidified. In this occasion, the recycling-side air is heated by absorbing the adsorption heat when passing through the cooling passage (40*b*) of the second adsorption cooling element (42), subsequently is humidified by the first adsorption heat exchanger (21) and the first adsorption cooling element (41), and is supplied to the inside of the room. Moreover, as shown in FIG. 9B, when the cold/hot water circuit (10) is switched to the second cold/hot water circulation state and the air passage (30) for humidifying operation is switched to the second air circulation state, the adsorbent of the second adsorption heat exchanger (22) and the second adsorption cooling element (42) is recycled while moisture is given to the adsorbent of the first adsorption heat exchanger (21) and the first adsorption cooling element (41). By supplying this recycling-side air to the inside of the room, the inside of the room can be humidified. In this occasion, the recycling-side air is heated by absorbing the adsorption heat when passing through the cooling passage (40*b*) of the first adsorption cooling element (41), subsequently is humidified by the second adsorption heat exchanger (22) and the second adsorption cooling element (42), and is supplied to the inside of the room. Then, by alternately switching the above two operating states, the inside of the room can be continuously humidified.

Moreover, when the cold/hot water circuit (10) is switched to the second cold/hot water circulation state and the air passage (30) for dehumidifying operation is switched to the first air circulation state, as shown in FIG. 10B, moisture is adsorbed by the adsorbent of the first adsorption heat exchanger (21) and the first adsorption cooling element (41) while the adsorbent of the second adsorption heat exchanger (22) and the second adsorption cooling element (42) is recycled. By supplying this adsorption-side air to the inside of the room, the inside of the room can be dehumidified. In this occasion, the adsorption-side air is dehumidified by the first adsorption heat exchanger (21), subsequently is further dehumidified when passing through the humidity control passage (40*a*) of the first adsorption cooling element (41), radiates the adsorption heat into air of the cooling passage (40*b*), and is supplied to the inside of the room. Moreover, when the cold/hot water circuit (10) is switched to the first cold/hot water circulation state and the air passage (30) for dehumidifying operation is switched to the second air circulation state, as shown in FIG. 10A, moisture is adsorbed by the adsorbent of the second adsorption heat exchanger (22) and the second adsorption cooling element (42) while the adsorbent of the first adsorption heat exchanger (21) and the first adsorption cooling element (41) is recycled. By supplying this adsorption-side air to the inside of the room, the inside of the room can be dehumidified. In this occasion, the adsorption-side air is dehumidified by the second adsorption heat exchanger (22), subsequently is further dehumidified when passing through the humidity control passage (40*a*) of the second adsorption cooling element (42) and at the same time radiating the adsorption heat to the air in the cooling passage (40*b*), and is supplied to the inside of the room. Then, by alternately switching the above two operating states, the inside of the room can be continuously dehumidified.

According to a tenth invention, the humidity controller of the second invention further includes a refrigerant circuit (50) for conducting a refrigerating cycle of circulating a refrigerant. A heat exchanger of the refrigerant circuit (50) is composed of a third adsorption heat exchanger (53) and a fourth adsorption heat exchanger (55) that support an adsorbent on the surfaces of the third adsorption heat exchanger (53) and the fourth adsorption heat exchanger (55). The refrigerant circuit (50) is configured to be switchable between a first refrigerant circulation state (a state of FIG. 11A and FIG. 12A) in which the third adsorption heat exchanger (53) serves as a condenser and the fourth adsorption heat exchanger (55) serves as an evaporator and a second refrigerant circulation state (a state of FIG. 11B and FIG. 12B) in which the fourth adsorption heat exchanger (55) serves as a condenser and the third adsorption heat exchanger (53) serves as an evaporator. The air passage (30) is configured to be switchable between the following two states: the first air circulation state (a state of FIG. 11A and FIG. 12B) in which the air passage (30) supplies air that has passed through the third adsorption heat exchanger (53) and the first adsorption heat exchanger (21) to the inside of the room and also discharges air that has passed through the fourth adsorption heat exchanger (55) and the second adsorption heat exchanger (22) to the outdoors; and the second air circulation state (a state of FIG. 11B and FIG. 12A) in which the air passage (30) supplies air that has passed through the fourth adsorption heat exchanger (55) and the second adsorption heat exchanger (22) to the inside of the room and also discharges air that has passed through the third adsorption heat exchanger (53) and the first adsorption heat exchanger (21) to the outdoors.

In the tenth invention, when the cold/hot water circuit (10) is switched to the first cold/hot water circulation state, the refrigerant circuit (50) is switched to the first refrigerant circulation state, and the air passage (30) is switched to the first air circulation state, as shown in FIG. 11A, the adsorbent of the third adsorption heat exchanger (53) and the first adsorption heat exchanger (21) is recycled while moisture is given to the adsorbent of the fourth adsorption heat exchanger (55) and the second adsorption heat exchanger (22). By supplying this recycling-side air to the inside of the room, the inside of the room can be humidified. Moreover, when the cold/hot water circuit (10) is switched to the second cold/hot water circulation state, the refrigerant circuit (50) is switched to the second refrigerant circulation state, and the air passage (30) is switched to the second air circulation state, as shown in FIG. 11B, the adsorbent of the fourth adsorption heat exchanger (55) and the second adsorption heat exchanger (22) is recycled while moisture is given to the adsorbent of the third adsorption heat exchanger (53) and the first adsorption heat exchanger (21). By supplying this recycling-side air to the inside of the room, the inside of the room can be humidified. Then, by alternately switching the above two operating states, the inside of the room can be continuously humidified.

Moreover, when the cold/hot water circuit (10) is switched to the second cold/hot water circulation state, the refrigerant circuit (50) is switched to the second refrigerant circulation state, and the air passage (30) is switched to the first air circulation state, as shown in FIG. 12B, moisture is adsorbed by the adsorbent of the third adsorption heat exchanger (53) and the first adsorption heat exchanger (21) while the adsorbent of the fourth adsorption heat exchanger (55) and the second adsorption heat exchanger (22) is recycled. By supplying this adsorption-side air to the inside of the room, the inside of the room can be dehumidified. Moreover, when the cold/hot water circuit (10) is switched to the first cold/hot water circulation state, the refrigerant circuit (50) is switched to the first refrigerant circulation state, and the air passage (30) is switched to the second air circulation state, as shown in FIG. 12A, moisture is adsorbed by the adsorbent of the fourth adsorption heat exchanger (55) and the second adsorption heat exchanger (22) while the adsorbent of the third adsorption heat exchanger (53) and the first adsorption heat exchanger (21) is recycled. By supplying this adsorption-side air to the inside of the room, the inside of the room can be dehumidified. Then, by alternately switching the above two operating states, the inside of the room can be continuously dehumidified.

It is noted that in this invention, either of the first adsorption heat exchanger (21) or the third adsorption heat exchanger (53) may be on the upstream side of the air passage (30), and either of the second adsorption heat exchanger (22) or the fourth adsorption heat exchanger (55) may be on the upstream side of the air passage (30).

According to an eleventh invention, the humidity controller of the second invention further includes a refrigerant circuit (60) for operating a refrigeration cycle with the circulating refrigerant. A heat exchanger of the refrigerant circuit (60) is composed of a first air heat exchanger (63) and a second air heat exchanger (65) with air therein carrying out a sensible heat change by heat exchange between air and the refrigerant. The refrigerant circuit (60) is configured to be switchable between the first refrigerant circulation state (state of FIG. 13A and FIG. 14A) in which the first air heat exchanger (63) serves as a condenser and the second air heat exchanger (65) serves as an evaporator and the second refrigerant circulation state (state of FIG. 13B and FIG. 14B) in which the second air heat exchanger (65) serves as a condenser and the first air heat exchanger (63) serves as an evaporator. The air passage (30) is configured to be switchable between the following two states: the first air circulation state (a state of FIG. 13A and FIG. 14B) in which the air passage (30) supplies air that has passed through the first adsorption heat exchanger (21) and the first air heat exchanger (63) to the inside of the room and also discharges air that has passed through the second adsorption heat exchanger (22) and the second air heat exchanger (65) to the outdoors; and the second air circulation state (a state of FIG. 13B and FIG. 14A) in which the air passage (30) supplies air that has passed through the second adsorption heat exchanger (22) and the second air heat exchanger (65) to the inside of the room and also discharges air that has passed through the first adsorption heat exchanger (21) and the first air heat exchanger (63) to the outdoors.

In the eleventh invention, when the cold/hot water circuit (10) is switched to the first cold/hot water circulation state, the refrigerant circuit (60) is switched to the first refrigerant circulation state, and the air passage (30) is switched to the first air circulation state, as shown in FIG. 13A, the adsorbent of the first adsorption heat exchanger (21) is recycled while moisture is given to the adsorbent of the second adsorption heat exchanger (22). By supplying this recycling-side air to the inside of the room, the inside of the room can be humidified. In this occasion, the recycling-side air is humidified by the first adsorption heat exchanger (21), is heated by the first air heat exchanger (63), and is supplied to the inside of the room. Moreover, when the cold/hot water circuit (10) is switched to the second cold/hot water circulation state, the refrigerant circuit (60) is switched to the second refrigerant circulation state, and the air passage (30) is switched to the second air circulation state, as shown in FIG. 13B, the adsorbent of the second adsorption heat exchanger (22) is recycled while moisture is given to the adsorbent of the first adsorption heat exchanger (21). By supplying this recycling-side air to the inside of the room, the inside of a room can be humidified. In this occasion, the recycling-side air is humidified by the second adsorption heat exchanger (22), is heated by the second air heat exchanger (65), and is supplied to the inside of the room. Then, by alternately switching the above two operating states, the inside of the room can be continuously humidified.

Moreover, when the cold/hot water circuit (10) is switched to the second cold/hot water circulation state, the refrigerant circuit (60) is switched to the second refrigerant circulation state, and the air passage (30) is switched to the first air circulation state, as shown in FIG. 14B, moisture is adsorbed by the adsorbent of the first adsorption heat exchanger (21), while the adsorbent of the second adsorption heat exchanger (22) is recycled. By supplying this adsorption-side air to the inside of the room, the inside of the room can be dehumidified. In this occasion, the adsorption-side air is dehumidified by the first adsorption heat exchanger (21), is cooled by the first air heat exchanger (63), and is supplied to the inside of the room. Moreover, when the cold/hot water circuit (10) is switched to the first cold/hot water circulation state, the refrigerant circuit (60) is switched to the first refrigerant circulation state, and the air passage (30) is switched to the second air circulation state, as shown in FIG. 14A, moisture is adsorbed by the adsorbent of the second adsorption heat exchanger (22) while the adsorbent of the first adsorption heat exchanger (21) is recycled. By supplying the adsorption-side air to the inside of the room, the inside of the room can be dehumidified. In this occasion, the adsorption-side air is dehumidified by the second adsorption heat exchanger (22), is cooled by the second air heat exchanger (65), and is supplied to the inside of the room. Then, by alternately switching the above two operating states, the inside of the room can be continuously dehumidified.

According to a twelfth invention, the humidity controller of the second invention further includes an auxiliary heat exchanger (70). The auxiliary heat exchanger (70) is equipped with a first passage (71) through which first air flows and a second passage (72) through which second air flows, and is configured to let the air flowing through the first passage (71) and the air flowing through the second passage (72) conduct a total heat exchange or a sensible heat exchange. The air passage (30) is configured to be switchable between the following two states: the first air circulation state (a state of FIG. 15A and FIG. 16B) in which the air passage (30) supplies air that has passed through the first passage (71) of the auxiliary heat exchanger (70) and the first adsorption heat exchanger (21) to the inside of the room and also discharges air that has passed through the second passage (72) of the auxiliary heat exchanger (70) and the second adsorption heat exchanger (22) to the outdoors; and the second air circulation state (a state of FIG. 15B and FIG. 16A) in which the air passage (30) supplies air that has passed through the second passage (72) of the auxiliary heat exchanger (70) and the second adsorption heat exchanger (22) to the inside of the room and also discharges air that has passed through the first passage (71) of the auxiliary heat exchanger (70) and the first adsorption heat exchanger (21) to the outdoors.

In the twelfth invention, when the cold/hot water circuit (10) is switched to the first cold/hot water circulation state and the air passage (30) is switched to the first air circulation state, the adsorbent of the first adsorption heat exchanger (21) is recycled while moisture is given to the adsorbent of the second adsorption heat exchanger (22). By supplying this recycling-side air to the inside of the room, the inside of the room can be humidified. In this occasion, the recycling-side air is heated/humidified by the auxiliary heat exchanger (70), is also humidified by the first adsorption heat exchanger (21), and is supplied to the inside of the room. Moreover, when the cold/hot water circuit (10) is switched to the second air circulation state and the air passage (30) is switched to the second cold/hot water circulation state, as shown in FIG. 15B, the adsorbent of the second adsorption heat exchanger (22) is recycled while moisture is given to the adsorbent of the first adsorption heat exchanger (21). By supplying this recycling-side air to the inside of the room, the inside of the room can be humidified. In this occasion, the recycling-side air is heated/humidified by the auxiliary heat exchanger (70), is also humidified by the second adsorption heat exchanger (22), and is supplied to the inside of the room. Then, by alternately changing the above two operating states, the inside of the room can be continuously humidified.

Moreover, when the cold/hot water circuit (10) is switched to the second cold/hot water circulation state and the air passage (30) is switched to the first air circulation state, as shown in FIG. 16B, moisture is adsorbed by the adsorbent of the first adsorption heat exchanger (21) while the adsorbent of the second adsorption heat exchanger (22) is recycled. By supplying this absorption-side air to the inside of the room, the inside of the room can be dehumidified. In this occasion, the adsorption-side air is cooled/dehumidified by the auxiliary heat exchanger (70), is dehumidified by the first adsorption heat exchanger (21), and is supplied to the inside of the room. Moreover, when the cold/hot water circuit (10) is switched to the first cold/hot water circulation state and the air passage (30) is switched to the second air circulation state, as shown in FIG. 16A, moisture is adsorbed by the adsorbent of the second adsorption heat exchanger (22) while the adsorbent of the first adsorption heat exchanger (21) is recycled. By supplying this absorption-side air to the inside of the room, the inside of the room can be dehumidified. In this occasion, the adsorption-side air is cooled/dehumidified by the auxiliary heat exchanger (70), is dehumidified by the second adsorption heat exchanger (22), and is supplied to the inside of the room. Then, by alternately switching the above two operating states, the inside of the room can be continuously dehumidified.

According to a thirteenth invention, the humidity controller of the second invention further includes control means for setting a time interval at which the cold/hot water circulation state of the cold/hot water circuit (10) and the air circulation state of the air passage (30) are switched according to a latent heat load of the inside of the room. The control means is configured such that the setting value of the time interval is made smaller with increasing latent heat load of the inside of the room.

In the thirteenth invention, the larger the latent heat load of the inside of the room, the smaller the time interval at which the cold/hot water circulation state of cold/hot water circuit (10) and the air circulation state of the air passage (30) are switched becomes, which results in a larger amount of latent heat processing; conversely, the smaller the latent heat load of the inside of the room, the larger the time interval becomes, which results in a smaller amount of latent heat processing.

According to a fourteenth invention, in the humidity controller of the second invention, a cold heat source (81) for supplying cold water cooled by a refrigerator (90) is connected to the cold/hot water circuit (10). Here, the "refrigerator" may be any kind of refrigerator, as long as the refrigerator has a capability of cooling, such as a steam compression type refrigerator for operating a refrigerating cycle of a vapor compression type with the circulating refrigerant and an absorption refrigerator for conducting a refrigerating cycle using a process of making an absorbent etc. absorb refrigerant vapor.

In the fourteenth invention, the cold heat source (81) is connected to the cold/hot water circuit (10). The cold water cooled by the refrigerator (90) flows into this cold heat source (81), and this cold water is supplied to the cold/hot water circuit (10). Then, this cold water is used to cool the adsorbent of the first adsorption heat exchanger (21) and the second adsorption heat exchanger (22).

According to a fifteenth invention, in the humidity controller of the fourteenth invention, the cold heat source (81) for supplying cold water cooled by the refrigerator (90) and a hot heat source (82) for supplying hot water heated by heat radiated from the refrigerator (90) are connected to the cold/hot water circuit (10).

In the fifteenth invention, the cold heat source (81) and the hot heat source (82) are connected to the cold/hot water circuit (10). Here, the cold water cooled by the refrigerator (90) flows into the cold heat source (81), and this cold water is supplied to the cold/hot water circuit (10). Then, this cold water is used to cool the adsorbent of the first adsorption heat exchanger (21) and the second adsorption heat exchanger (22).

On the other hand, the hot water heated by heat radiated from the refrigerator (90) flows into the hot heat source (82), and this hot water is supplied to the cold/hot water circuit (10). Then, this hot water is used to heat and recycle the adsorbent of the first adsorption heat exchanger (21) and the second adsorption heat exchanger (22).

According to a sixteenth invention, in the humidity controller of the second invention, hot heat sources (81, 82) for supplying hot water heated by the refrigerator (90) or a boiler (95) are connected to the cold/hot water circuit (10).

In the sixteenth invention, the hot heat source (82) is connected to the cold/hot water circuit (10). The hot water heated by the refrigerator (90) or the boiler (95) flows into this hot heat source (82), and this hot water is supplied to the cold/hot water circuit (10). Then, this hot water is used to heat and recycle the adsorbent of the first adsorption heat exchanger (21) and the second adsorption heat exchanger (22).

According to a seventeenth invention, in the humidity controller of the second invention, the cold heat source (81) for supplying cold water cooled by cold heat being thermally stored in a thermal storage device (101) is connected to the cold/hot water circuit (10). Here, the "thermal storage device" may be a sensible-heat type thermal storage device that acquires cold heat using a temperature difference of water, or may be a latent-heat type thermal storage device that acquires cold heat using latent heat of melting of ice.

In the seventeenth invention, the cold water cooled by the cold heat being thermally stored in the thermal storage device (101) flows through the cold heat source (81), and this cold water is supplied to the cold/hot water circuit (10). Then, this cold water is used to cool the adsorbent of the first adsorption heat exchanger (21) and the second adsorption heat exchanger (22).

According to an eighteenth invention, in the humidity controller of the second invention, the hot heat source (82) for supplying hot water heated by hot heat being thermally stored in the thermal storage device is connected to the cold/hot water circuit (10).

In the eighteenth invention, the hot water heated by hot heat being thermally stored in a thermal storage device (102) flows through the hot heat source (82) and this hot water is supplied to the cold/hot water circuit (10). Then, this hot water is used to heat and recycle the adsorbent of the first adsorption heat exchanger (21) and the second adsorption heat exchanger (22).

EFFECTS OF THE INVENTION

According to the first invention, since a heat exchanger is installed in the cold/hot water circuit (10) through which cold/hot water circulates and this heat exchanger is made to serve as the adsorption heat exchanger (20), the inside of the room can be humidified by using an effect that flowing of hot water in the cold/hot water circuit (10) causes the adsorbent of the adsorption heat exchanger (20) to desorb moisture. Then, by providing the adsorption heat exchanger (20) in the cold/hot water circuit (10) in the above manner, it becomes possible to simplify the configuration and miniaturize the controller compared with the conventional humidity controller using an adsorption element and a heat pump apparatus.

According to the second invention, the cold/hot water circuit (10) is configured to be switchable between the first cold/hot water circulation state and the second cold/hot water circulation state, making the following states switchable: a state in which the cold water flows through the adsorption heat exchangers (21, 22) and a state in which the hot water flows therethrough, and also the air passage (30) is configured to be switchable between the first air circulation state and the second air circulation state. By this configuration, either the recycling-side air or the adsorption-side air can be supplied to the inside of the room selectively. Thus, the humidity controller capable of continuously performing a humidifying operation and a dehumidifying operation using the cold/hot water circuit (10) and the adsorption heat exchangers (21, 22) can be realized with the simple configuration.

According to the third invention, in what is called a circulation-fan type humidity controller, it becomes possible to realize miniaturization and simplification of the controller by specifying the heat exchangers of the cold/hot water circuit (10) as the adsorption heat exchangers (21, 22).

According to the fourth invention, in what is called a ventilation-fan type humidity controller, it becomes possible to realize miniaturization and simplification of the controller by specifying the heat exchangers of the cold/hot water circuit (10) as the adsorption heat exchangers (21, 22).

According to the fifth invention, in what is called a ventilation-fan type humidity controller capable of simple ventilation and outside cooling, it becomes possible to realize miniaturization and simplification of the controller by specifying the heat exchangers of the cold/hot water circuit (10) as the adsorption heat exchangers (21, 22).

According to the sixth invention, in what is called an air-supply-fan type humidity controller, it becomes possible to realize miniaturization and simplification of the controller by specifying the heat exchangers of the cold/hot water circuit (10) as the adsorption heat exchangers (21, 22).

According to the seventh invention, the cold/hot water circuit (10) is configured to be capable of an operation whereby only one of hot water and cold water circulates through the cold/hot water circuit (10) and the other one of them is halted. In this case, humidification capacity or dehumidification capacity declines slightly compared with the controller of claim 2. However, if the controller itself is configured to allow only one of hot water and cold water circulate therethrough, a cold water supply system or a hot water supply system becomes unnecessary and therefore it becomes possible to simplify the configuration.

According to the eighth invention, since the controller is configured to be switched between the first cold/hot water circulation state and the second cold/hot water circulation state, when the circulation state is switched over, the cold water in the adsorption heat exchangers (21, 22) through which cold water was flowing till that time is carried away by the hot water and conversely the hot water in the adsorption heat exchangers (21, 22) through which hot water was flowing till that time is carried away by the cold water. Because of this, the cold water and the hot water are not left in the adsorption heat exchangers (21, 22), and heat exchange efficiency is not lowered.

Here, in order to switch between the first cold/hot water circulation state and the second cold/hot water circulation state, a configuration using four solenoid valves (shut-off valves) is also possible, as shown in FIG. 17. In this example, the heat exchange pipes of the adsorption heat exchangers (101, 102) are branched into hot-water-side paths (101*a*, 102*a*) and cold-water-side paths (101*b*, 102*b*), and a hot water inflow pipe (103) is branched into two pipes including branch pipes (104*a*, 104*b*), which are connected to the hot water inflow sides of the adsorption heat exchangers (101, 102) through solenoid valves (shut-off valves) (105*a*, 105*b*), respectively, and the hot-water-outflow sides of the adsorption heat exchangers (101, 102) are connected to a hot water outflow pipe (107) using two junction pipes (106*a*, 106*b*). Moreover, a cold water inflow pipe (108) is branched into two pipes including branch pipes (109*a*, 109*b*), which are connected to cold water inflow sides of the adsorption heat exchangers (101, 102) through solenoid valves (shut-off valves) (110*a*, 110*b*), respectively, and the cold water outflow sides of the adsorption heat exchangers (101, 102) are connected to a cold water outflow pipe (112) using two junction pipes (111*a*, 111*b*).

However, if the controller is configured in the above manner, when a cold/hot water circuit (100) is switched to either of the first cold/hot water circulation state of FIG. 17A or the second cold/hot water circulation state of FIG. 17B, the cold water is left in cold-water-side paths (101*b*, 102*b*) of the adsorption heat exchangers (101, 102) through which the hot water circulates, and conversely the hot water is left in the hot-water-side paths (101*a*, 102*a*) of the adsorption heat exchangers (101, 102) through which the cold water circulates (see thick sold line parts of FIG. 17 for parts through which water circulates and see thin sold line parts of FIG. 17 for parts where water is left). This lowers heat exchange efficiency.

It is noted that the same circuit can be built up by installing three-way valves (not shown) at connection points between the hot water inflow pipe (103) and the two branch pipes (104*a*, 104*b*) and at connection points between the cold water inflow pipe (108) and two branch pipes (109*a*, 109*b*), instead of the four solenoid valves (105*a*, 105*b*) (110*a*, 110*b*). However, even in that case, the cold water is left in the cold-water-side paths (101*b*, 102*b*) of the adsorption heat exchangers (101, 102) through which the hot water circulates, and conversely the hot water is left in the hot-water-side paths (101*a*, 102*a*) of the adsorption heat exchangers (101, 102) through which cold water circulates. Thus, the same problem occurs as that in the circuit using the solenoid valves (105*a*, 105*b*) (110*a*, 110*b*).

According to the ninth invention, since it is configured that an adsorption cooling element (40) is further used in addition to the adsorption heat exchangers (21, 22) of the cold/hot water circuit (10), dehumidification and humidification performance of the controller can be enhanced. Moreover, although the controller has this high performance, since the adsorption heat exchangers (21, 22) are used, enlargement of the controller can also be prevented.

According to the tenth invention, since it is configured that adsorption heat exchangers (53, 55) of the refrigerant circuit (50) are further used in addition to the adsorption heat exchangers (21, 22) of the cold/hot water circuit (10), dehumidification and humidification performance of the controller can be enhanced. Moreover, although the controller has this high performance, since the adsorption heat exchangers (20, 53, and 55) are used, enlargement of the controller can also be prevented.

According to the eleventh invention, since it is configured that air heat exchangers (63, 65) of a refrigerant circuit (60) are further used, cooling and heating performance of the controller can be enhanced. Moreover, although the controller has this high performance, since the adsorption heat exchangers (21, 22) are used, enlargement of the controller can also be prevented.

According to the twelfth invention, it is configured to further use the auxiliary heat exchanger (70) in addition to the adsorption heat exchangers (21, 22) of the cold/hot water circuit (10), cooling and heating performance and/or dehumidification and humidification performance of the controller can be enhanced. Moreover, although the controller has this high performance, since the adsorption heat exchangers (21, 22) are used, enlargement of the controller can also be prevented.

According to the thirteenth invention, the larger the latent heat load of the inside of the room, the smaller the above-mentioned time interval at which cold/hot water circulation state of the cold/hot water circuit (10) and the air circulation state of the air passage (30) are switched becomes, which results in a larger amount of latent heat processing; while, conversely, the smaller the latent heat load of the inside of the room, the larger the above-mentioned time interval becomes, which results in a smaller amount of latent heat processing. Thus, a comfortable operation control according to the latent heat load of the inside of the room can be performed.

According to the fourteenth invention, in order to cool the adsorbent of the first adsorption heat exchanger (21) and the second adsorption heat exchanger (22) by the cold/hot water circuit (10), it is configured to use cold water cooled by the refrigerator (90). Thus, the adsorbent can be cooled with an easy and simple configuration, and the moisture adsorption effect of the adsorbent can be enhanced.

According to the fifteenth invention, in order to cool the adsorbent of the first adsorption heat exchanger (21) and the second adsorption heat exchanger (22) by the cold/hot water circuit (10), it is configured to use cold water cooled by the refrigerator (90). At the same time, in order to heat and recycle the adsorbent of the first adsorption heat exchanger (21) and the second adsorption heat exchanger (22), it is configured to use hot water heated by heat radiated from the refrigerator (90). Thus, the adsorbent can be cooled with the easy and simple configuration, and at the same time the adsorbent can be heated and recycled using the radiated heat of the refrigerator (90).

According to the sixteenth invention, in order to heat recycle the adsorbent of the first adsorption heat exchanger (21) and the second adsorption heat exchanger (22) by the cold/hot water circuit (10), it is configured to use hot water heated by the refrigerator (90) or the boiler (95). Thus, the adsorbent can be reliably heated and recycled with the easy and simple configuration.

According to the seventeenth invention, in order to cool the adsorbent of the first adsorption heat exchanger (21) and the second adsorption heat exchanger (22) by the cold/hot water circuit (10), it is configured to use cold heat being thermally stored in the thermal storage device (101). Accordingly, a reduction in heat source capacity can be attained, and additionally a reduction in power incoming unit capacity and a reduction in electricity rate can be attained.

According to the eighteenth invention, in order to heat and recycle the adsorbent of the first adsorption heat exchanger (21) and the second adsorption heat exchanger (22) by the cold/hot water circuit (10), it is configured to use hot water heated by the hot heat being thermally stored in the thermal storage device (102). Thus, as in the seventeenth invention, a reduction in heat source capacity can be attained, and additionally a reduction in power receiving unit capacity and a reduction in electricity rate can be attained.

Figure 1:
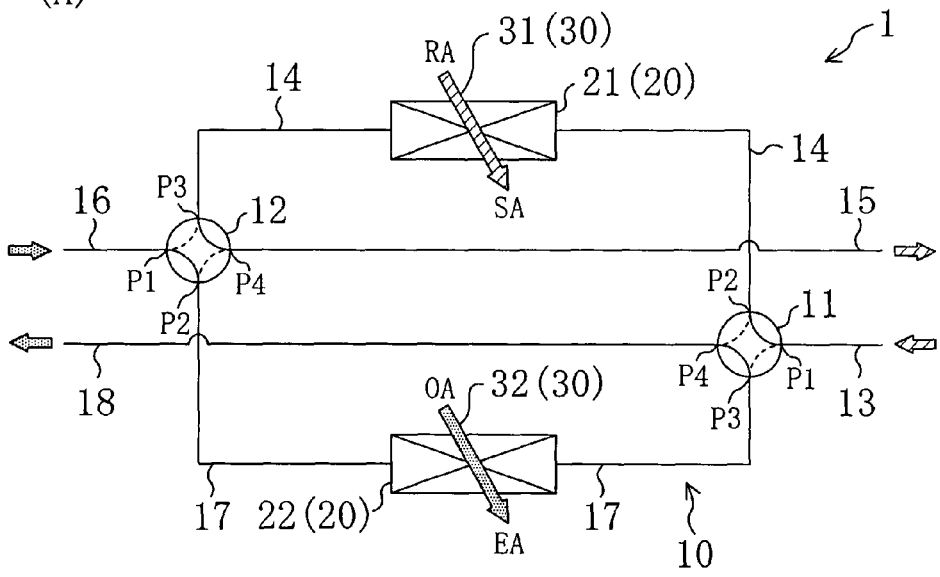
FIG. 1 is a circuit diagram showing a humidifying operating state of a humidity controller according to a first embodiment.
Figure 1:
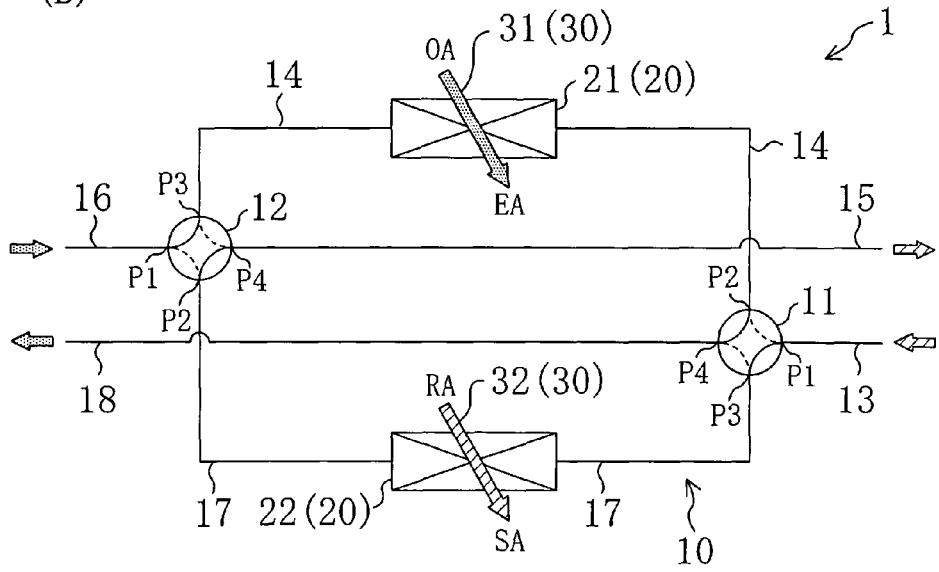

DESCRIPTION OF REFERENCE NUMERAL (1) humidity controller
(10) cold/hot water circuit
(11) first four-way selector valve
(12) second four-way selector valve
(13) hot water inflow pipe
(14) first circulating pipe
(15) hot water outflow pipe
(16) cold water inflow pipe
(17) second circulating pipe
(18) cold water outflow pipe
(20) adsorption heat exchanger
(21) first adsorption heat exchanger
(22) second adsorption heat exchanger
(30) air passage
(31) air passage
(32) air passage
(40) adsorption cooling element
(40*a*) humidity control passage
(40*b*) cooling passage
(41) first adsorption cooling element
(42) second adsorption cooling element
(50) refrigerant circuit
(51) compressor
(52) third four-way selector valve
(53) third adsorption heat exchanger
(54) expansion valve
(55) fourth adsorption heat exchanger
(60) refrigerant circuit
(61) compressor
(62) third four-way selector valve
(63) first air heat exchanger
(64) expansion valve
(65) second air heat exchanger
(70) auxiliary heat exchange
(71) first passage
(72) second passage
(P1) first port
(P2) second port
(P3) third port
(P4) fourth port
(81) first heat source circuit (cold heat source)
(82) first heat source circuit (cold heat source or hot heat source)
(90) refrigerator
(95) boiler
(101) thermal storage device
(102) thermal storage device

DETAILED DESCRIPTION OF THE PREFERRED EMBODIMENTS

Hereafter, embodiments of the present invention will be described in detail based on the drawings.

First Embodiment

Figure 2:
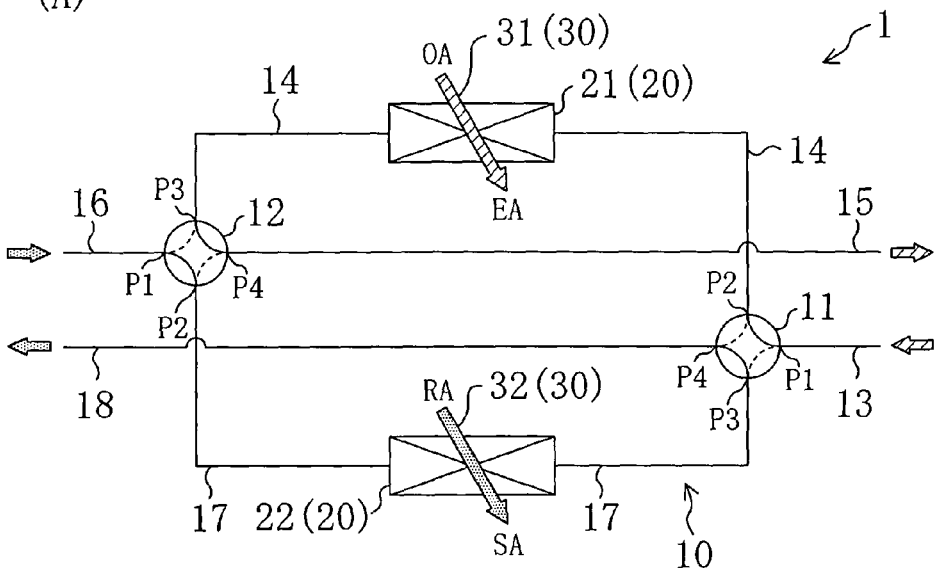
FIG. 2 is a circuit diagram showing a dehumidifying operating state of the humidity controller according to the first embodiment.
Figure 2:
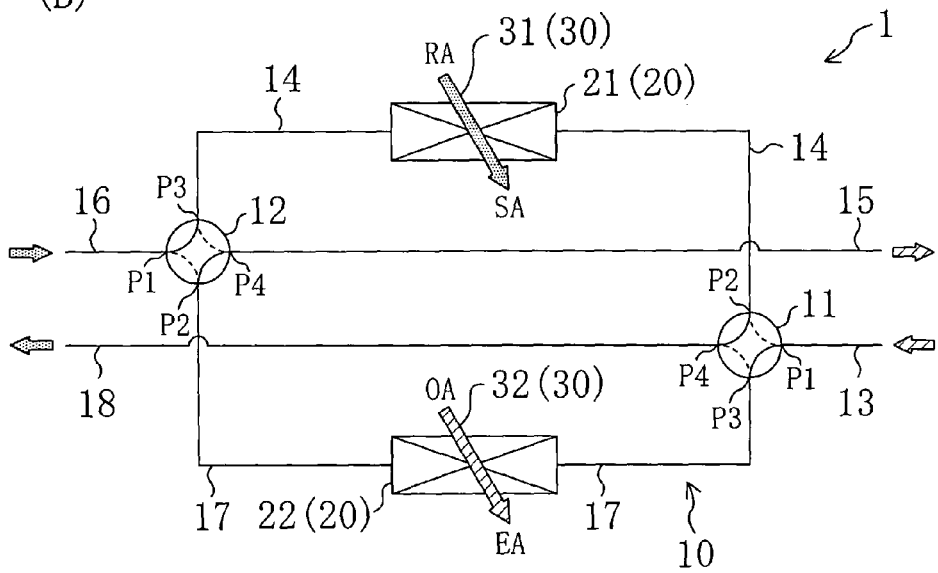

As shown in FIG. 1 and FIG. 2, a humidity controller (1) according to this first embodiment has a cold/hot water circuit (10) through which cold/hot water circulates, an adsorption heat exchanger (20) provided in the cold/hot water circuit (10), and an air passage (30) for supplying air that has passed through this adsorption heat exchanger (20) to the inside of the room or the outdoors selectively. The adsorption heat exchanger (20) is composed of a first adsorption heat exchanger (21) and a second adsorption heat exchanger (22). Each adsorption heat exchanger (20) is a heat exchanger that supports an adsorbent on its surface, and can adjust moisture of air by adsorbing or desorbing moisture with the adsorbent.

The cold/hot water circuit (10) is constructed by pipe-connecting the first adsorption heat exchanger (21), the second adsorption heat exchanger (22), a first four-way selector valve (11), and a second four-way selector valve (12). The first four-way selector valve (11) and the second four-way selector valve (12) can switch between a first state in which a first port (P1) and a second port (P2) communicate with each other and a third port (P3) and a fourth port (P4) communicate with each other (see solid lines in FIG. 1A and FIG. 2A) and a second state in which the first port (P1) and the third port (P3) communicate with each other and the second port (P2) and the fourth port (P4) communicate with each other (see solid lines in FIG. 1B and FIG. 2B).

A hot water inflow pipe (13) is connected to the first port (P1) of the first four-way selector valve (11). A first circulating pipe (14) that communicates with a heat exchange pipe of the first adsorption heat exchanger (21) is connected to the second port (P2) of the first four-way selector valve (11) and the third port (P3) of the second four-way selector valve (12). A hot water outflow pipe (15) is connected to the fourth port (P4) of the second four-way selector valve (12). Moreover, a cold water inflow pipe (16) is connected to the first port (P1) of the second four-way selector valve (12). A second circulating pipe (17) that communicates with a heat exchange pipe of the second adsorption heat exchanger (22) is connected to the second port (P2) of the second four-way selector valve (12) and the third port (P3) of the first four-way selector valve (11). A cold water outflow pipe (18) is connected to the fourth port (P4) of the first four-way selector valve (11).

The cold/hot water circuit (10) is configured to be switchable between a first cold/hot water circulation state (a state of FIG. 1A and FIG. 2A) in which hot water passes through the first adsorption heat exchanger (21) and cold water passes through the second adsorption heat exchanger (22) and a second cold/hot water circulation state (a state of FIG. 1B and FIG. 2B) in which hot water passes through the second adsorption heat exchanger (22) and cold water passes through the first adsorption heat exchanger (21).

Although not shown, the adsorption heat exchanger (20) is constructed with a fin and tube heat exchanger of the cross fin type that has multiple fins each being shaped in a rectangular plate and a heat exchange pipe that penetrates these fins. Moreover, the adsorption heat exchanger (20) supports an adsorbent on the outer surfaces of the fins and the heat exchange pipe, the adsorbent being made by dip formation (immersion formation). Adsorbents that can be used include zeolite, silica gel, activated carbon, organic polymer systems that have a hydrophilic property or water permeability, ion exchange resin systems that have a carboxylic acid group or a sulfonic group, highly functional polymeric materials such as thermosensitive polymers, etc.

It is noted that the adsorption heat exchanger (20) is not limited to fin and tube heat exchangers of the cross fin type, and heat exchangers of other forms, for example, heat exchangers of the corrugated fin type, etc. may be used. Moreover, regarding a method for making the fins and the heat exchange pipe support an adsorbent on their outer surfaces, any method may be used, not being limited to the dip formation, as long as the pertinent method does not impair performance as the adsorbent.

The air passage (30) is composed of two air passages (31, 32), and is configured to be switchable between a first air circulation state (a state of FIG. 1A and FIG. 2A) in which the air passage (30) supplies air that has passed through the first adsorption heat exchanger (21) to the inside of a room and also discharges air that has passed through the second adsorption heat exchanger (22) to the outdoors and a second air circulation state (a state of FIG. 1B and FIG. 2A) in which the air passage (30) supplies air that has passed through the second adsorption heat exchanger (22) to the inside of the room and also discharges air that has passed through the first adsorption heat exchanger (21) to the outdoors.

The humidity controller (1) is constructed as a circulation-fan type humidity controller (1) that processes and supplies room air (RA) to the inside of the room, and on the other hand processes and discharges outdoor air (OA) to the outdoors again. Accordingly, the air passage (30) is configured to supply the room air (RA) to the adsorption heat exchanger (21, 22) as air to be supplied to the inside of the room after passing through one of the first adsorption heat exchanger (21) and the second adsorption heat exchanger (22), and supply the outdoor air (OA) to the adsorption heat exchanger (22, 21) as air to be discharged to the outdoors after passing through the other one of the first adsorption heat exchanger (21) and the second adsorption heat exchanger (22).

Moreover, the humidity controller (1) is equipped with control means of setting a time interval at which a cold/hot water circulation state of the cold/hot water circuit (10) and an air circulation state of the air passage (30) according to a latent heat load of the inside of the room. This control means is configured such that the setting value of the time interval is made smaller with increasing latent heat load of the inside of the room.

—Driving Operation—

(Humidifying Operation)

At the time of humidifying operation, a first operation of FIG. 1A and a second operation of FIG. 1B are conducted alternately. At the time of the first operation, the first four-way selector valve (11) and the second four-way selector valve (12) are switched to the first state, and at the time of the second operation, the first four-way selector valve (11) and the second four-way selector valve (12) are switched to the second state.

At the time of the first operation, the cold/hot water circuit (10) is in the first cold/hot water circulation state, and the air passage (30) is in the first air circulation state. In this state, hot water supplied to the cold/hot water circuit (10) from the hot water inflow pipe (13) passes through the first adsorption heat exchanger (21), heats the adsorbent of the first adsorption heat exchanger (21), and subsequently is discharged from the hot water outflow pipe (15). Moreover, cold water supplied to the cold/hot water circuit (10) from a cold water inflow pipe (16) passes through the second adsorption heat exchanger (22), cools the adsorbent of the second adsorption heat exchanger (22), and subsequently is discharged from the cold water outflow pipe (18).

In this occasion, at the first adsorption heat exchanger (21), room air (RA) is humidified (latent heat processing) by recycling the adsorbent and is gradually heated (sensible heat processing) when the room air (RA) passes through the first adsorption heat exchanger (21). The room air (RA) is returned to the inside of the room as supply air (SA). Moreover, at the second adsorption heat exchanger (22), the adsorbent is given moisture by outdoor air (OA) passing through the second adsorption heat exchanger (22), and the outdoor air (OA) is discharged to the outdoors as exhaust air (EA).

At the time of the second operation, the cold/hot water circuit (10) is in the second cold/hot water circulation state and the air passage (30) is in the second air circulation state. In this state, hot water supplied to the cold/hot water circuit (10) from the hot water inflow pipe (13) passes through the second adsorption heat exchanger (22), heats the adsorbent of the second adsorption heat exchanger (22), and subsequently is discharged from the hot water outflow pipe (15). Moreover, cold water supplied to the cold/hot water circuit (10) from the cold water inflow pipe (16) passes through the first adsorption heat exchanger (21), cools the adsorbent of the first adsorption heat exchanger (21), and subsequently is discharged from the cold water outflow pipe (18).

In this occasion, at the second adsorption heat exchanger (22), room air (RA) is humidified (subjected to latent heat processing) by recycling the adsorbent and is gradually heated (subjected to sensible heat processing) when the room air (RA) passes through the second adsorption heat exchanger (22). The room air (RA) is returned to the inside of the room as supply air (SA). Moreover, at the first adsorption heat exchanger (21), outdoor air (OA) gives moisture to the adsorbent by passing through the first adsorption heat exchanger (21), and the outdoor air (OA) is discharged to the outdoors.

By repeating the first operation and the second operation alternately in the manner described above, a humidifying operation can be performed continuously. At this time, by adjusting the time interval at which the first operation and the second operation are switched, the amount of humidification (the amount of latent heat processing) can be adjusted. Specifically, by shortening the above-mentioned time interval (increasing switching frequency), the amount of humidification can be increased. Thus, when the latent heat load of the inside of the room is large, the amount of humidification is increased by increasing switching frequency, whereby indoor amenity can be enhanced. Moreover, when, conversely, the latent heat load of the inside of the room is small, the amount of humidification is lessened by decreasing the switching frequency, whereby energy efficiency can be increased.

Furthermore, at the time of this operation, the first operation and the second operation may not be switched but only one operation may be conducted, so that circulation of cold water in the cold/hot water circuit (10) is halted and only hot water is flowed. This leads the adsorbent to saturation, which starts sensible heat exchange between air and the hot water, and therefore it becomes possible to perform a heating operation.

(Dehumidifying Operation)

At the time of dehumidifying operation, the first operation of FIG. 2B and the second operation of FIG. 2A are conducted alternately. At the time of the first operation, the first four-way selector valve (11) and the second four-way selector valve (12) are switched to the second state; at the time of the second operation, the first four-way selector valve (11) and the second four-way selector valve (12) are switched to the first state.

At the time of the first operation, the cold/hot water circuit (10) is in the second cold/hot water circulation state and the air passage (30) is in the first air circulation state. In this state, hot water supplied to the cold/hot water circuit (10) from the hot water inflow pipe (13) passes through the second adsorption heat exchanger (22), heats the adsorbent of the second adsorption heat exchanger (22), and subsequently is discharged from the hot water outflow pipe (15). Moreover, cold water supplied to the cold/hot water circuit (10) from the cold water inflow pipe (16) passes through the first adsorption heat exchanger (21), cools the adsorbent of the first adsorption heat exchanger (21), and subsequently is discharged from the cold water outflow pipe (18).

In this occasion, at the first adsorption heat exchanger (21), room air (RA) is deprived of moisture (subjected to latent heat processing) by the adsorbent adsorbing moisture, and is gradually cooled (subjected to sensible heat processing) when the room air (RA) passes through the first adsorption heat exchanger (21). The room air (RA) is returned to the inside of the room as supply air (SA). Moreover, at the second adsorption heat exchanger (22), outdoor air (OA) recycles the adsorbent when passing through the second adsorption heat exchanger (22) and subsequently is discharged to the outdoors as exhaust air (EA).

At the time of the second operation, the cold/hot water circuit (10) is in the first cold/hot water circulation state and the air passage (30) is in the second air circulation state. In this state, hot water supplied to the cold/hot water circuit (10) from the hot water inflow pipe (13) passes through the first adsorption heat exchanger (21), heats the adsorbent of the first adsorption heat exchanger (21), and subsequently is discharged from the hot water outflow pipe (15). Moreover, cold water supplied to the cold/hot water circuit (10) from the cold water inflow pipe (16) passes through the second adsorption heat exchanger (22), cools the adsorbent of the second adsorption heat exchanger (22), and subsequently is discharged from the cold water outflow pipe (18).

In this occasion, at the second adsorption heat exchanger (22), room air (RA) is deprived of moisture (subjected to latent heat processing) by the adsorbent adsorbing moisture and is gradually cooled (subjected to sensible heat processing) when passing through the second adsorption heat exchanger (22). The room air (RA) is returned to the inside of the room as supply air (SA). Moreover, at the first adsorption heat exchanger (21), outdoor air (OA) recycles the adsorbent when passing through the first adsorption heat exchanger (21) and subsequently is discharged to the outdoors as exhaust air (EA).

By repeating the first operation and the second operation alternately in the manner described above, the dehumidifying operation can be continuously performed. At this time, the amount of dehumidification (the amount of latent heat processing) can be adjusted by adjusting the time interval at which the first operation and the second operation are switched. Specifically, by shortening the above-mentioned time interval, the amount of dehumidification can be increased. Thus, when the latent heat load of the inside of the room is large, the amount of dehumidification is increased by increasing the switching frequency, whereby indoor amenity can be enhanced. Moreover, when, conversely, the latent heat load of the inside of the room is small, the amount of dehumidification is lessened by decreasing the switching frequency, whereby energy efficiency can be increased.

At the time of this operation, the first operation and the second operation may not be switched but only one operation may be conducted, so that circulation of hot water in the cold/hot water circuit (10) is halted and only cold water is flowed. This operation leads the adsorbent to saturation, which starts sensible heat exchange between air and the hot water, and therefore it becomes possible to perform a cooling operation.

Effects of First Embodiment

According to the first embodiment, since it is configured that humidification and dehumidification inside the room are performed by the use of the adsorption heat exchangers (20) each supporting the adsorbent on its surface, the configuration can be simplified and the controller can be miniaturized compared with the conventional humidity controller (1) using an adsorption element and a heat pump apparatus.

In the first embodiment, when the latent heat load of the inside of the room is large, switching frequency between the first operation and the second operation is increased, while when, conversely, the latent heat load is small, the switching frequency between the first operation and the second operation is decreased. This makes it possible to perform an operation that excels in the balance between indoor amenity and energy efficiency.

Figure 17:
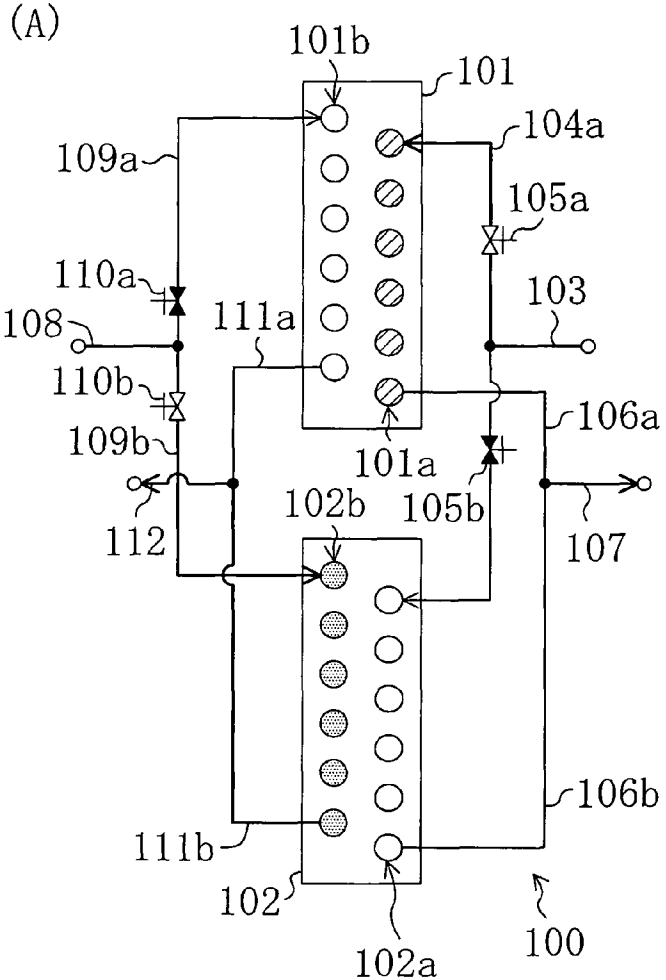
FIG. 17 is a diagram showing a configuration of a cold/hot water circuit using four solenoid valves.
Figure 17:
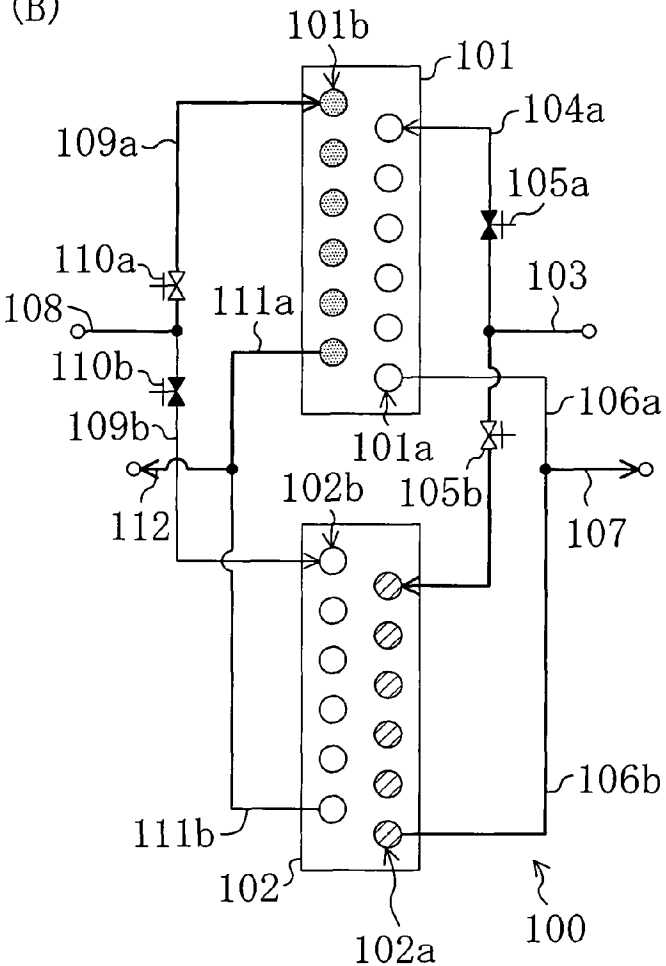

In the first embodiment, since the two four-way selector valves (11, 12) are used to construct the cold/hot water circuit (10), as already described using FIG. 17, the configuration can be simplified compared with the case of using a shut-off valve, such as a solenoid valve, and performance degradation is not caused because no water is left in the cold/hot water circuit (10).

Second Embodiment

Figure 3:
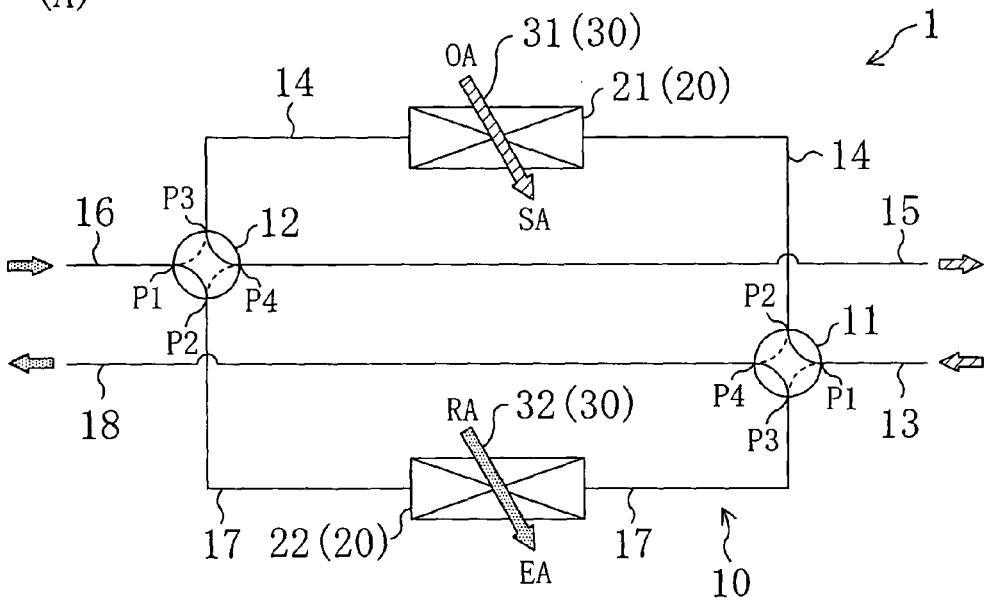
FIG. 3 is a circuit diagram showing a humidifying operating state of a humidity controller according to a second embodiment.
Figure 3:
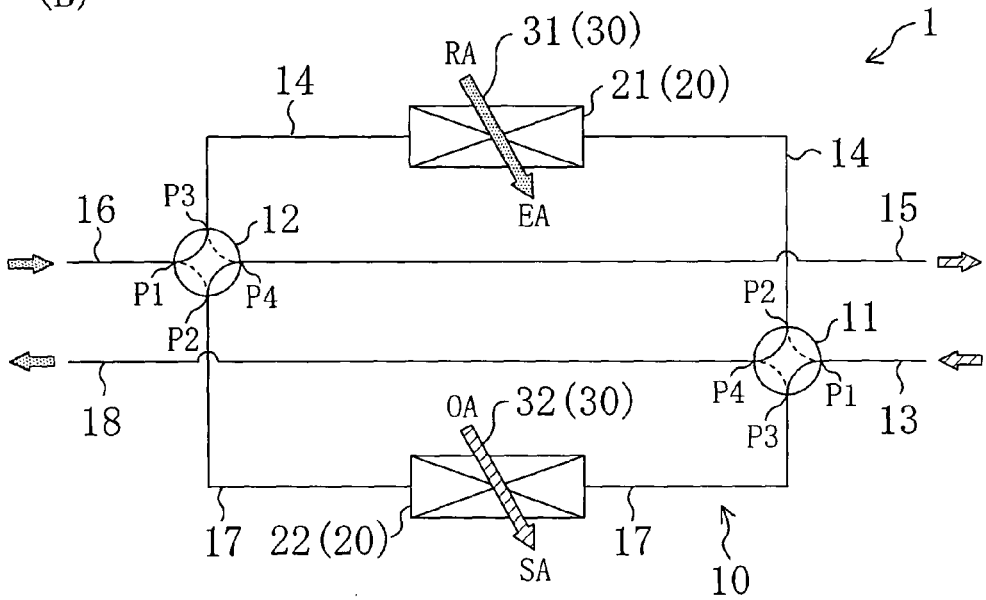
Figure 4:
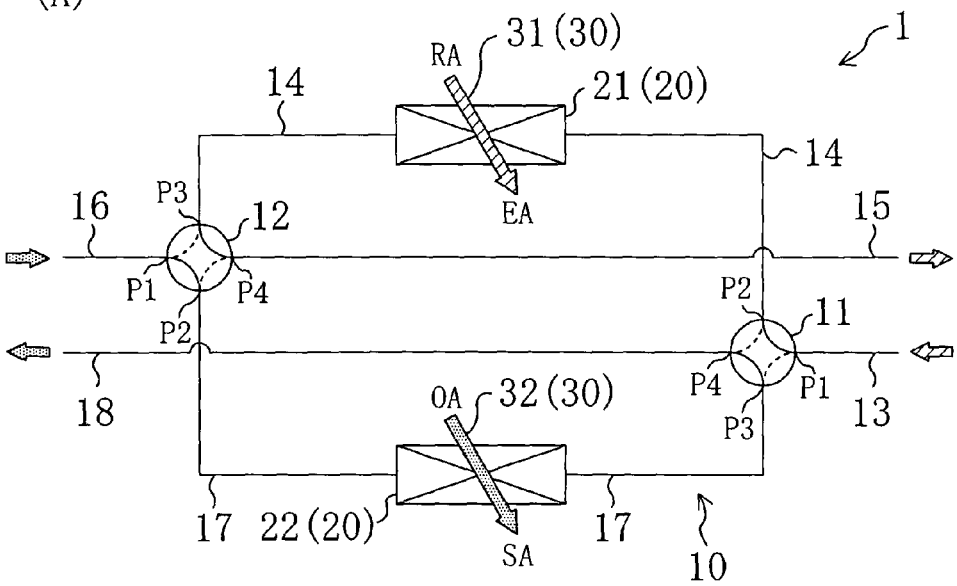
FIG. 4 is a circuit diagram showing a dehumidifying operating state of the humidity controller according to the second embodiment.
Figure 4:
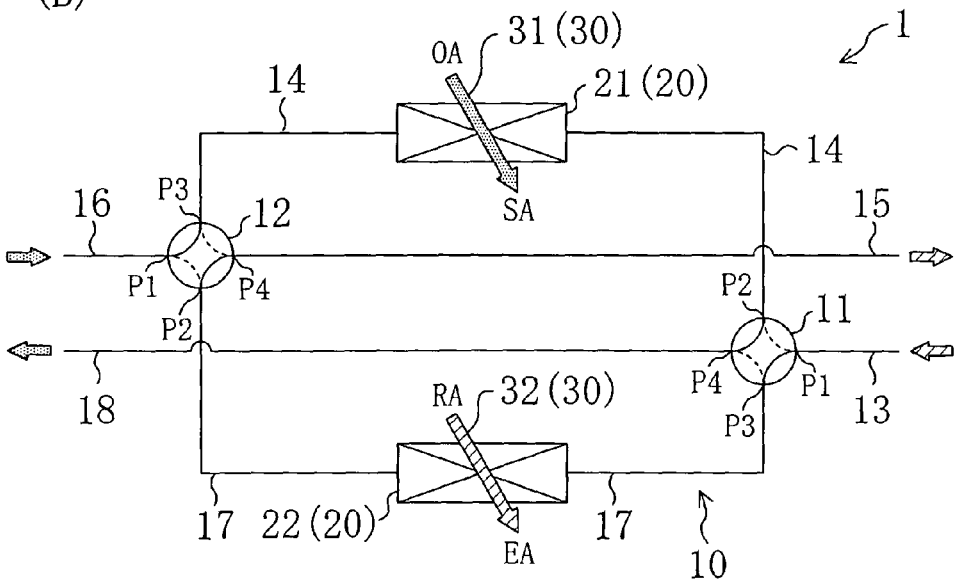

The humidity controller (1) of a second embodiment shown in FIG. 3 and FIG. 4 is an example wherein a configuration of the air passage (30) is made different from that of the first embodiment.

Also in this second embodiment, the cold/hot water circuit (10) is configured to be switchable between the first cold/hot water circulation state (a state of FIG. 3A and FIG. 4A) in which hot water passes through the first adsorption heat exchanger (21) and cold water passes through the second adsorption heat exchanger (22) and the second cold/hot water circulation state (a state of FIG. 3B and FIG. 4B) in which hot water passes through the second adsorption heat exchanger (22) and cold water passes through the first adsorption heat exchanger (21).

The air passage (30) is configured to be switchable between the first air circulation state (a state of FIG. 3A and FIG. 4B) in which the air passage (30) supplies air that has passed through the first adsorption heat exchanger (21) to the inside of the room and also discharges air that has passed through the second adsorption heat exchanger (22) to the outdoors and the second air circulation state (a state of FIG. 3B and FIG. 4A) in which the air passage (30) supplies air that passes through the second adsorption heat exchanger (22) to the inside of the room and also discharges air that has passed through the first adsorption heat exchanger (21) to the outdoors.

This humidity controller (1) is constructed as a ventilation-fan type humidity controller (1) that processes and supplies outdoor air (OA) to the inside of the room, and on the other hand processes and discharges room air (RA) to the outdoors. Accordingly, the air passage (30) is configured to supply the outdoor air (OA) to the adsorption heat exchanger (21, 22) as air to be supplied to the inside of the room after passing through one of the first adsorption heat exchanger (21) and the second adsorption heat exchanger (22), and to supply the room air (RA) to the adsorption heat exchanger (22, 21) as air to be discharged to the outdoors after passing through the other one of the first adsorption heat exchanger (21) and the second adsorption heat exchanger (22).

The humidity controller (1) of the second embodiment is constructed in the same manner as in the first embodiment in other respects.

In the second embodiment, at the time of humidifying operation of FIG. 3, the outdoor air (OA) is humidified by the first adsorption heat exchanger (21) (FIG. 3A) or the second adsorption heat exchanger (22) (FIG. 3B) and is supplied to the inside of the room. The room air (RA) gives moisture to the second adsorption heat exchanger (22) (FIG. 3A) or the first adsorption heat exchanger (21) (FIG. 3B) and is discharged to the outdoors. Moreover, at the time of dehumidifying operation, the outdoor air (OA) is dehumidified by the first adsorption heat exchanger (21) (FIG. 4B) or the second adsorption heat exchanger (22) (FIG. 4A) and is supplied to the inside of the room. The room air (RA) recycles the second adsorption heat exchanger (22) (FIG. 4B) or the first adsorption heat exchanger (21) (FIG. 4A) and is discharged to the outdoors.

Also in the second embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, by increasing the switching frequency between the first operation and the second operation when the latent heat load of the inside of the room is large, and by decreasing the switching frequency between the first operation and the second operation when, conversely, the latent heat load is small, it becomes possible to perform an operation that excels in the balance between indoor amenity and energy efficiency

Third Embodiment

Figure 5:
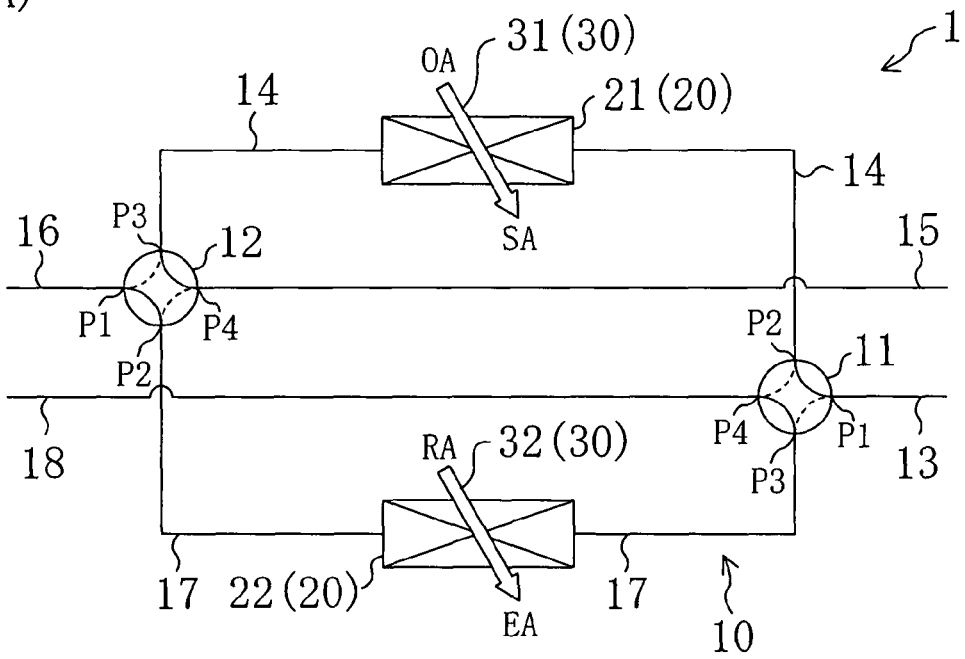
FIG. 5 is a circuit diagram showing an outside air cooling state of a humidity controller according to a third embodiment.
Figure 5:
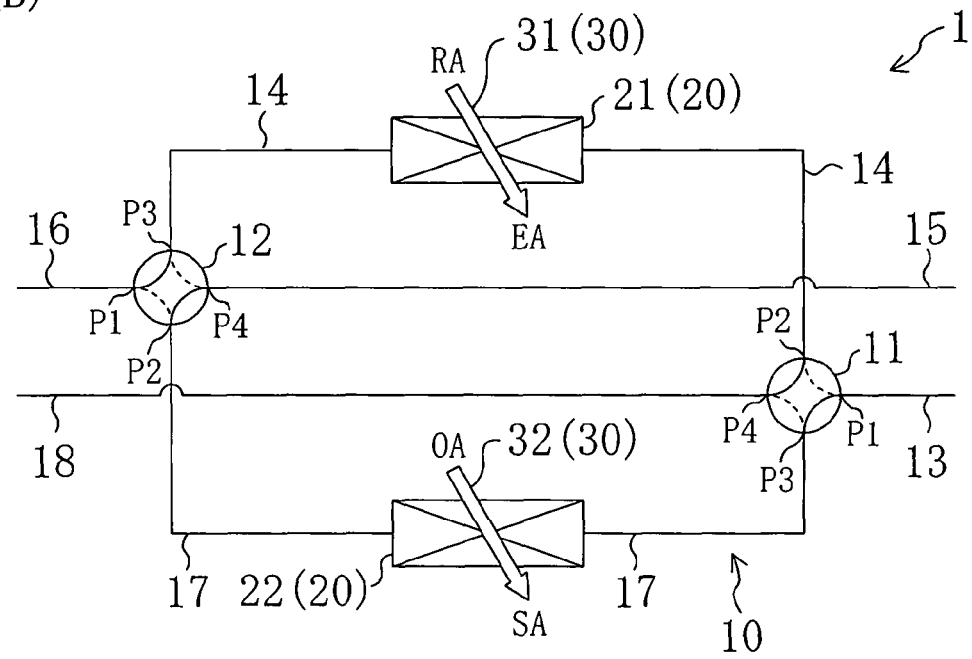

The humidity controller (1) of a third embodiment shown in FIG. 5 is an example that is a modification of the second embodiment such that the circulation of cold/hot water in the cold/hot water circuit (10) can be halted.

In the third embodiment, the air passage (30) is configured to supply outdoor air (OA) that has passed through one of the first adsorption heat exchanger (21) or the second adsorption heat exchanger (22) to the inside of the room in a state in which the cold/hot water circuit (10) is halted, and discharge room air (RA) that has passed through the other one of the first adsorption heat exchanger (21) and the second adsorption heat exchanger (22) to the outdoors.

Since the air passage (30) is configured in the manner described above, the humidity controller (1) of the third embodiment can perform an outside air cooling operation in addition to a humidifying operation and a dehumidifying operation. This outside air cooling operation is performed to cool the inside of the room by supplying the outdoor air (OA) as it is to the inside of the room when the outdoor air (OA) is lower in temperature than the room air (RA). In this case, the outdoor air (OA) is supplied to the inside of the room as supply air (SA) after passing through one of the first adsorption heat exchanger (21) and the second adsorption heat exchanger (22). The room air (RA) is discharged to the outdoors as exhaust air (EA) after passing through the other one of the first adsorption heat exchanger (21) and the second adsorption heat exchanger (22).

Also in the third embodiment, the configuration can be simplified and the controller can be miniaturized compared with the conventional humidity controller (1) using an adsorption element and a heat pump apparatus. In this case, either the operation of FIG. 5A or the operation of FIG. 5B may be selected and there is no need for switching therebetween.

Fourth Embodiment

Figure 6:
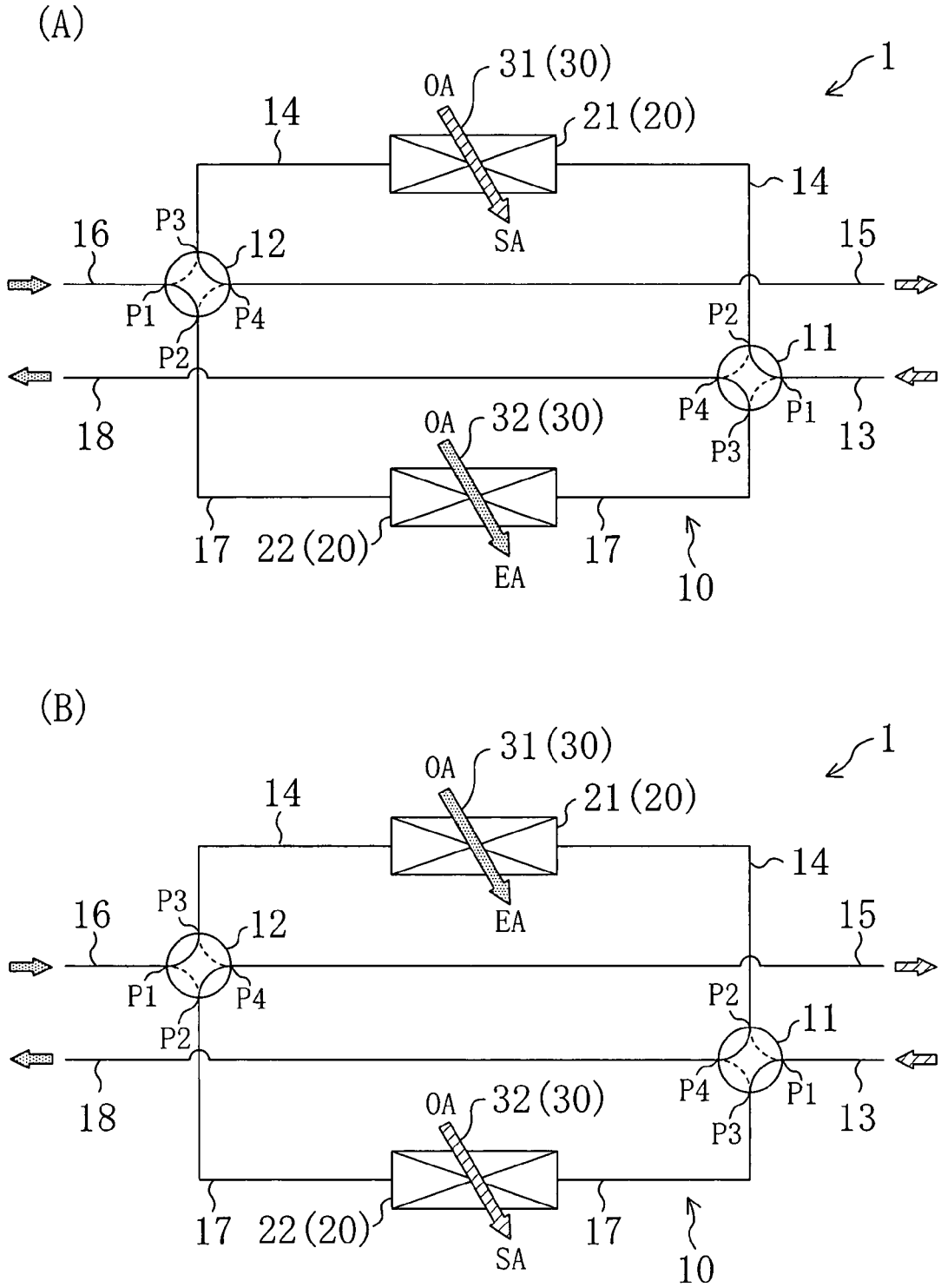
FIG. 6 is a circuit diagram showing a humidifying operating state of a humidity controller according to a fourth embodiment.
Figure 7:
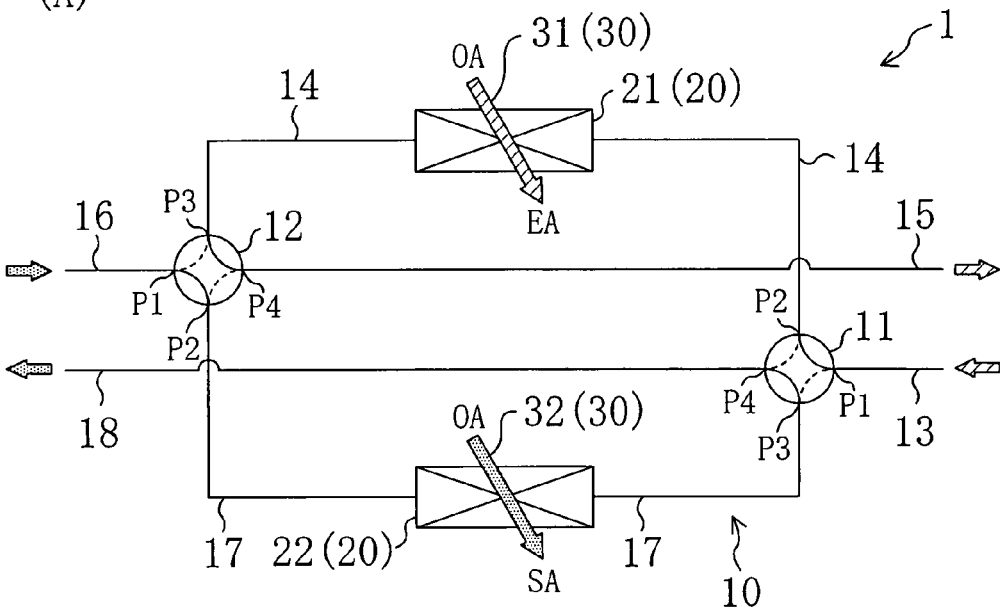
FIG. 7 is a circuit diagram showing a dehumidifying operating state of the humidity controller according to the fourth embodiment.
Figure 7:
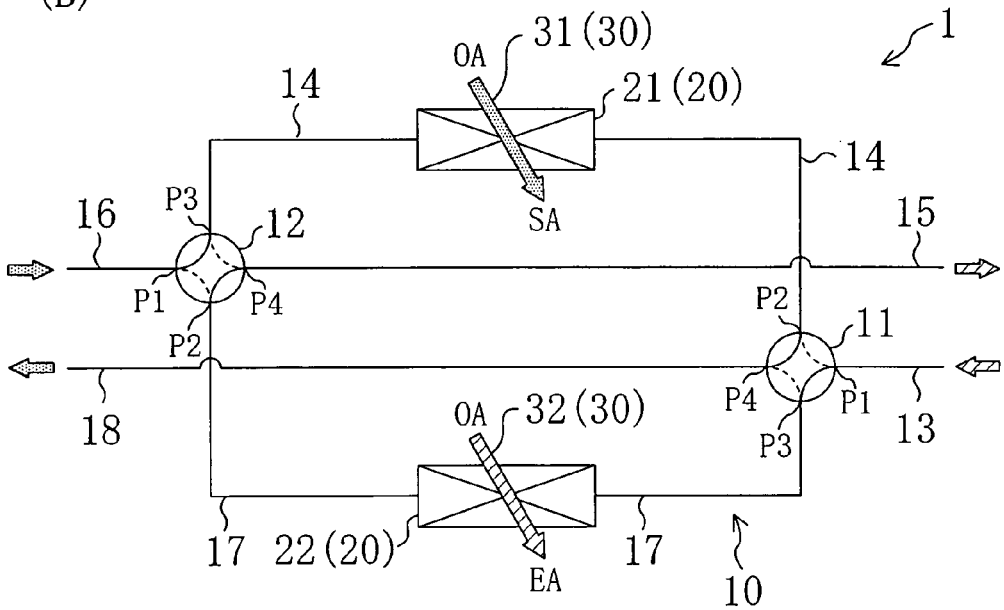

The humidity controller (1) of a fourth embodiment shown in FIG. 6 and FIG. 7 is an example in which the configuration of the air passage (30) is made different from those of the above-mentioned embodiments.

Also in the fourth embodiment, the cold/hot water circuit (10) is configured to be switchable between the first cold/hot water circulation state (a state of FIG. 6A and FIG. 7A) in which hot water passes through the first adsorption heat exchanger (21) and cold water passes through the second adsorption heat exchanger (22) and the second cold/hot water circulation state (a state of FIG. 6B and FIG. 7B) in which hot water passes through the second adsorption heat exchanger (22) and cold water passes through the first adsorption heat exchanger (21).

The air passage (30) is configured to be switchable between the first air circulation state (a state of FIG. 6A and FIG. 7B) in which the air passage (30) supplies air that has passed through the first adsorption heat exchanger (21) to the inside of the room and also discharges air that has passed through the second adsorption heat exchanger (22) to the outdoors and the second air circulation state (a state of FIG. 6B and FIG. 7A) in which the air passage (30) supplies air that has passed through the second adsorption heat exchanger (22) to the inside of the room and also discharges air that has passed through the first adsorption heat exchanger (21) to the outdoors.

Moreover, this humidity controller (1) conducts the second kind of ventilation, being constructed as a supply air fan type humidity controller (1) that processes and supplies outdoor air (OA) to the inside of the room, and on the other hand processes and discharges the outdoor air (OA) to the outdoors again. Accordingly, the air passage (30) is configured to supply the outdoor air (OA) to the adsorption heat exchangers (21, 22) as air to be supplied to the inside of the room after passing through one of the first adsorption heat exchanger (21) and the second adsorption heat exchanger (22), and supply the outdoor air (OA) to the adsorption heat exchangers (21, 22) as air to be discharged to the outdoors after passing through the other one of the first adsorption heat exchanger (21) and the second adsorption heat exchanger (22).

The humidity controller (1) of this fourth embodiment is constructed in the same manner as in the first embodiment in other respects.

In the fourth embodiment, at the time of humidifying operation of FIG. 6, outdoor air (OA) is humidified by the first adsorption heat exchanger (21) (FIG. 6A) or the second adsorption heat exchanger (22) (FIG. 6B) and is supplied to the inside of the room. Room air (RA) gives moisture to the second adsorption heat exchanger (22) (FIG. 6A) or the first adsorption heat exchanger (21) (FIG. 6B) and is discharged to the outdoors. Moreover, at the time of dehumidifying operation, the room air (RA) is dehumidified by the first adsorption heat exchanger (21) (FIG. 7B) or the second adsorption heat exchanger (22) (FIG. 7A) and is supplied to the inside of the room. The room air (RA) recycles the second adsorption heat exchanger (22) (FIG. 7B) or the first adsorption heat exchanger (21) (FIG. 7B) and is discharged to the outdoors.

Also in the fourth embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, by increasing the switching frequency between the first operation and the second operation when the latent heat load of the inside of the room is large, and by decreasing the switching frequency between the first operation and the second operation when, conversely, the latent heat load is small, it becomes possible to perform an operation that excels in the balance between indoor amenity and energy efficiency.

Furthermore, since when the dehumidifying operation is performed in the fourth embodiment, recycling of the adsorbent is conducted using outside air, which has high temperature in summer and thus imparts the recycling temperature, and therefore energy saving can be attained.

Fifth Embodiment

Figure 8:
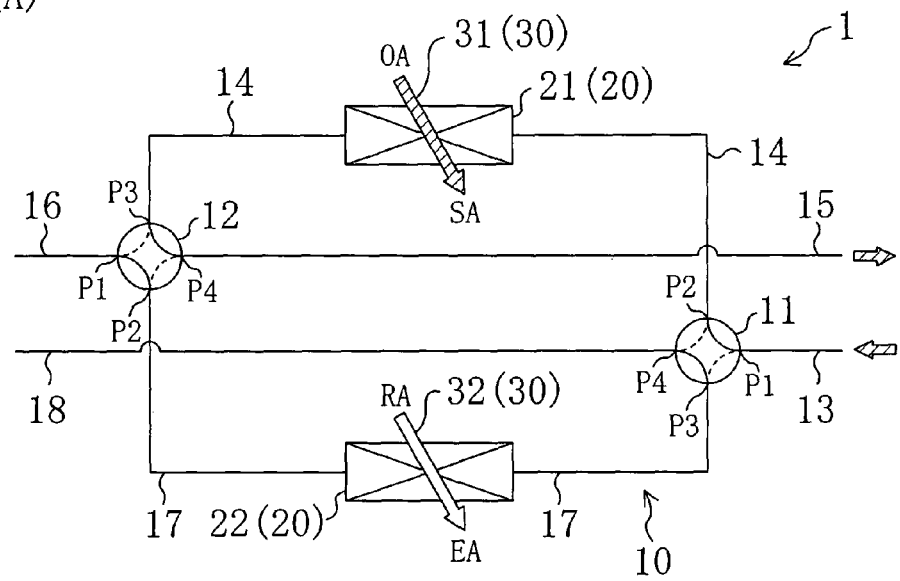
FIG. 8 is a circuit diagram showing a humidifying operating state of a humidity controller according to a fifth embodiment.
Figure 8:
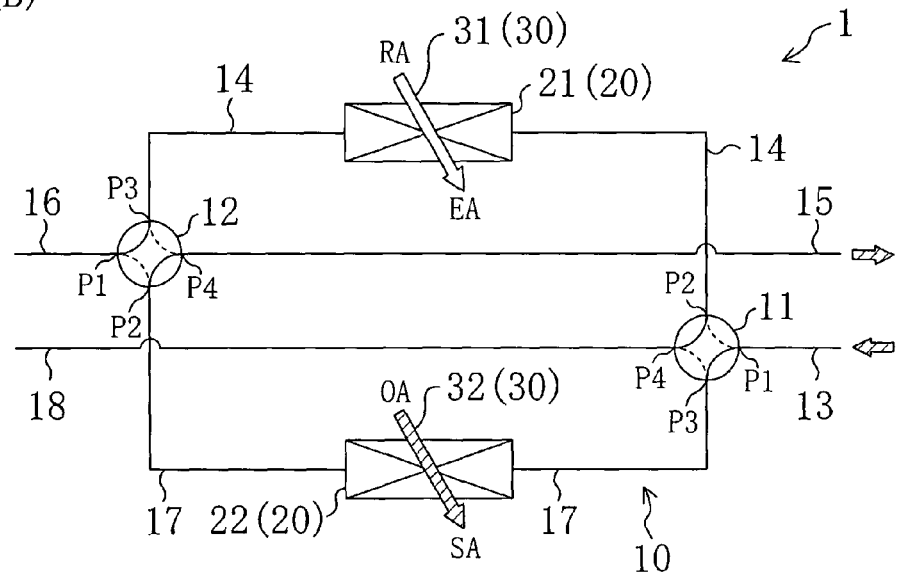

The humidity controller (1) of a fifth embodiment shown in FIG. 8 is an example that is the humidity controller of the second embodiment modified so as not to conduct circulation of cold water.

In this case, all that is needed is to connect neither the cold water inflow pipe (16) nor the cold water outflow pipe (18) to a cold water system, but to seal their ends.

In the fifth embodiment, the air passage (30) is configured to supply outdoor air (OA) that has passed through one of the first adsorption heat exchanger (21) and the second adsorption heat exchanger (22) to the inside of the room and discharge room air (RA) that has passed through the other one of the first adsorption heat exchanger (21) and the second adsorption heat exchanger (22) to the outdoors.

In the humidity controller (1) of the fifth embodiment, since the adsorption-side adsorbent is not cooled, the amount of adsorption becomes slightly small compared with the second embodiment, and accordingly humidification capacity is slightly decreased. However, since it is not necessary to install a cooling water system, the configuration of the controller can be simplified.

Also in the fifth embodiment, the configuration can be simplified and the controller can be miniaturized compared with the conventional humidity controller (1) using an adsorption element and a heat pump apparatus. Moreover, by increasing the switching frequency between the first operation and the second operation when the latent heat load of the inside of the room is large, and by decreasing the switching frequency between the first operation and the second operation when, conversely, the latent heat load is small, it becomes possible to perform an operation that excels in the balance between indoor amenity and energy efficiency.

Although in the example of FIG. 8, the second embodiment is modified such that the cold/hot water circuit (10) is configured not to allow cold water to circulate therethrough but to allow only hot water to circulate, conversely the cold/hot water circuit (10) may be configured to allow only cold water to circulate therethrough but not to allow hot water to circulate. Moreover, in the controllers of the first embodiment and the fourth embodiment, the cold/hot water circuit (10) may be configured to allow only one of cold water and hot water to circulate therethrough, halting the circulation of the other.

Sixth Embodiment

Figure 9:
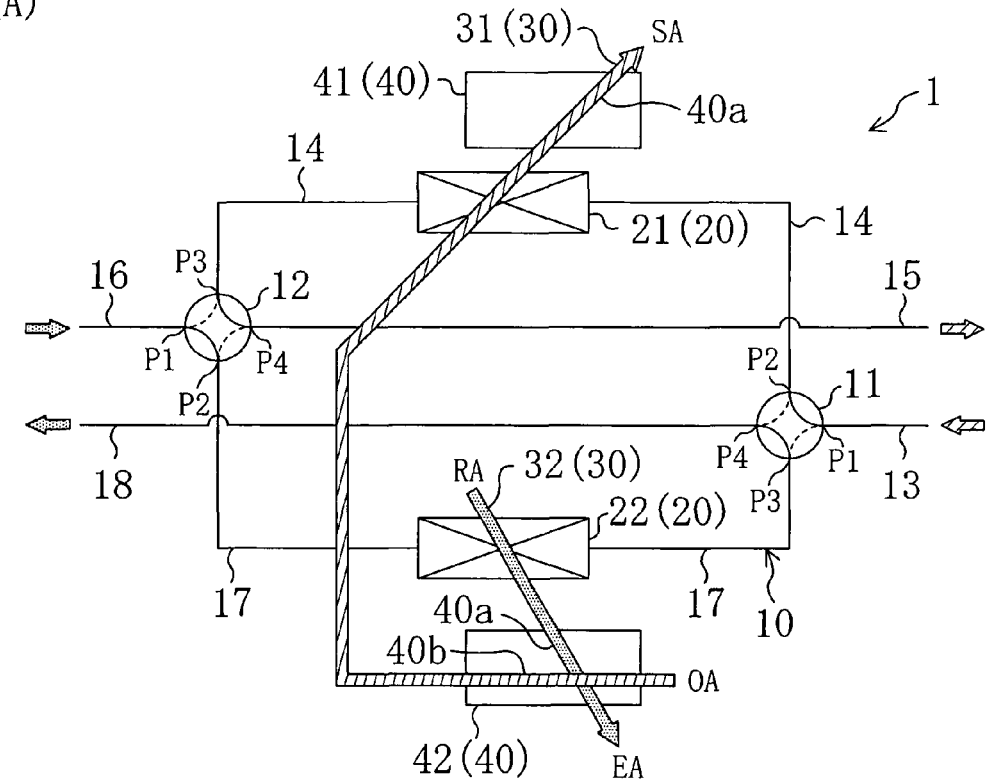
FIG. 9 is a circuit diagram showing a humidifying operating state of a humidity controller according to a sixth embodiment.
Figure 9:
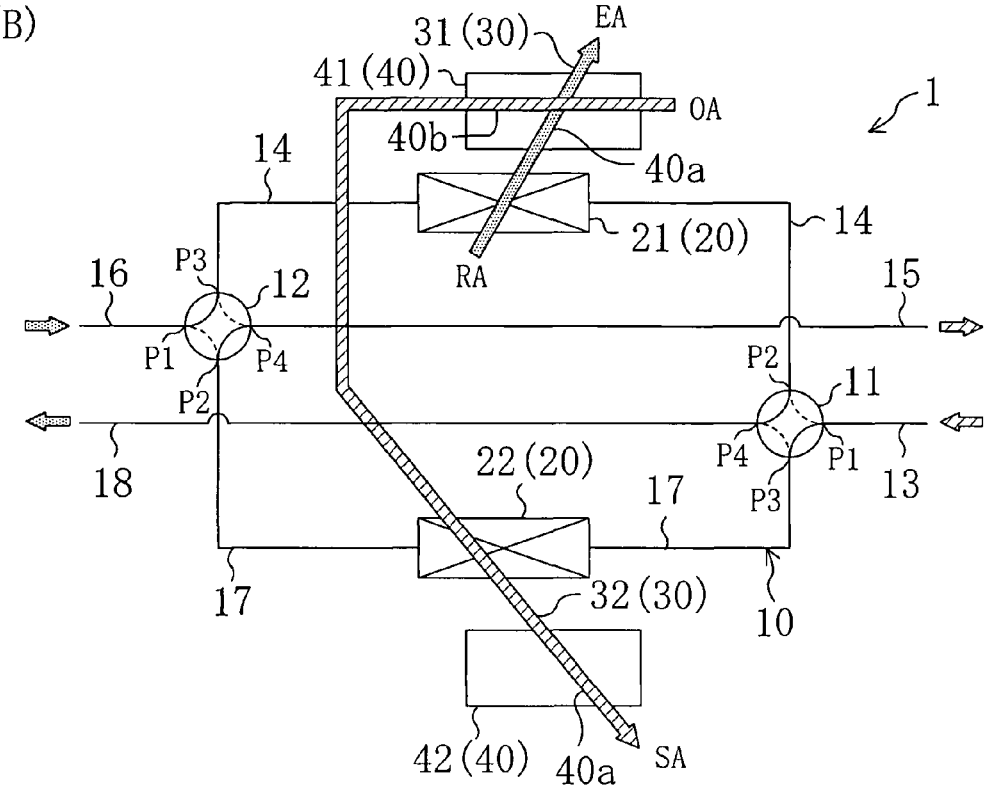
Figure 10:
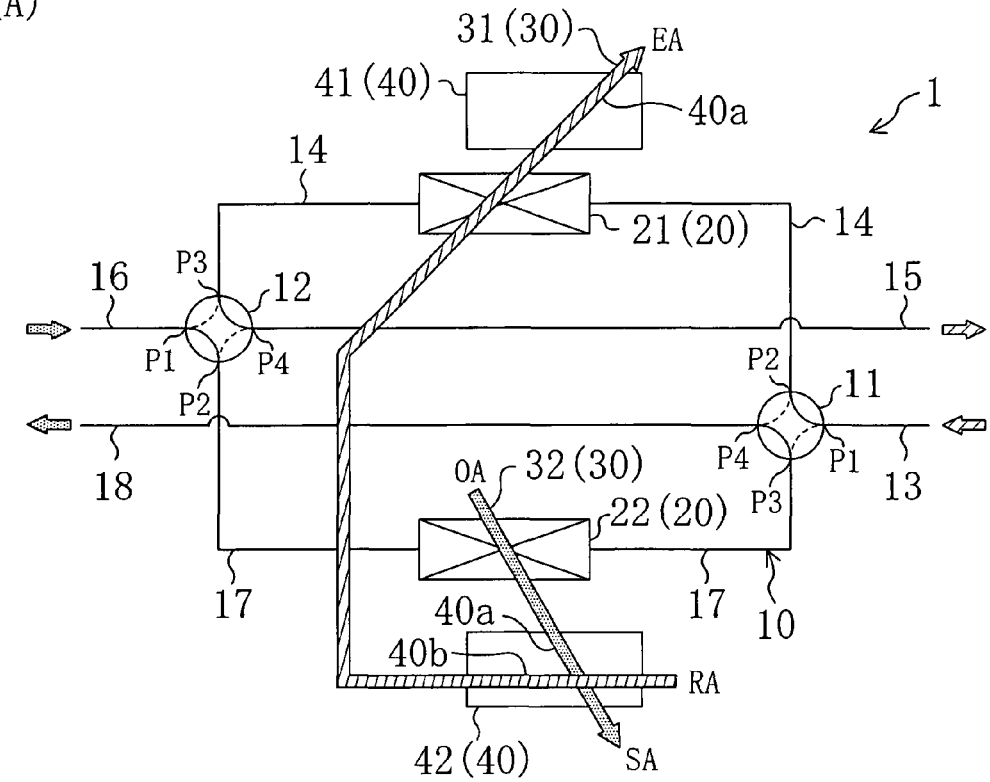
FIG. 10 is a circuit diagram showing a dehumidifying operating state of the humidity controller according to the sixth embodiment.
Figure 10:
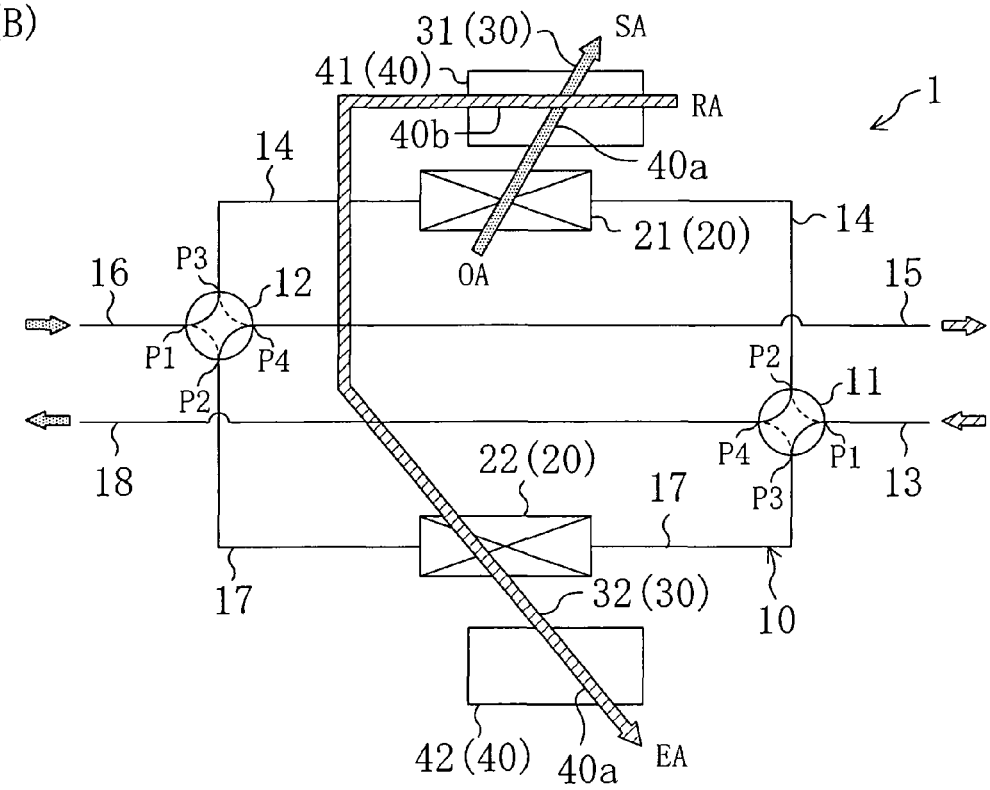

The humidity controller (1) of a sixth embodiment shown in FIG. 9 and FIG. 10 is an example such that an adsorption cooling element (40) is further installed in the humidity controller of the second embodiment.

The adsorption cooling element (40) is composed of a first adsorption cooling element (41) and a second adsorption cooling element (42). Each adsorption cooling element (40) has a humidity control passage (40*a*) capable of adsorbing and desorbing moisture in/to air, and a cooling passage (4.0*b*) for absorbing adsorption heat produced when moisture is adsorbed in the humidity control passage (40*a*) with cooling air.

The air passage (30) is configured to be able to set an air passage for humidifying operation shown in FIG. 9 and an air passage for dehumidifying operation shown in FIG. 10.

The air passage for humidifying operation is configured to be switchable between the first air circulation state (a state of FIG. 9A) in which the air passage supplies air that has passed through the cooling passage (40*b*) of the second adsorption cooling element (42), the first adsorption heat exchanger (21), and the humidity control passage (40*a*) of the first adsorption cooling element (41) to the inside of the room and also discharges air that has passed through the second adsorption heat exchanger (22) and the humidity control passage (40*a*) of the second adsorption cooling element (42) and the second air circulation state (a state of FIG. 9B) in which the air passage supplies air that has passed through the cooling passage (40*b*) of the first adsorption cooling element (41), the second adsorption heat exchanger (22), and the humidity control passage (40*a*) of the second adsorption cooling element (42) to the inside of the room and also discharges air that has passed through the first adsorption heat exchanger (21) and the humidity control passage (40*a*) of the first adsorption cooling element (41) to the outdoors.

The air passage (30) for dehumidifying operation is configured to be switchable between the first air circulation state (a state of FIG. 10B) in which the air passage (30) supplies air that has passed through the first adsorption heat exchanger (21) and the humidity control passage (40*a*) of the first adsorption cooling element (41) to the inside of the room, and also discharges air that has passed through the cooling passage (40*b*) of the first adsorption cooling element (41), the second adsorption heat exchanger (22), and the humidity control passage (40*a*) of the second adsorption cooling element (42) to the outdoors and the second air circulation state (a state of FIG. 10A) in which the air passage (30) supplies air that has passed through the second adsorption heat exchanger (22) and the humidity control passage (40*a*) of the second adsorption cooling element (42) and also discharges air that has passed through the cooling passage (40*b*) of the second adsorption cooling element (42), the first adsorption heat exchanger (21), and the humidity control passage (40*a*) of the first adsorption cooling element (41) to the outdoors.

At the time of the first operation of the humidifying operation shown in FIG. 9A, the cold/hot water circuit (10) is in the first cold/hot water circulation state and the air passage (30) is in the first air circulation state. In this state, outdoor air (OA) is heated by absorbing the adsorption heat produced by passing of room air (RA) through the humidity control passage (40*a*) when the outdoor air (OA) passes through the cooling passage (40*b*) of the second adsorption cooling element (42), subsequently is humidified by passing through the first adsorption heat exchanger (21) and the humidity control passage (40*a*) of the first adsorption cooling element (41), and is supplied to the inside of the room as supply air (SA). At this time, the room air (RA) is discharged to the outdoors as exhaust air (EA) after giving moisture to the adsorbent when passing through the second adsorption heat exchanger (22) and the humidity control passage (40*a*) of the second adsorption cooling element (42).

At the time of the second operation of the humidifying operation shown in FIG. 9B, the cold/hot water circuit (10) is in the second cold/hot water circulation state and the air passage (30) is in the second air circulation state. In this state, the outdoor air (OA) is heated by absorbing the adsorption heat produced by passing of the room air (RA) through the humidity control passage (40*a*) when the outdoor air (OA) passes through the cooling passage (40*b*) of the first adsorption cooling element (41), subsequently is humidified by passing through the second adsorption heat exchanger (22) and the humidity control passage (40*a*) of the second adsorption cooling element (42), and is supplied to the inside of the room as supply air (SA). At this time, the room air (RA) is discharged to the outdoors as exhaust air (EA) after giving moisture to the adsorbent when passing through the first adsorption heat exchanger (21) and the humidity control passage (40*a*) of the first adsorption cooling element (41).

At the time of the first operation of the dehumidifying operation shown in FIG. 10B, the cold/hot water circuit (10) is in the second cold/hot water circulation state and the air passage (30) is in the first air circulation state. In this state, the outdoor air (OA) is dehumidified when passing through the first adsorption heat exchanger (21) and the humidity control passage (40*a*) of the first adsorption cooling element (41) and is supplied to the inside of the room as supply air (SA). In the first adsorption cooling element (41), temperature rise of the supply air (SA) is suppressed by absorption of the adsorption heat by the room air (RA) flowing through the cooling passage (40*b*). At this time, the room air (RA) is heated by passing through the cooling passage (40*b*) of the first adsorption cooling element (41), subsequently recycles the adsorbent when passing through the second adsorption heat exchanger (22) and the humidity control passage (40*a*) of the second adsorption cooling element (42), and is discharged to the outdoors as exhaust air (EA).

At the time of the second operation of the dehumidifying operation shown in FIG. 10A, the cold/hot water circuit (10) is in the first cold/hot water circulation state and the air passage (30) is in the second air circulation state. In this state, the outdoor air (OA) is dehumidified when passing through the second adsorption heat exchanger (22) and the humidity control passage (40*a*) of the second adsorption cooling element (42) and is supplied to the inside of the room as supply air (SA). In the second adsorption cooling element (42), temperature rise of the supply air (SA) is suppressed by absorption of adsorption heat by the room air (RA) flowing through the cooling passage (40*b*). At this time, the room air (RA) is heated when passing through the cooling passage (40*b*) of the second adsorption cooling element (42), recycles the adsorbent when passing through the first adsorption heat exchanger (21) and the humidity control passage (40*a*) of the first adsorption cooling element (41), and is discharged to the outdoors as exhaust air (EA).

Also in the sixth embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

By increasing switching frequency between the first operation and the second operation when the latent heat load of the inside of the room is large and by decreasing switching frequency between the first operation and the second operation when, conversely, the latent heat load is small, it becomes possible to perform an operation that excels in the balance between indoor amenity and energy efficiency

Seventh Embodiment

Figure 11:
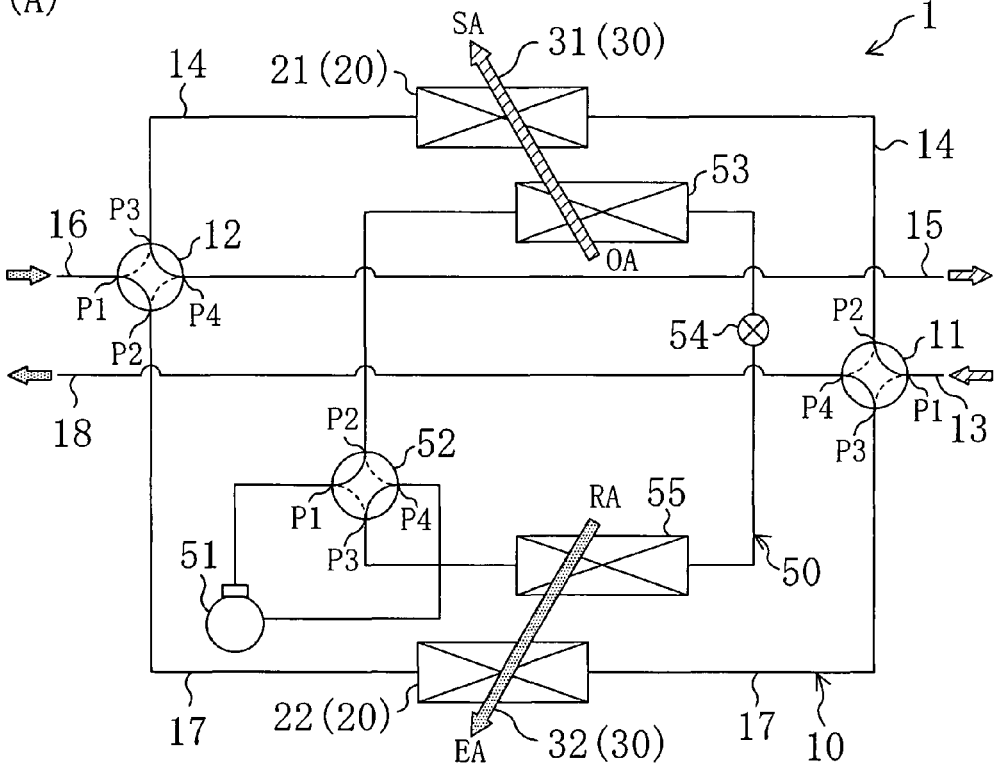
FIG. 11 is a circuit diagram showing a humidifying operating state of a humidity controller according to a seventh embodiment.
Figure 11:
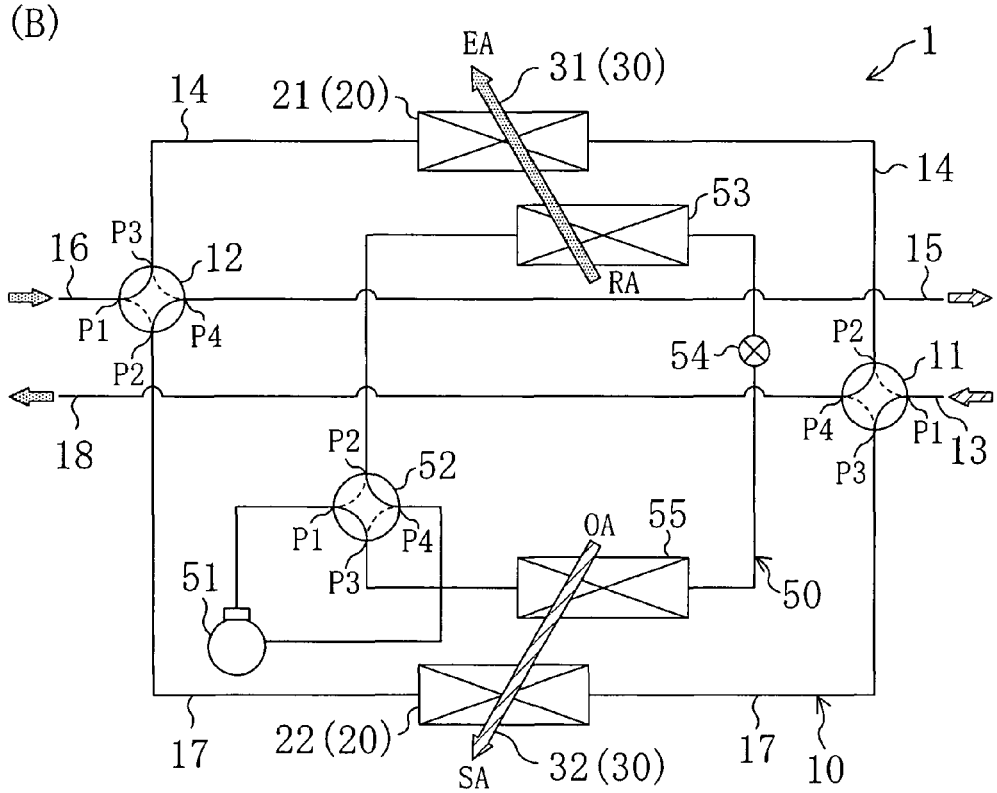
Figure 12:
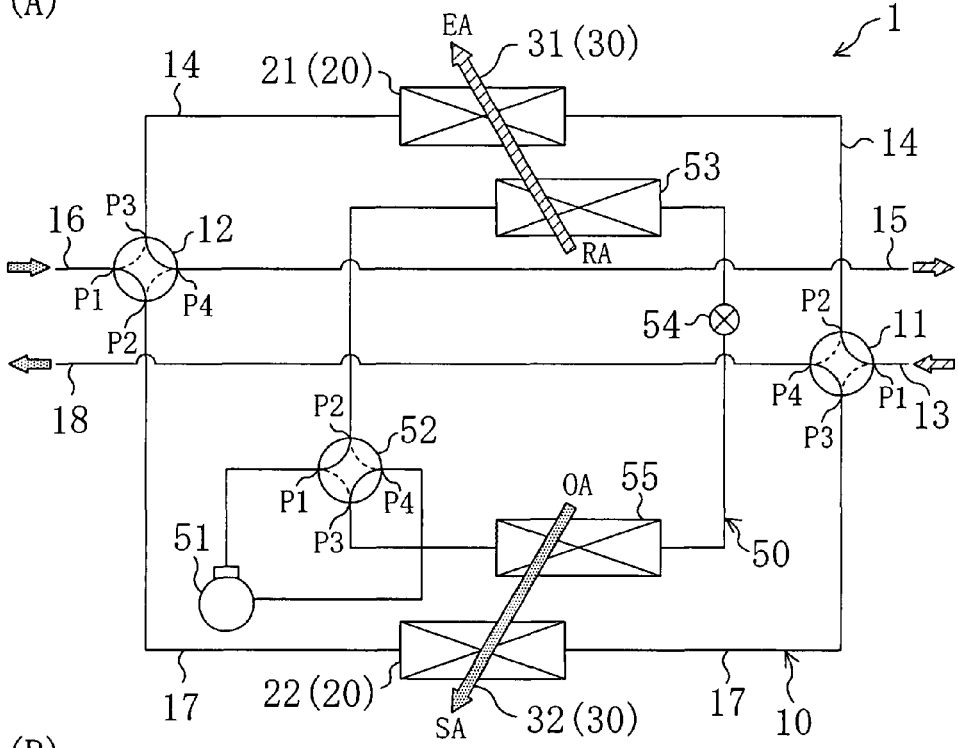
FIG. 12 is a circuit diagram showing a dehumidifying operating state of the humidity controller according to the seventh embodiment.
Figure 12:
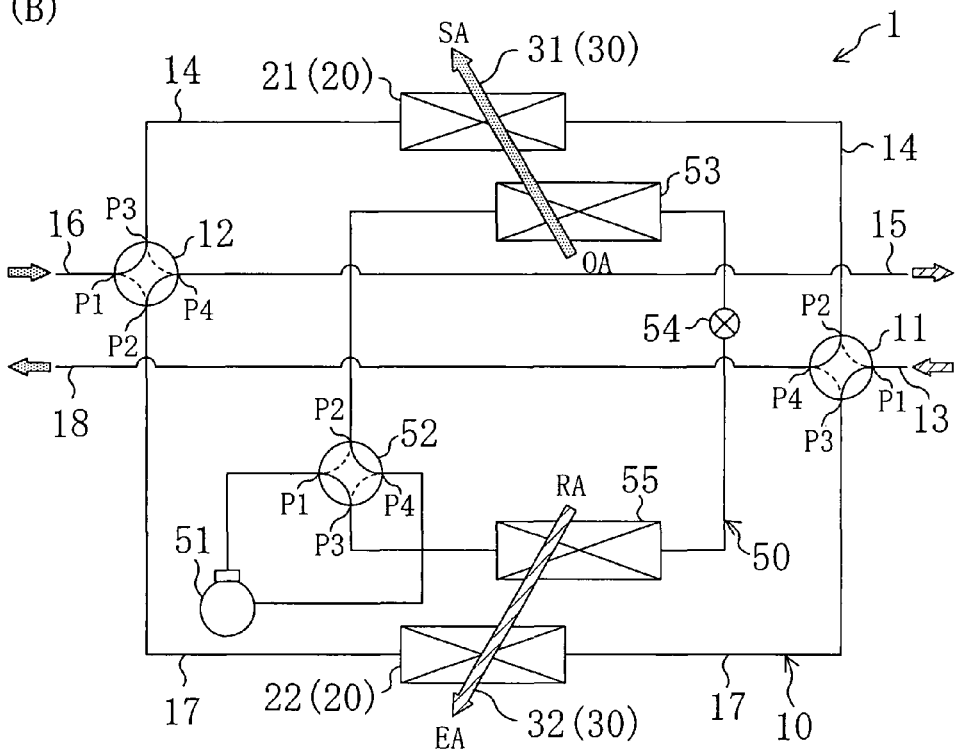

The humidity controller (1) of a seventh embodiment shown in FIG. 11 and FIG. 12 is an example such that a refrigerant circuit (50) is further installed in the controller of the second embodiment.

The refrigerant circuit (50) is a closed circuit that conducts a refrigerating cycle of circulating a refrigerant, being composed of a compressor (51), a third four-way selector valve (52), a third adsorption heat exchanger (53), an expansion valve (54), and a fourth adsorption heat exchanger (55) that are connected serially. Thus, the heat exchanger of this refrigerant circuit (50) is made up of an adsorption heat exchanger that supports an adsorbent on its surface.

In the refrigerant circuit (50), a circulation direction of the refrigerant can be reversed. The refrigerant circuit (50) is configured to be switchable between a first refrigerant circulation state (a state of FIG. 11A and FIG. 12A) in which the third adsorption heat exchanger (53) serves as a condenser and the fourth adsorption heat exchanger (55) serves as an evaporator and a second refrigerant circulation state (a state of FIG. 11B and FIG. 12B) in which the fourth adsorption heat exchanger (55) serves as a condenser and the third adsorption heat exchanger (53) serves as an evaporator.

Moreover, the air passage (30) is configured to be switchable between the first air circulation state (a state of FIG. 11A and FIG. 12B) in which the air passage (30) supplies air that has passed through the third adsorption heat exchanger (53) and the first adsorption heat exchanger (21) to the inside of the room and also discharges air that has passed through the fourth adsorption heat exchanger (55) and the second adsorption heat exchanger (22) and the second air circulation state (a state of FIG. 11B and FIG. 12A) in which the air passage (30) supplies air that has passed through the fourth adsorption heat exchanger (55) and the second adsorption heat exchanger (22) to the inside of the room and also discharges air that has passed through the third adsorption heat exchanger (53) and the first adsorption heat exchanger (21) to the outdoors.

At the time of the first operation of the humidifying operation shown in FIG. 11A, the cold/hot water circuit (10) is in the first cold/hot water circulation state, the refrigerant circuit (50) is in the first refrigerant circulation state, and the air passage (30) is in the first air circulation state. In this state, outdoor air (OA) is humidified when passing through the third adsorption heat exchanger (53) and the first adsorption heat exchanger (21), and supplied to the inside of the room as supply air (SA). At this time, room air (RA) gives moisture to the adsorbent when passing through the fourth adsorption heat exchanger (55) and the second adsorption heat exchanger (22), and subsequently is discharged to the outdoors as exhaust air (EA).

At the time of the second operation of the humidifying operation shown in FIG. 11B, the cold/hot water circuit (10) is in the second cold/hot water circulation state, the refrigerant circuit (50) is in the second refrigerant circulation state, and the air passage (30) is in the second air circulation state. In this state, the outdoor air (OA) is humidified when passing through the fourth adsorption heat exchanger (55) and the second adsorption heat exchanger (22), and is supplied to the inside of the room as supply air (SA). At this time, the room air (RA) gives moisture to the adsorbent when passing through the third adsorption heat exchanger (53) and the first adsorption heat exchanger (21), and is discharged to the outdoors as exhaust air (EA) after.

At the time of the first operation of the dehumidifying operation shown in FIG. 12B, the cold/hot water circuit (10) is in the second cold/hot water circulation state, the refrigerant circuit (50) is in the second refrigerant circulation state, and the air passage (30) is in the first air circulation state. In this state, the outdoor air (OA) is dehumidified when passing through the third adsorption heat exchanger (53) and the first adsorption heat exchanger (21), and supplied to the inside of the room as supply air (SA). At this time, the room air (RA) recycles the adsorbent when passing through the fourth adsorption heat exchanger (55) and the second adsorption heat exchanger (22), and subsequently is discharged to the outdoors as exhaust air (EA) after.

At the time of the second operation of the dehumidifying operation shown in FIG. 12A, the cold/hot water circuit (10) is in the first cold/hot water circulation state, the refrigerant circuit (50) is in the first refrigerant circulation state, and the air passage (30) is in the second air circulation state. In this state, the outdoor air (OA) is dehumidified when passing through the fourth adsorption heat exchanger (55) and the second adsorption heat exchanger (22), and is supplied to the inside of the room as supply air (SA). At this time, the room air (RA) recycles the adsorbent when passing through the third adsorption heat exchanger (53) and the first adsorption heat exchanger (21), and subsequently is discharged to the outdoors as exhaust air (EA) after.

Also in this seventh embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, by increasing switching frequency between the first operation and the second operation when the latent heat load of the inside of the room is large and by decreasing the switching frequency between the first operation and the second operation when the latent heat load of the inside of the room is small, it becomes possible to perform an operation that excels in the balance between indoor amenity and energy efficiency Furthermore, since this humidity controller (1) uses the adsorption heat exchangers (53, 55) of the refrigerant circuit (50) in addition to the adsorption heat exchangers (21, 22) of the cold/hot water circuit (10), dehumidification and humidification performance is improved.

Still moreover, if assuming a humidity controller for performing dehumidification/humidification only with adsorption heat exchangers installed in the refrigerant circuit, the circulating amount of refrigerant of the refrigerant circuit (50) can be lessened in the seventh embodiment, and accordingly it becomes also possible to attain low noise by using the small-sized compressor (51).

In the seventh embodiment, either of the first adsorption heat exchanger (21) or the third adsorption heat exchanger (53) may be disposed on the upper stream side of the air passage (30), and either of the second adsorption heat exchanger (22) or the fourth adsorption heat exchanger (55) may be disposed on the upper stream side of the air passage (30).

Eighth Embodiment

Figure 13:
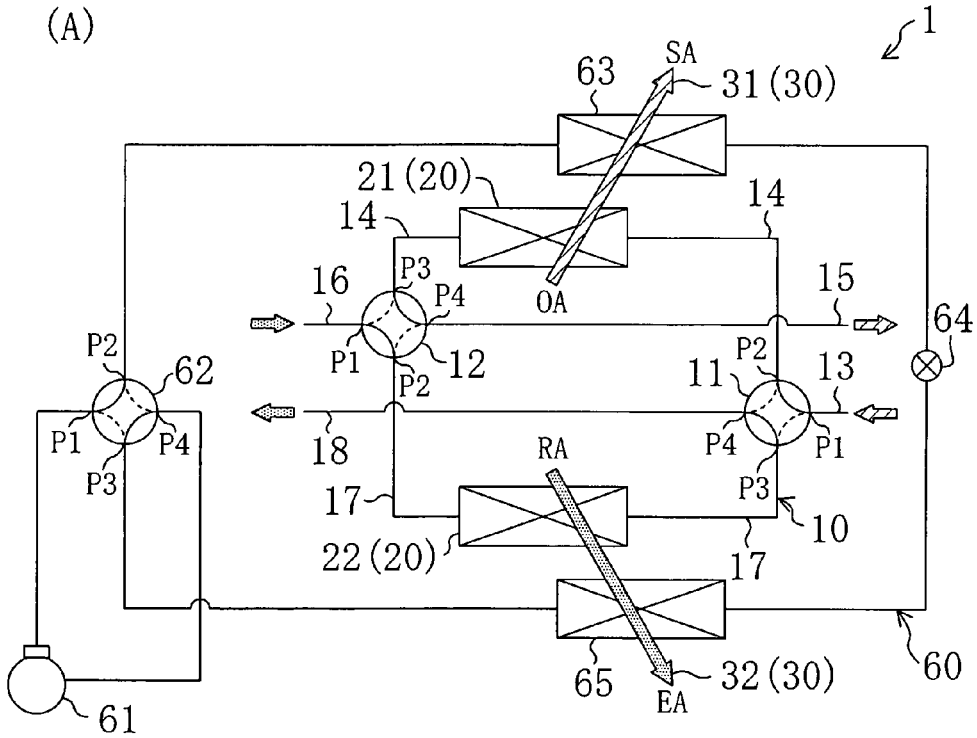
FIG. 13 is a circuit diagram showing a humidifying operating state of a humidity controller according to an eighth embodiment.
Figure 13:
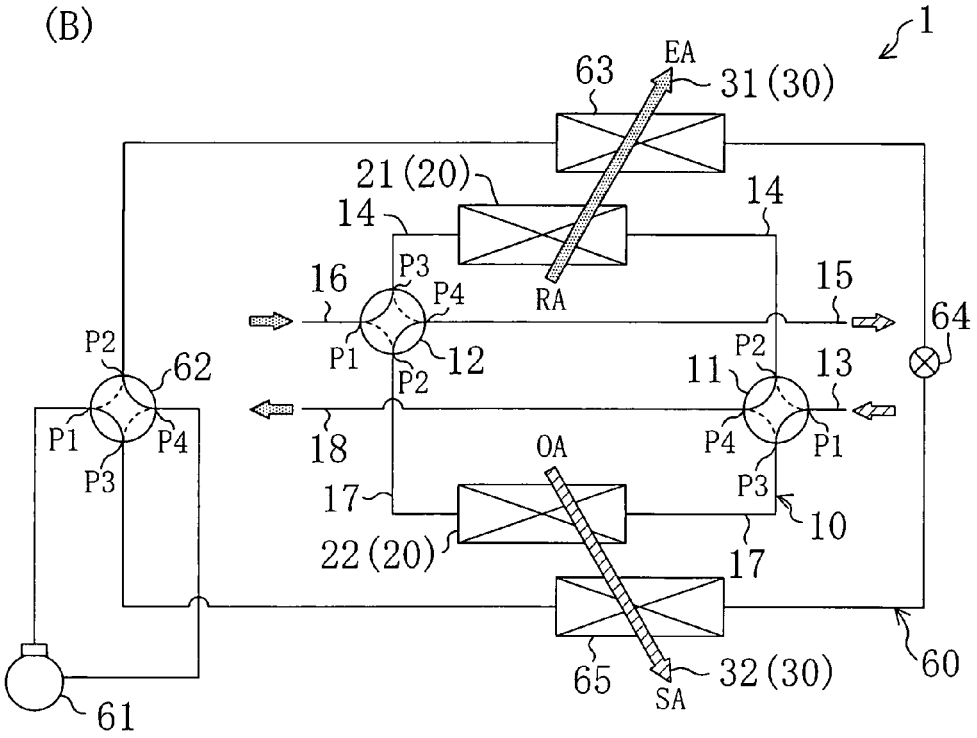
Figure 14:
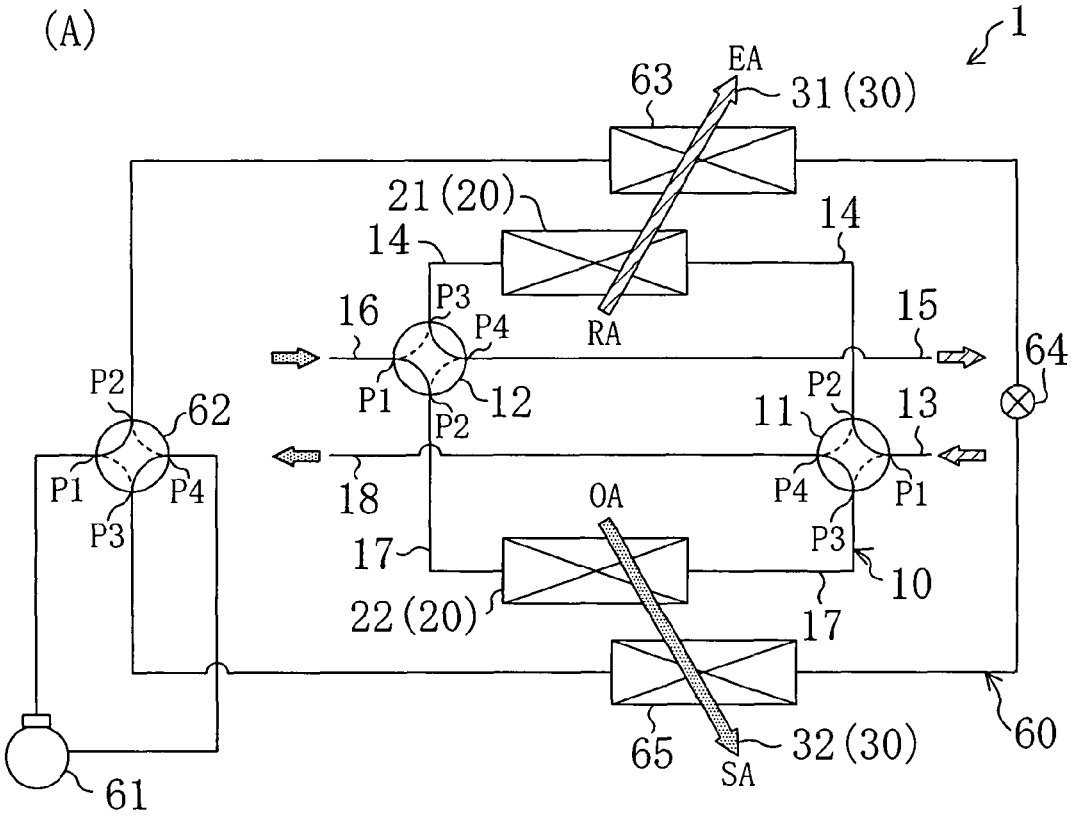
FIG. 14 is a circuit diagram showing the dehumidifying operating state of the humidity controller according to the eighth embodiment.
Figure 14:
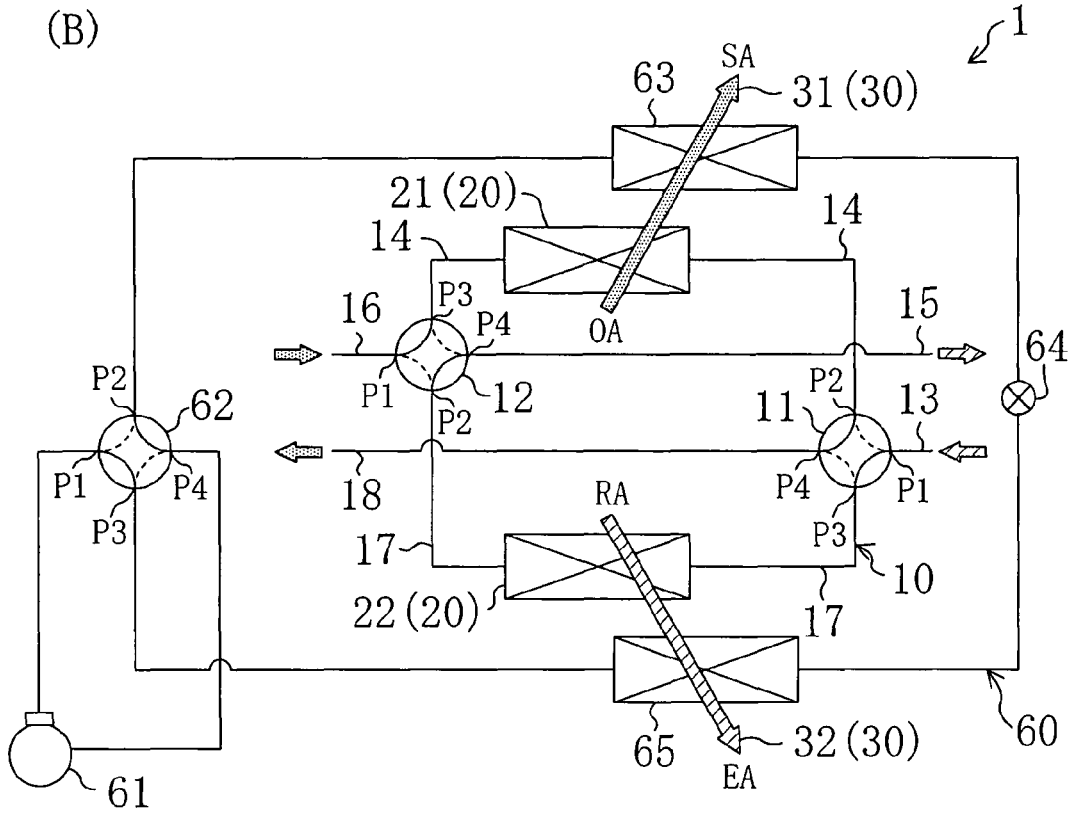

The humidity controller (1) of an eighth embodiment shown in FIG. 13 and FIG. 14 is another example of the humidity controller of the second embodiment such that a refrigerant circuit (60) is further installed.

The heat exchanger of this refrigerant circuit (60) is made up of an air heat exchanger that does not support an adsorbent on its surface. Specifically, the refrigerant circuit (60) is a closed circuit for conducting a refrigerating cycle of circulating a refrigerant, being composed of a compressor (61), a third four-way selector valve (62), a first air heat exchanger (63), an expansion valve (64), and a second air heat exchanger (65) that are connected serially. Thus, the heat exchanger of this refrigerant circuit (60) is made up of the first air heat exchanger (63) and the second air heat exchanger (65) in which air carries out a sensible heat change by heat exchange with the refrigerant.

In the refrigerant circuit (60), a circulation direction of the refrigerant can be reversed. The refrigerant circuit (60) is configured to be switchable between the first refrigerant circulation state (a state of FIG. 13A and FIG. 14A) in which the first air heat exchanger (63) serves as a condenser and the second air heat exchanger (65) serves as an evaporator and the second refrigerant circulation state (a state of FIG. 13B and FIG. 14B) in which the second air heat exchanger (65) serves as a condenser and the first air heat exchanger (63) serves as an evaporator.

Moreover, the air passage (30) is configured to be switchable between the first air circulation state (a state of FIG. 13A and FIG. 14B) in which the air passage (30) supplies air that has passed through the first adsorption heat exchanger (21) and the first air heat exchanger (63) to the inside of the room and also discharges air that has passed through the second adsorption heat exchanger (22) and the second air heat exchanger (65) and the second air circulation state (a state of FIG. 13B and FIG. 14A) in which the air passage (30) supplies air that has passed through the second adsorption heat exchanger (22) and the second air heat exchanger (65) to the inside of the room and also discharges air that has passed through the first adsorption heat exchanger (21) and the first air heat exchanger (63).

At the time of the first operation of the humidifying operation shown in FIG. 13A, the cold/hot water circuit (10) is in the first cold/hot water circulation state, the refrigerant circuit (60) is in the first refrigerant circulation state, and the air passage (30) is in the first air circulation state. In this state, outdoor air (OA) is humidified when passing through the first adsorption heat exchanger (21), subsequently is heated when passing through the first air heat exchanger (63), and is supplied to the inside of the room as supply air (SA). At this time, room air (RA) gives moisture to the adsorbent when passing through the second adsorption heat exchanger (22), radiates heat to the refrigerant when passing through the second air heat exchanger (65), and subsequently is discharged to the outdoors as exhaust air (EA).

At the time of the second operation of the humidifying operation shown in FIG. 13B, the cold/hot water circuit (10) is in the second cold/hot water circulation state, the refrigerant circuit (60) is in the second refrigerant circulation state, and the air passage (30) is in the second air circulation state. In this state, the outdoor air (OA) is humidified when passing through the second adsorption heat exchanger (22), subsequently is heated when passing through the second air heat exchanger (65), and is supplied to the inside of the room as supply air (SA). At this time, the room air (RA) gives moisture to the adsorbent when passing through the first adsorption heat exchanger (21), radiates heat to the refrigerant when passing through the first air heat exchanger (63), and subsequently is discharged to the outdoors as exhaust air (EA).

At the time of the first operation of the dehumidifying operation shown in FIG. 14B, the cold/hot water circuit (10) is in the second cold/hot water circulation state, the refrigerant circuit (60) is in the second refrigerant circulation state, and the air passage (30) is in the first air circulation state. In this state, the outdoor air (OA) is dehumidified when passing through first adsorption heat exchanger (21), subsequently is cooled when passing through the first air heat exchanger (63), and is supplied to the inside of the room as supply air (SA). At this time, the room air (RA) recycles the adsorbent when passing through the second adsorption heat exchanger (22), cools the refrigerant when passing through the second air heat exchanger (65), and subsequently is discharged to the outdoors as exhaust air (EA).

At the time of the second operation of the dehumidifying operation shown in FIG. 14A, the cold/hot water circuit (10) is in the first cold/hot water circulation state, the refrigerant circuit (60) is in the first refrigerant circulation state, and the air passage (30) is in the second air circulation state. In this state, the outdoor air (OA) is dehumidified when passing through the second adsorption heat exchanger (22), subsequently is cooled when passing through the second air heat exchanger (65), and is supplied to the inside of the room as supply air (SA). At this time, the room air (RA) recycles the adsorbent when passing through the first adsorption heat exchanger (21), cools the refrigerant when passing through the first air heat exchanger (63), and subsequently is discharged to the outdoors as exhaust air (EA).

Also in the eighth embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, by increasing the switching frequency between the first operation and the second operation when the latent heat load of the inside of the room is large, and by decreasing the switching frequency between the first operation and the second operation when, conversely, the latent heat load is small, it becomes possible to perform an operation that excels in the balance between indoor amenity and energy efficiency.

Ninth Embodiment

Figure 15:
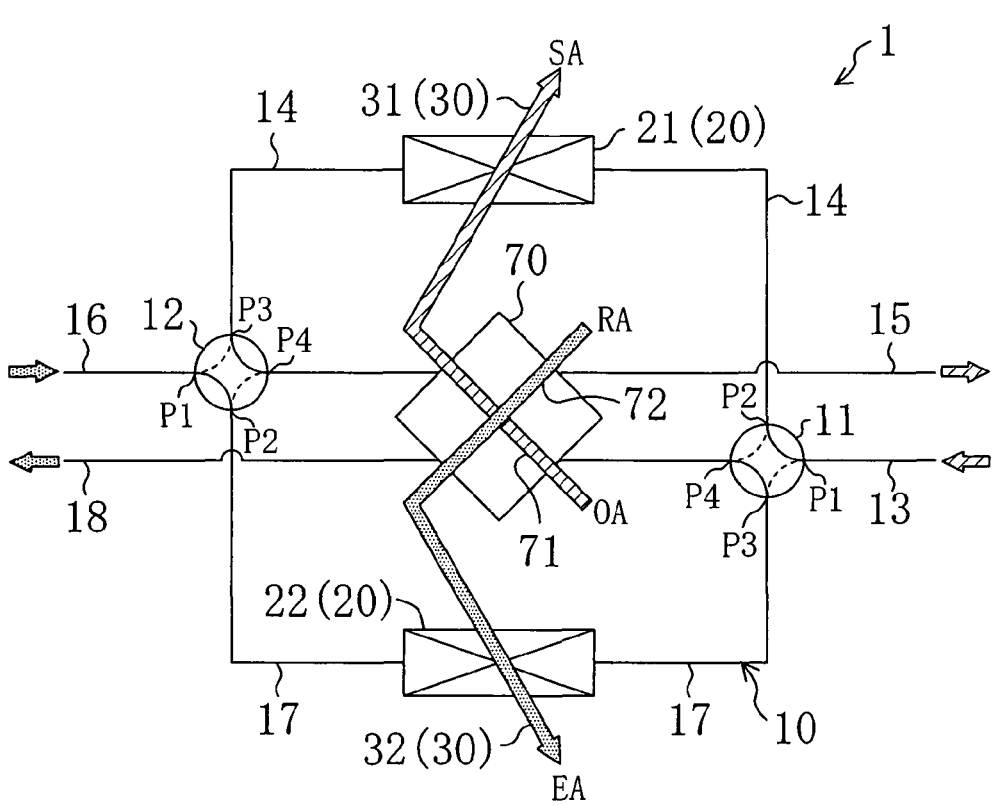
FIG. 15 is a circuit diagram showing a humidifying operating state of a humidity controller according to a ninth embodiment.
Figure 15:
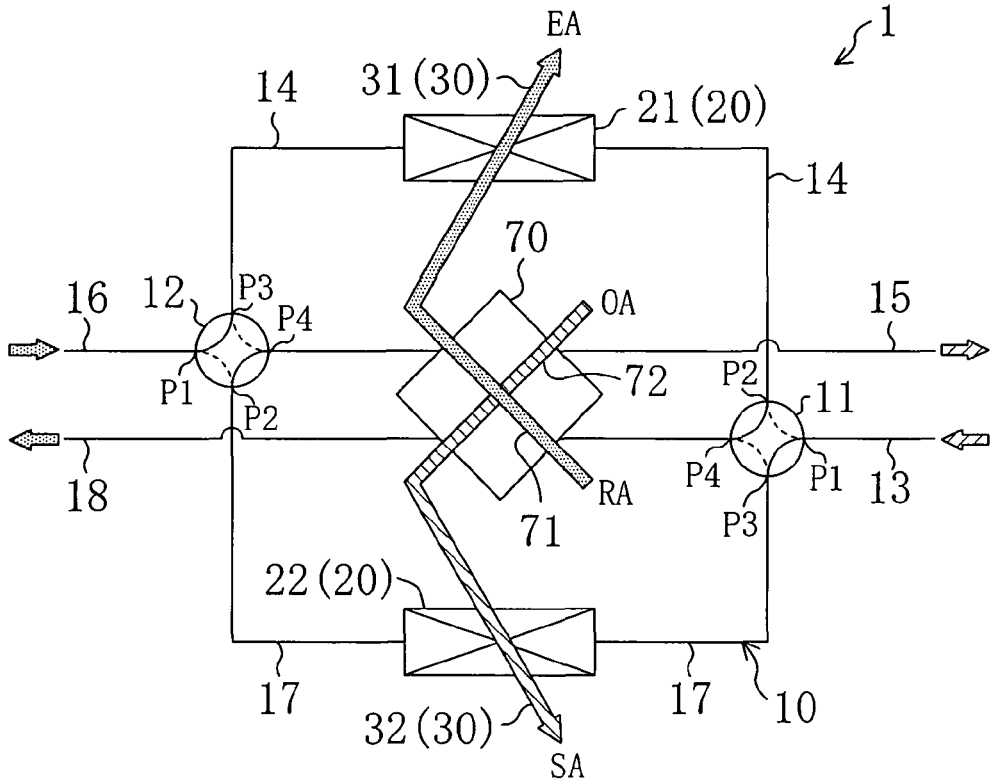
Figure 16:
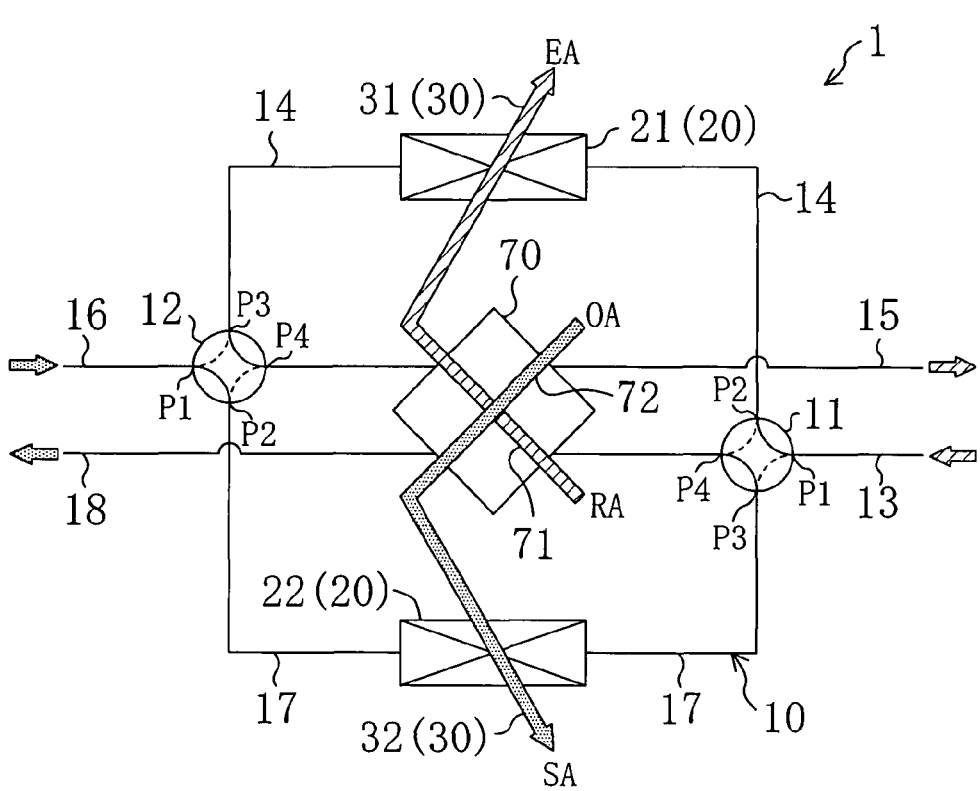
FIG. 16 is a circuit diagram showing a dehumidifying operating state of the humidity controller according to the ninth embodiment.
Figure 16:
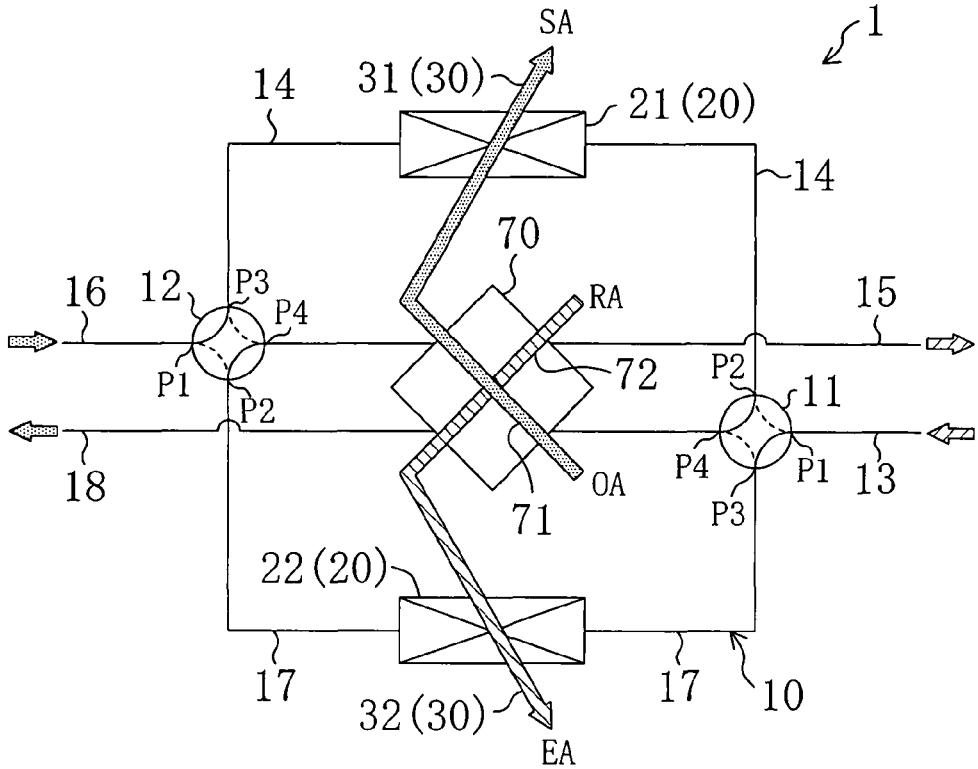

The humidity controller (1) of a ninth embodiment shown in FIG. 15 and FIG. 16 is an example such that an auxiliary heat exchanger (70) is further installed in the controller of the second embodiment.

The auxiliary heat exchanger (70) is equipped with a first passage (71) through which first air flows and a second passage (72) through which second air flows, and is configured to let the air flowing through the first passage (71) and the air flowing through the second passage (72) conduct a total heat exchange or a sensible heat exchange. That is, the auxiliary heat exchanger (70) is made up of a total heat exchanger or a sensible heat exchanger.

Moreover, the air passage (30) is configured to be switchable between the first air circulation state (a state of FIG. 15A, FIG. 16B) in which the air passage (30) supplies air that has passed through the first passage (71) of the auxiliary heat exchanger (70) and the first adsorption heat exchanger (21) and also discharges air that has passed through the second passage (72) of the auxiliary heat exchanger (70) and the second adsorption heat exchanger (22) to the outdoors and the second air circulation state (a state of FIG. 15B and FIG. 16A) in which the air passage (30) supplies air that has passed through the second passage (72) of the auxiliary heat exchanger (70) and the second adsorption heat exchanger (22) to the inside of the room and also discharges air that has passed through the first passage (71) of the auxiliary heat exchanger (70) and the first adsorption heat exchanger (21) to the outdoors.

At the time of the first operation of the humidifying operation shown in FIG. 15A, the cold/hot water circuit (10) is in the first cold/hot water circulation state and the air passage (30) is in the first air circulation state. In this state, outdoor air (OA) is heated/humidified by room air (RA) when flowing through the auxiliary heat exchanger (70), subsequently is humidified when passing through the first adsorption heat exchanger (21), and is supplied to the inside of the room as supply air (SA). At this time, the room air (RA) heats/humidifies the outdoor air (OA) when flowing through the auxiliary heat exchanger (70), gives moisture to the adsorbent when passing through the second adsorption heat exchanger (22), and subsequently is discharged to the outdoors as exhaust air (EA).

At the time of the second operation of the humidifying operation shown in FIG. 15B, the cold/hot water circuit (10) is in the second cold/hot water circulation state and the air passage (30) is in the second air circulation state. In this state, the outdoor air (OA) is heated/humidified when flowing through the auxiliary heat exchanger (70), subsequently is humidified when passing through the second adsorption heat exchanger (22), and is supplied to the inside of the room as supply air (SA). At this time, the room air (RA) heats/humidifies the outdoor air (OA) when flowing through the auxiliary heat exchanger (70), gives moisture to the adsorbent when passing through the first adsorption heat exchanger (21), and subsequently is discharged to the outdoors as exhaust air (EA).

At the time of the first operation of the dehumidifying operation shown in FIG. 16B, the cold/hot water circuit (10) is in the second cold/hot water circulation state and the air passages (30) is in the first air circulation state. In this state, the outdoor air (OA) is cooled/dehumidified by the room air (RA) when flowing through the auxiliary heat exchanger (70), subsequently is dehumidified when passing through the first adsorption heat exchanger (21), and is supplied to the inside of the room as supply air (SA). At this time, the room air (RA) cools/dehumidifies the outdoor air (OA) when flowing through the auxiliary heat exchanger (70), recycles the adsorbent when passing through the second adsorption heat exchanger (21), and subsequently is discharged to the outdoors as exhaust air (EA).

At the time of the second operation of the dehumidifying operation shown in FIG. 16A, the cold/hot water circuit (10) is in the first cold/hot water circulation state and the air passage (30) is in the second air circulation state. In this state, the outdoor air (OA) is cooled/dehumidified by the room air (RA) when flowing through the auxiliary heat exchanger (70), subsequently is dehumidified when passing through the second adsorption heat exchanger (22), and is supplied to the inside of the room as supply air (SA). At this time, the room air (RA) cools/dehumidifies the outdoor air (OA) when flowing through the auxiliary heat exchanger (70), recycles the adsorbent when passing through the first adsorption heat exchanger (22), and subsequently is discharged to the outdoors as exhaust air (EA).

Also in this ninth embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, by increasing the switching frequency between the first operation and the second operation when the latent heat load of the inside of the room is large, and by decreasing the switching frequency between the first operation and the second operation when, conversely, the latent heat load is small, it becomes possible to perform an operation that excels in the balance between indoor amenity and energy efficiency.

Furthermore, it becomes possible for this humidity controller (1) to attain improvement of dehumidification and humidification performance and/or cooling and heating performance.

Tenth Embodiment

Figure 18:
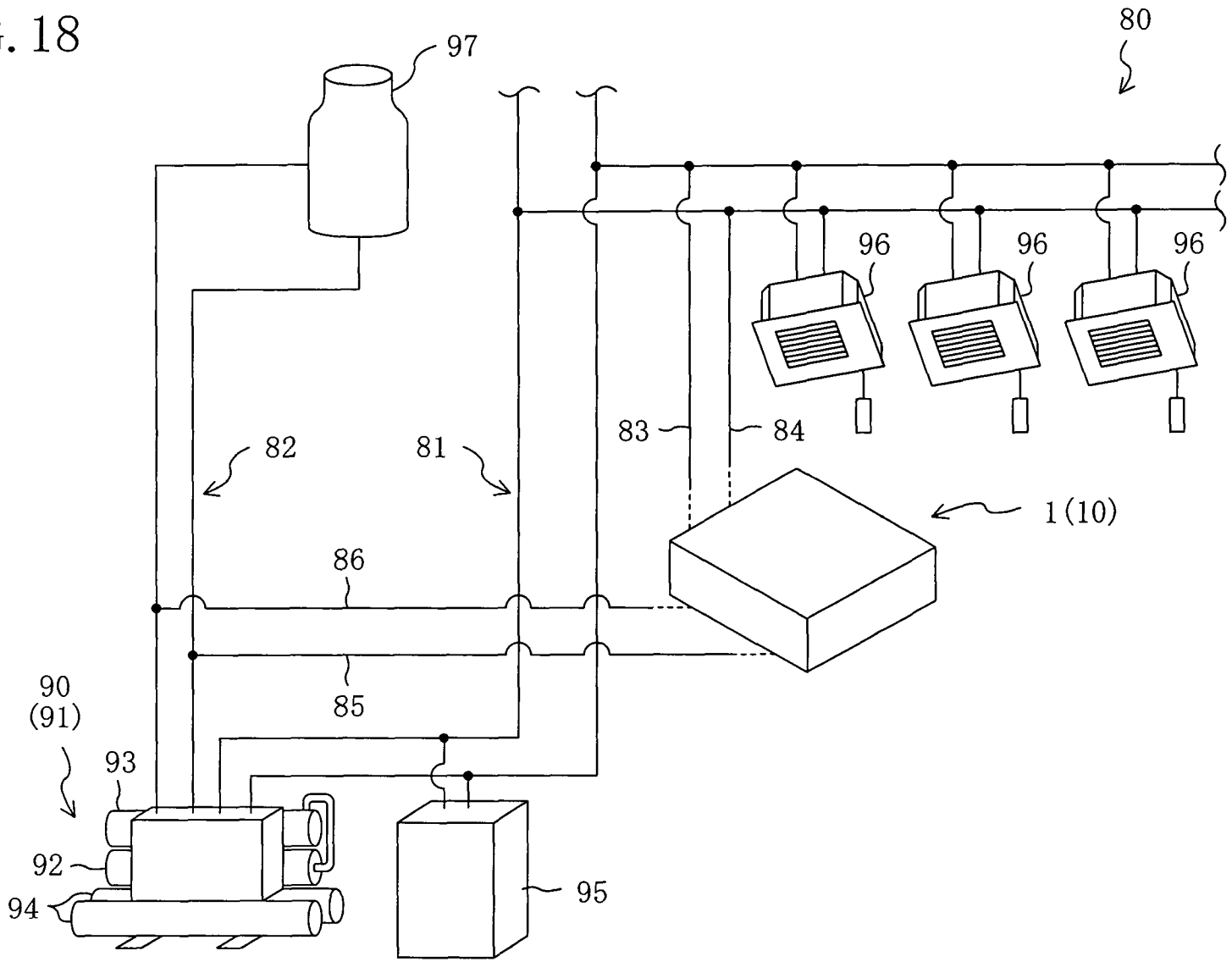
FIG. 18 is a circuit diagram of an outside air control system to which a humidity controller according to a tenth embodiment is applied.

As shown in FIG. 18, the humidity controller (1) of a tenth embodiment is applied to an outside air control system (80) of the total latent heat processing type that simultaneously processes sensible heat and latent heat of the insides of a plurality of rooms, such as of an office building and a hotel. The outside air control system (80) is configured to be switchable between a dehumidifying and cooling operation in summer and a heating and humidifying operation in winter. This outside air control system has a first heat source circuit (81) and a second heat source circuit (82) serving as a cold/hot water heat source of the cold/hot water circuit (10).

The first heat source circuit (81) connects with the cold/hot water circuit (10) of the humidity controller (1) through a first connecting pipe (83) and a second connecting pipe (84), connects with a refrigerator (90), described later, thereby constituting a circulation path of water. Moreover, a boiler (95) and a plurality of air conditioners (96, 96, . . . ) are connected in parallel with the first heat source circuit (81). The boiler (95) is made up of a hot water boiler. Each of the plurality of air conditioners (96, 96, . . . ) is made up of the two-pipe fan coil unit type air conditioner, and is installed on a wall surface or ceiling surface inside each room. Furthermore, the first heat source circuit (81) is provided with a pump for sending water out of the first heat source circuit (81) by pressure and a shut-off valve for changing a flow path of water flowing through this first heat source circuit (81) (illustration of the pump and the shut-off valve is omitted).

The second heat source circuit (82) connects with the cold/hot water circuit (10) of the humidity controller (1) through a third connecting pipe (85) and a fourth connecting pipe (86), and at the same time connects with the refrigerator (90), thereby constituting a circulation path of water. Moreover, the second heat source circuit (82) is connected in parallel with a cooling tower (97). The cooling tower (97) is configured to be capable of cooling water that flows through the second heat source circuit (82) by air blown from a fan, not shown. Furthermore, the second heat source circuit (82) is equipped with a pump for sending water out of the second heat source circuit (82) by pressure and a shut-off valve for changing a flow path of water flowing through this second heat source circuit (82).

The refrigerator (90) is made up of what is called a water-cooled chiller unit. This refrigerator (90) is equipped with a refrigerant circuit (91) that is filled with a refrigerant and operates a refrigerating cycle. The refrigerant circuit (91) is provided with a cooler (92), a compressor (93), a condenser (94), and an expansion valve, not shown.

Although the cooler (92) is composed of heat exchangers of; for example, the shell and tube type, it may be made up of any heat exchangers, such as a plate heat exchanger, other than the above heat exchanger. This cooler (92) is configured to be capable of heat transfer between the refrigerant flowing through the refrigerant circuit (91) and water flowing through the first heat source circuit (81). Although the condenser (94) is made up of a pair of shell and tube type heat exchangers, it is not limited to this but may be made up of any kind of heat exchangers. This condenser (94) is configured to be capable of heat transfer between the refrigerant flowing through the refrigerant circuit (91) and water flowing through the second heat source circuit (82).

Although the humidity controller (1) of the tenth embodiment 2 is configured as a ventilation-fan type humidity controller (1), as in the above-mentioned humidity controller (1) of the second embodiment, it differs from the humidity controller (1) of the second embodiment in that it supplies processed outdoor air (OA) to the inside of each room, and on the other hand processes and discharges room air (RA) in the inside of the each room to the outdoors.

—Driving Operation—

A cooling and dehumidifying operation and a heating and humidifying operation of the outside air control system (80) to which the humidity controller (1) of the tenth embodiment is applied will be described below.

(Cooling and Dehumidifying Operation)

Figure 19:
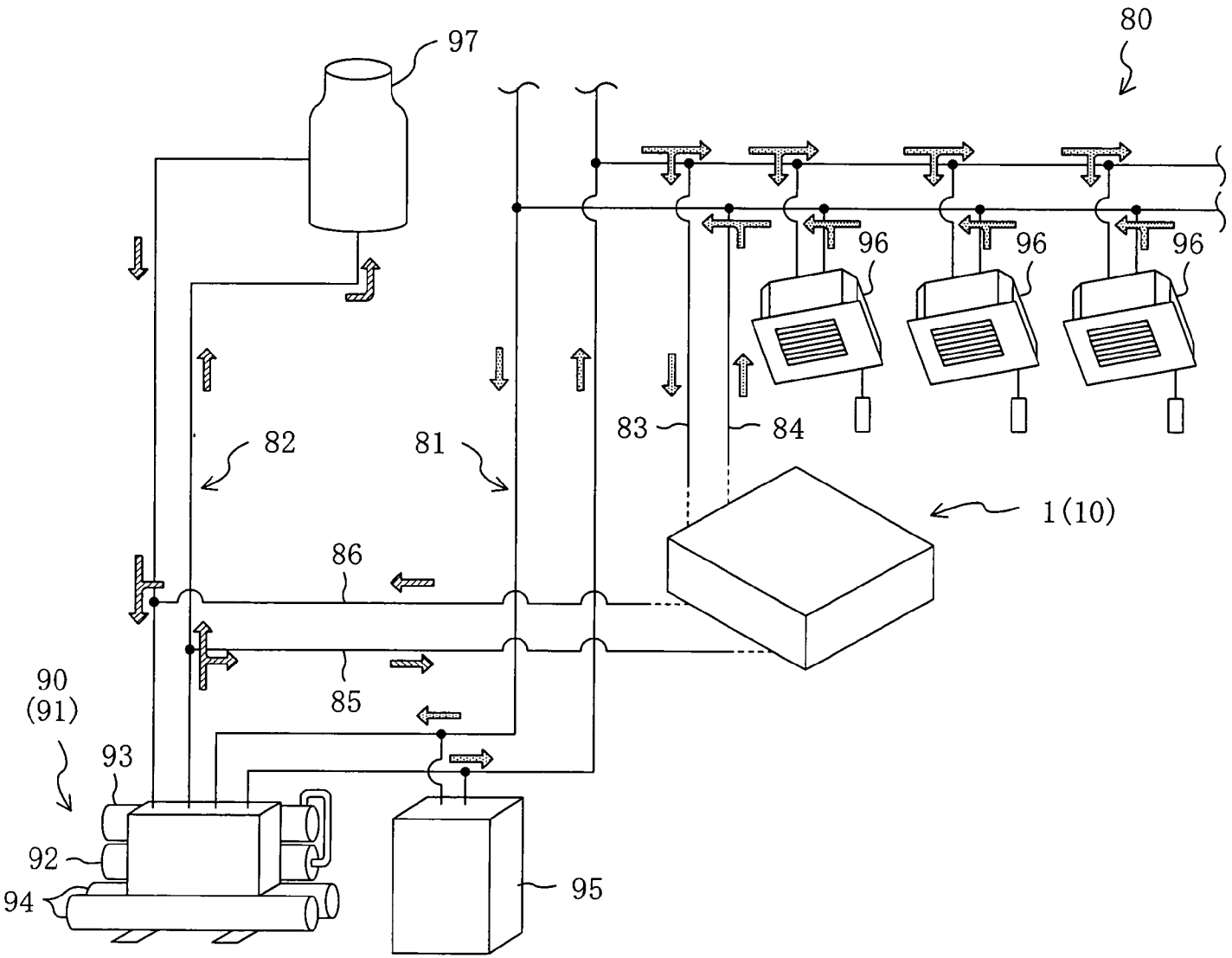
FIG. 19 is a circuit diagram showing a cooling and dehumidifying operating state of the outside air control system to which the humidity controller according to the tenth embodiment is applied.

At the time of cooling and dehumidifying operation, the refrigerator (90) is in an operating state, whereas the boiler (95) is in a halt state. Moreover, a pump which is not shown is operated and a shut-off valve which is not shown is switched over, so that the flows of water of the first and second heat source circuits (81, 82) are changed as shown in FIG. 19. Accordingly, the first heat source circuit (81) serves as a cold heat source for supplying cold water cooled by the cooler (92) of the refrigerator (90) to the cold/hot water circuit (10). On the other hand, the second heat source circuit (82) serves as a hot heat source for supplying hot water heated by heat radiated from the condenser (94) of the refrigerator (90) to the cold/hot water circuit (10).

Specifically, when water flowing through the first heat source circuit (81) flows into the cooler (92), this water conducts heat exchange with the refrigerant of the refrigerant circuit (91). As a result, the water flowing through the first heat source circuit (81) is deprived of evaporation heat of the refrigerant and is thus cooled. A part of the water (cold water) cooled by the cooler (92) is sent to the air conditioners (96, 96, . . . ). Each of the air conditioners (96, 96, . . . ) blows air cooled by the cold water into the inside of each room, thereby cooling the inside of the each room. The rest of the cold water cooled by the cooler (92) is supplied to the cold/hot water circuit (10) through the first connecting pipe (83).

On the other hand, when water flowing through the second heat source circuit (82) flows into the condenser (94), this water conducts heat exchange with the refrigerant of the refrigerant circuit (91). As a result, the water flowing through the second heat source circuit (92) is heated by being given the condensed heat of the refrigerant. A part of the water (hot water) heated by the condenser (94) is sent to the cooling tower (97). In the cooling tower (97), heat discharge is carried out from the hot water into air. On the other hand, the rest of the hot water heated by the condenser (94) is supplied to the cold/hot water circuit (10) through the third connecting pipe (85).

As in the second embodiment described above, the cold/hot water circuit (10) conducts the first operation of FIG. 4B and the second operation of FIG. 4A alternately. Specifically, at the time of the first operation, cold water supplied to the cold/hot water circuit (10) from the first heat source circuit (81) passes through the first adsorption heat exchanger (21), and cools the adsorbent of this first adsorption heat exchanger (21). Subsequently, the cold water is returned to the second connecting pipe (84) of the first heat source circuit (81). Moreover, hot water supplied to the cold/hot water circuit (10) from the second heat source circuit (82) passes through the second adsorption heat exchanger (22), and heats the adsorbent of this second adsorption heat exchanger (22). Subsequently, the hot water is returned to the fourth connecting pipe (86) of the second heat source circuit (82).

In this occasion, the first adsorption heat exchanger (21) dehumidifies and cools the outdoor air (OA). The dehumidified and cooled air is supplied to the inside of each room as supply air (SA). On the other hand, in the second adsorption heat exchanger (22), the room air (RA) from the inside of each room heat recycles the adsorbent of the second adsorption heat exchanger (22). The air used for heating and recycling the adsorbent of the second adsorption heat exchanger (22) is discharged to the outdoors as exhaust air (EA).

On the other hand, at the time of the second operation, cold water supplied to the cold/hot water circuit (10) from the first heat source circuit (81) passes through the second adsorption heat exchanger (22), and cools the adsorbent of this second adsorption heat exchanger (22). Subsequently, the cold water is returned to the second connecting pipe (84) of the first heat source circuit (81). Moreover, hot water supplied to the cold/hot water circuit (10) from the second heat source circuit (82) passes through the first adsorption heat exchanger (21), and heats the adsorbent of this first adsorption heat exchanger (21). Subsequently, the hot water is returned to the fourth connecting pipe (86) of the second heat source circuit (82).

In this occasion, the second adsorption heat exchanger (22) dehumidifies and cools the outdoor air (OA). The dehumidified and cooled air is supplied to the inside of the each room as supply air (SA). On the other hand, in the first adsorption heat exchanger (21), the room air (RA) from the inside of the each room heats and recycles the adsorbent of the first adsorption heat exchanger (21). The air used for heating and recycling the adsorbent of the first adsorption heat exchanger (21) is discharged to the outdoors as exhaust air (EA).

(Heating and Humidifying Operation)

Figure 20:
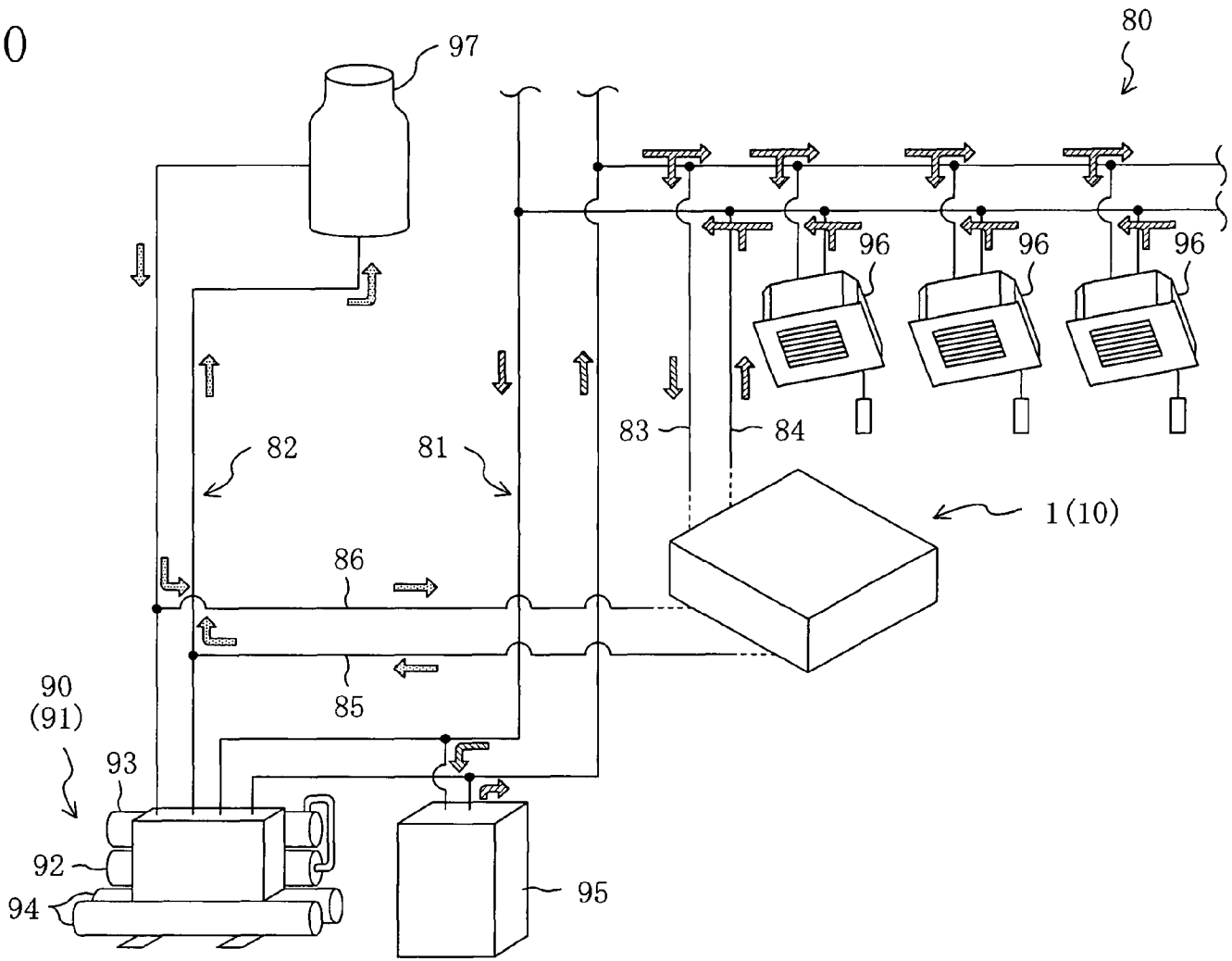
FIG. 20 is a circuit diagram showing a heating and humidifying operating state of the outside air control system to which the humidity controller according to the tenth embodiment is applied.

At the time of heating and humidifying operation, the refrigerator (90) is in a halt state, while the boiler (95) is in an operating state. Moreover, a pump which is not shown begins to be operated and a shut-off valve which is not shown is switched over, so that flows of water in the first and second heat source circuits (81, 82) are changed as shown in FIG. 20. Accordingly, the first heat source circuit (81) serves as a hot heat source for supplying hot water heated by the boiler (95) to the cold/hot water circuit (10). On the other hand, the second heat source circuit (82) serves as a cold heat source for supplying cold water cooled by the cooling tower (97) to the cold/hot water circuit (10).

Specifically, when water flowing through the first heat source circuit (81) flows into the boiler (95), this water is heated by the boiler (95). A part of the water (hot water) heated by the boiler (95) is sent to the air conditioners (96, 96, . . . ). Each of the air conditioners (96, 96, . . . ) blows air heated by hot water into the inside of each room, and the inside of the each room is heated. The rest of the hot water heated by the boiler (95) is sent to the cold/hot water circuit (10) through the first connecting pipe (83).

On the other hand, when water flowing through the second heat source circuit (82) flows into the cooling tower (97), this water is cooled by air blown by the cooling tower (97). The air cooled by the cooling tower (97) is supplied to the cold/hot water circuit (10) through the fourth connecting pipe (86).

The cold/hot water circuit (10) conducts the first operation of FIG. 3B and the second operation of FIG. 3A alternately as in the above-mentioned second embodiment. Specifically, at the time of the first operation, hot water supplied to the cold/hot water circuit (10) from the first heat source circuit (81) passes through the first adsorption heat exchanger (21), and heats the adsorbent of the first adsorption heat exchanger (21). Subsequently, the hot water is returned to the second connecting pipe (84) of the first heat source circuit (81). Moreover, cold water supplied to the cold/hot water circuit (10) from the second heat source circuit (82) passes through the second adsorption heat exchanger (22), and cools the adsorbent of the second adsorption heat exchanger (22). Subsequently, the cold water is returned to the third connecting pipe (85) of the second heat source circuit (82).

In this occasion, the first adsorption heat exchanger (21) humidifies and heats the outdoor air (OA). The humidified and heated air is supplied to the inside of each room as supply air (SA). On the other hand, in the second adsorption heat exchanger (22), the room air (RA) from the inside of each room gives moisture to the adsorbent of the second adsorption heat exchanger (22). The air that gave moisture to the adsorbent of the second adsorption heat exchanger (22) is discharged to the outdoors as exhaust air (EA).

On the other hand, at the time of the second operation, hot water supplied to the cold/hot water circuit (10) from the first heat source circuit (81) passes through the second adsorption heat exchanger (22), and heats the adsorbent of the second adsorption heat exchanger (22). Subsequently, the hot water is returned to the second connecting pipe (84) of the first heat source circuit (81). Moreover, cold water supplied to the cold/hot water circuit (10) from the second heat source circuit (82) passes through the first adsorption heat exchanger (21), and cools the adsorbent of this first adsorption heat exchanger (21). Subsequently, the cold water is returned to the third connecting pipe (85) of the second heat source circuit (82).

In this occasion, the second adsorption heat exchanger (22) humidifies and heats the outdoor air (OA). The humidified and heated air is supplied to the inside of each room as supply air (SA). On the other hand, in the first adsorption heat exchanger (21), the room air (RA) from the inside of the each room gives moisture to the adsorbent of the first adsorption heat exchanger (21). The air that gave moisture to the adsorbent of the second adsorption heat exchanger (22) is discharged to the outdoors as exhaust air (EA).

Also in the tenth embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, in the tenth embodiment, at the time of cooling and dehumidifying operation in summer, cold water cooled by the cooler (92) of the refrigerator (92) is supplied to the cold/hot water circuit (10). Therefore, with the easy and simple configuration, the adsorbent of the humidity controller (1) can be cooled, and dehumidification and cooling of supply air (SA) can be performed simultaneously. Moreover, the cold water cooled by the cooler (92) can be used for cooling the inside of the room by the air conditioners (96, 96, . . . ).

Moreover, at the time of cooling and dehumidifying operation, hot water heated by heat radiated from the condenser (94) of the refrigerator (90) is supplied to the cold/hot water circuit (10). Therefore, the adsorbent of the humidity controller (1) can be heated and recycled using the radiated heat of the refrigerator (90), so that the outside air control system (80) can perform an energy-efficient cooling and dehumidifying operation.

On the other hand, at the time of heating and humidifying operation, hot water heated by the boiler (95) is supplied to the cold/hot water circuit (10). Therefore, with the easy and simple configuration, the adsorbent of the humidity controller (1) can be certainly heated and recycled. Moreover, the hot water heated by the boiler (95) can be used for heating the inside of the room by the air-conditioners (96, 96, . . . ).

Furthermore, at the time of the heating and humidifying operation, the adsorbent of the humidity controller (1) can be easily cooled by supplying cold water cooled by the cooling tower (97) to the cold/hot water circuit (10).

It is noted that the cooling tower (97) may be configured not to operate at the time of the heating and humidifying operation. In this case, only hot water is supplied to the humidity controller (1), and the first operation of FIG. 8B and the second operation of FIG. 8A are conducted as in the fifth embodiment described above. That is, in this case, moisture in the room air (RA) is natural-adsorbed with the adsorbent of the first adsorption heat exchanger (21) and the second adsorption heat exchanger (22) that are not cooled. On the other hand, by being heated by hot water, the moisture desorbed from the first adsorption heat exchanger (21) and the second adsorption heat exchanger (22) is given to supply air (SA), which is supplied to the inside of the room.

On the other hand, at the time of cooling and dehumidifying operation described above, it is also possible that only cold water cooled by the refrigerator (90) is supplied to the cold/hot water circuit (10) but hot water is not supplied. In this case, moisture of the room air (RA) is adsorbed by the first and second adsorption heat exchangers (21, 22) that are in a cooled state, while recycling of the first and second adsorption heat exchangers (21, 22) is conducted by the heat of the outdoor air (OA). The desorbed moisture is given to supply air (SA), which is supplied to the inside of the room.

It goes without saying that the humidity controller (1) of any other embodiment may be applied to the outside air control system (80) described in this embodiment.

Eleventh Embodiment

Figure 21:
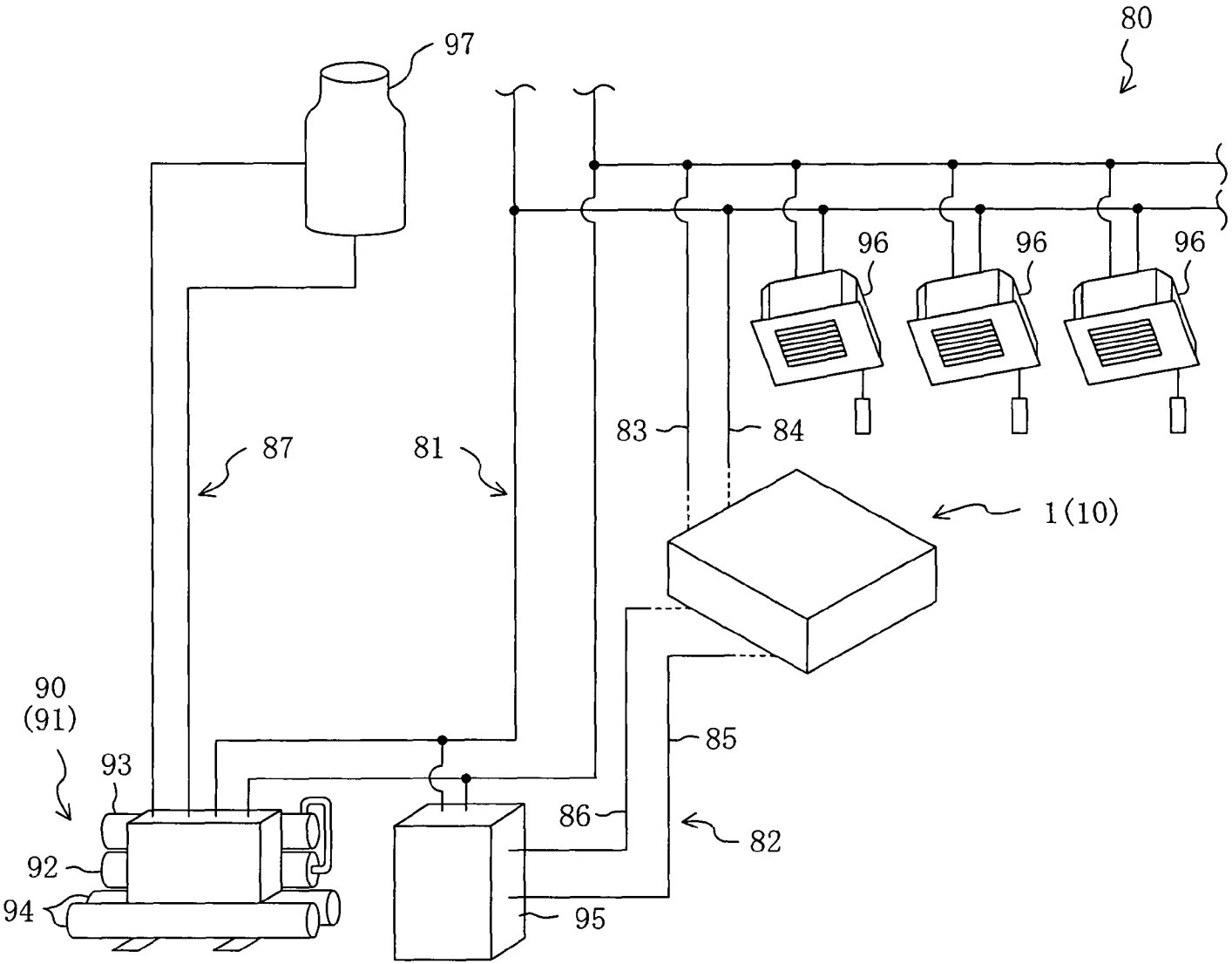
FIG. 21 is a circuit diagram of an outside air control system to which a humidity controller according to an eleventh embodiment is applied.

As shown in FIG. 21, the humidity controller (1) of an eleventh embodiment is applied to an outside air control system (80) different from that of the tenth embodiment described above. The outside air control system (80) has the first heat source circuit (81), the second heat source circuit (82), and a cooling-tower circuit (87) as cold/hot water heat sources of the cold/hot water circuit (10) in the humidity controller (1).

As in the tenth embodiment, the first heat source circuit (81) constitutes a circulation path of water by connecting to the cold/hot water circuit (10) of the humidity controller (1) through the first connecting pipe (83) and the second connecting pipe (84) and connecting to the refrigerator (90). The boiler (95) and the plurality of air conditioners (96, 96, . . . ) are connected in parallel with the first heat source circuit (81), as in the tenth embodiment. Moreover, the first heat source circuit (81) is provided with a pump for sending water out of the first heat source circuit (81) by pressure and a shut-off valve for changing a flow path of water flowing through the first heat source circuit (81) (illustration of the pump and the shut-off valve is omitted).

The second heat source circuit (82) constitutes a circulation path of water by connecting to the cold/hot water circuit (10) of the humidity controller (1) through the third connecting pipe (85) and the fourth connecting pipe (86), and at the same time, by connecting to the boiler (95). Moreover, the second heat source circuit (82) is provided with the pump for sending water out of the second heat source circuit (82) by pressure and the shut-off valve for changing a flow path of water flowing through the second heat source circuit (82) (illustration of the pump and the shut-off valve is omitted).

The cooling-tower circuit (87) constitutes a circulation path of water by connecting to the refrigerator (90) through the same cooling tower (97) as that of the tenth embodiment.

The refrigerator (90) is made up of a water-cooled chiller unit, as in the tenth embodiment. The cooler (92) of the refrigerator (90) is configured to be capable of heat transfer between the refrigerant flowing through the refrigerant circuit (91) and water flowing through the first heat source circuit (81). On the other hand, the condenser (94) of the refrigerator (90) is configured to be capable of heat transfer between the refrigerant flowing through the refrigerant circuit (91) and water flowing through the cooling-tower circuit (87).

As in the humidity controller of the tenth embodiment, the humidity controller (1) is made up of a ventilation-fan type humidity controller for supplying processed outdoor air (OA) to the inside of each room, and on the other hand processing and discharging room air (RA) of the inside of the each room to the outdoors.

—Driving Operation—

A cooling and dehumidifying operation and a heating and humidifying operation of the outside air control system (80) to which the humidity controller (1) of the eleventh embodiment is applied will be described below.

(Cooling and Dehumidifying Operation)

Figure 22:
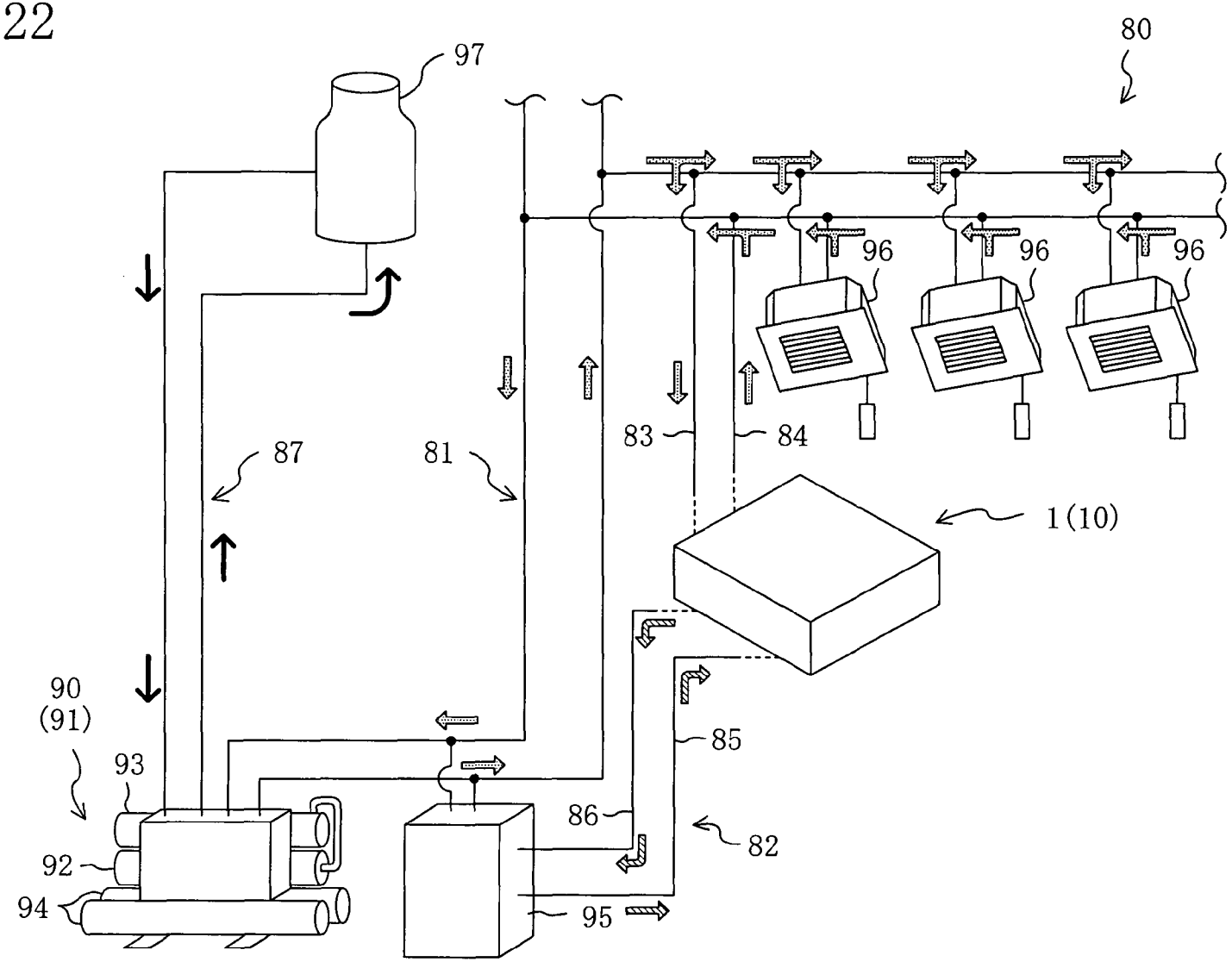
FIG. 22 is a circuit diagram showing a cooling and dehumidifying operating state of the outside air control system to which the humidity controller according to the eleventh embodiment is applied.

At the time of cooling and dehumidifying operation, the refrigerator (90) and the boiler (95) are in an operating state. Moreover, a pump which is not shown is operated and a shut-off valve which is not shown is switched over, so that flows of water of the first and second heat source circuits (81, 82) are changed as shown in FIG. 22. Accordingly, the first heat source circuit (81) serves as a cold heat source for supplying cold water cooled by the cooler (92) of the refrigerator (90) to the cold/hot water circuit (10). On the other hand, the second heat source circuit (82) serves as a hot heat source for supplying hot water heated by the boiler (95) to the cold/hot water circuit (10).

Specifically, when water flowing through the first heat source circuit (81) flows into the cooler (92), this water conducts heat exchange with the refrigerant of the refrigerant circuit (91). As a result, the water flowing through the first heat source circuit (81) is deprived of evaporation heat of the refrigerant and thus is cooled. A part of the water (cold water) cooled by the cooler (92) is sent to the air conditioners (96, 96, . . . ). Each of the air conditioners (96, 96, . . . ) blows air cooled by cold water into the inside of each room, and the inside of the each room is cooled. The rest of the cold water cooled by the cooler (92) is supplied to the cold/hot water circuit (10) through the first connecting pipe (83).

On the other hand, when water flowing through the second heat source circuit (82) flows into the boiler (95), this water is heated by the boiler (95). The water (hot water) heated by the boiler (95) is supplied to the cold/hot water circuit (10) through the third connecting pipe (85).

Moreover, water circulating in the cooling-tower circuit (87) takes away heat radiated from the condenser (94) of the refrigerator (90) and flows into the cooling tower (97). In the cooling tower (97), the circulating water radiates heat into air.

The cold/hot water circuit (10) conducts the first operation of FIG. 4B and the second operation of FIG. 4A alternately, as in the above-mentioned second embodiment. That is, cold water supplied to the cold/hot water circuit (10) cools the adsorbent of the first adsorption heat exchanger (21) or the second adsorption heat exchanger (22), and subsequently is returned to the first heat source circuit (81) through the second connecting pipe (84). On the other hand, hot water supplied to the cold/hot water circuit (10) heats the adsorbent of the first adsorption heat exchanger (21) or the second adsorption heat exchanger (22), and subsequently is returned to the second heat source circuit (82) through the fourth connecting pipe (86).

In this occasion, the outdoor air (OA) is dehumidified and cooled by the first adsorption heat exchanger (21) or the second adsorption heat exchanger (22), and subsequently is supplied to the inside of each room as supply air (SA). On the other hand, the room air (RA) from the inside of each room is used to heat and recycle the adsorbent of the first adsorption heat exchanger (21) or the second adsorption heat exchanger (22) and is discharged to the outdoors as exhaust air (EA).

(Heating and Humidifying Operation)

Figure 23:
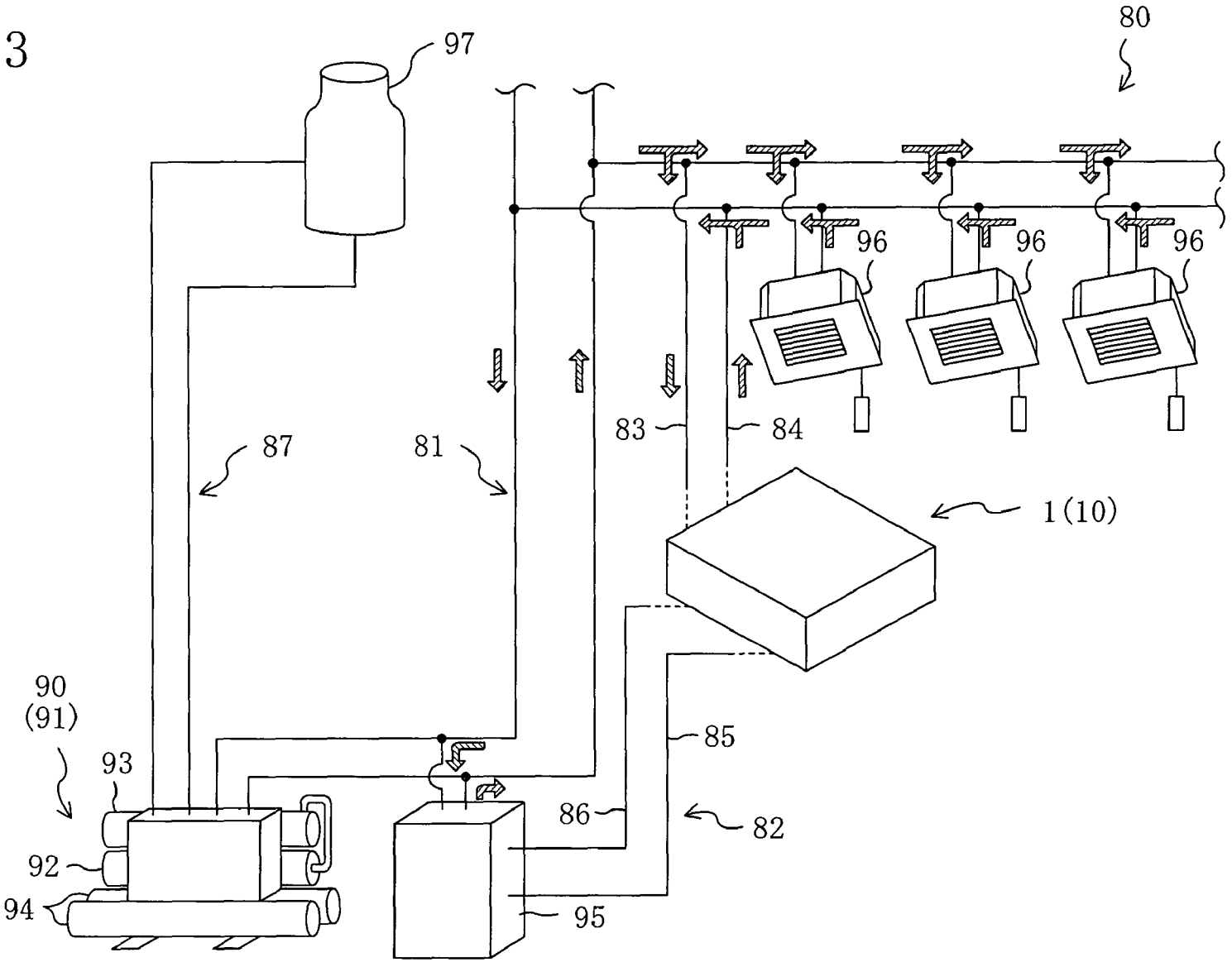
FIG. 23 is a circuit diagram showing a heating and humidifying operating state of the outside air control system to which the humidity controller according to the eleventh embodiment is applied.

At the time of heating and humidifying operation, the refrigerator (90) is in a halt state, whereas the boiler (95) is in an operating state. Moreover, a pump starts which is not shown is operated and a shut-off valve which is not shown is switched over, so that flows of water of the first and second heat source circuits (81, 82) are changed as shown in FIG. 23. Accordingly, the first heat source circuit (81) serves as a hot heat source for supplying hot water heated by the boiler (95) to the cold/hot water circuit (10).

Specifically, when water flowing through the first heat source circuit (81) flows into the boiler (95), this water is heated by the boiler (95). A part of the water (hot water) heated by the boiler (95) is sent to the air conditioners (96, 96, . . . ). Each of the air conditioners (96, 96, . . . ) blows air heated by hot water into the inside of each room, and the inside of the each room is heated. The rest of the hot water heated by the boiler (95) is sent to the cold/hot water circuit (10) through the first connecting pipe (83).

On the other hand, circulation of water is not conducted in the second heat source circuit (82) and the cooling-tower circuit (87), and accordingly there is no supply of cold water to the cold/hot water circuit (10).

Specifically, at the cold/hot water circuit (10), the first operation of FIG. 8B and the second operation of FIG. 8A are conducted, as in the above-mentioned fifth embodiment. That is, at the cold/hot water circuit (10), cooling of the adsorbent of the first adsorption heat exchanger (21) and the second adsorption heat exchanger (22) is not conducted. The room air (RA) from the inside of each room is subjected to natural adsorption in which the adsorbent adsorbs moisture and subsequently is discharged to the outdoors as exhaust air (EA).

On the other hand, hot water supplied to the cold/hot water circuit (10) heats the adsorbent of the first adsorption heat exchanger (21) or the second adsorption heat exchanger (22), and subsequently is returned to the second heat source circuit (82) through the fourth connecting pipe (86). Therefore, the outdoor air (OA) is humidified and heated by the first adsorption heat exchanger (21) or the second adsorption heat exchanger (22) and subsequently is supplied to the inside of each room as supply air (SA).

Also in the eleventh embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Moreover, in the eleventh embodiment, at the time of heating and humidifying operation in winter, supply of cold water to the cold/hot water circuit (10) is halted and moisture of the room air (RA) is adsorbed naturally. Therefore, indoor heating and humidifying can be performed by a comparatively simple operation.

It goes without saying that the humidity controller (1) of any other embodiment may be applied to the outside air control system (80) described in this embodiment.

Twelfth Embodiment

Figure 24:
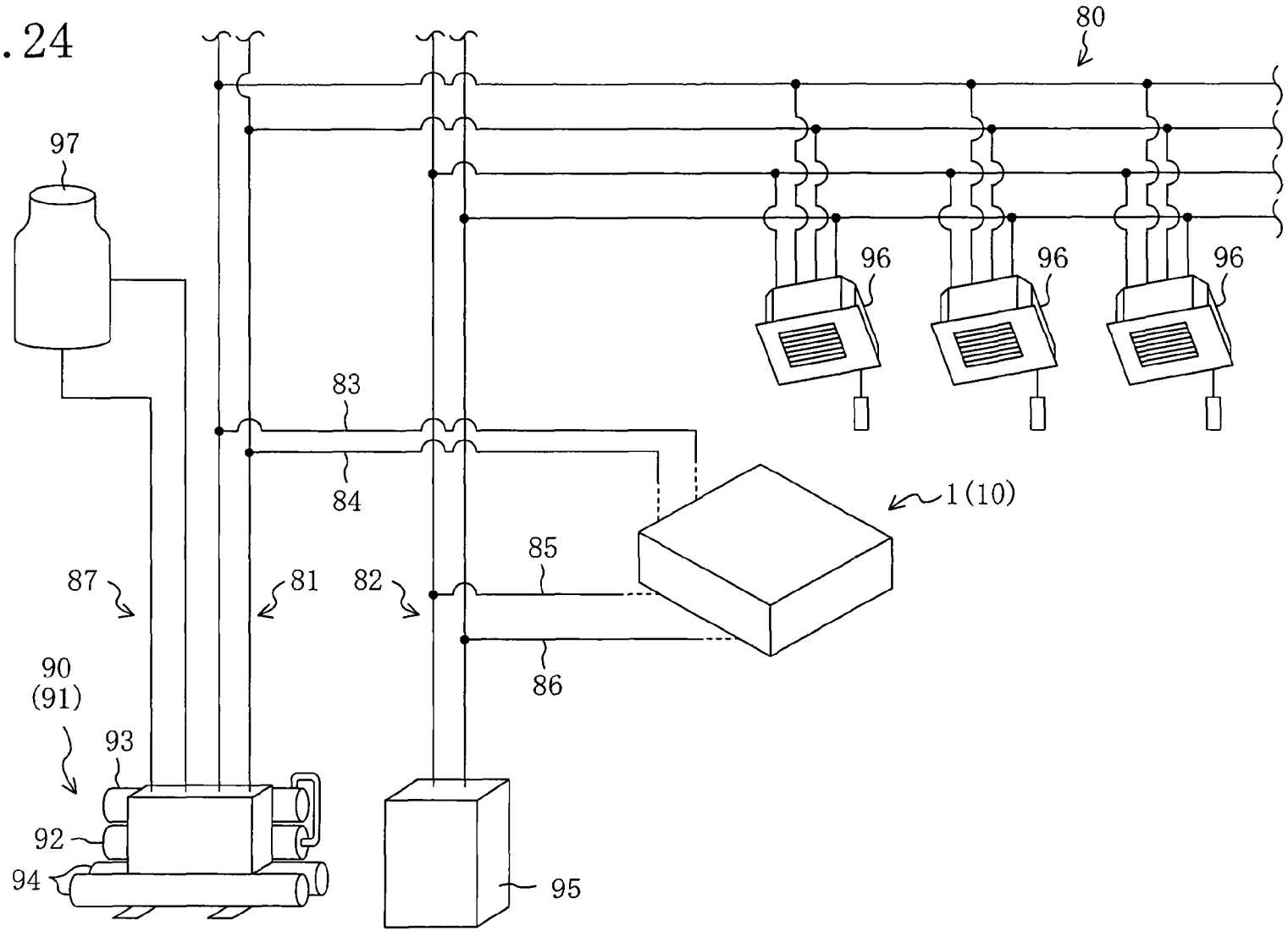
FIG. 24 is a circuit diagram of an outside air control system to which a humidity controller according to a twelfth embodiment is applied.

As shown in FIG. 24, the humidity controller (1) of a twelfth embodiment is applied to an outside air control system (80) different from those of the tenth and eleventh embodiments described above. The outside air control system (80) has the first heat source circuit (81), the second heat source circuit (82), and the cooling-tower circuit (87) as cold/hot water heat sources of the cold/hot water circuit (10) in the humidity controller (1).

As in the tenth embodiment, the first heat source circuit (81) constitutes a circulation path of water by connecting to the cold/hot water circuit (10) through the first connecting pipe (83) and a second connecting pipe (84), and at the same time, by connecting to the refrigerator (90). The plurality of air conditioners (96, 96, . . . ) are connected in parallel with the first heat source circuit (81). Unlike the tenth and eleventh embodiments described above, the plurality of air conditioners (96, 96, . . . ) are each made up of an air-conditioner of the four-pipe fan-coil unit type. Therefore, the first heat source circuit (81) is connected to two pipes of the four pipes of the each air-conditioner (96, 96, . . . ). Moreover, the first heat source circuit (81) is provided with a pump for sending water out of the first heat source circuit (81) by pressure and a shut-off valve for changing a flow path of water flowing through this first heat source circuit (81) (illustration of the pump and the shut-off valve is omitted).

The second heat source circuit (82) constitutes a circulation path of water by connecting to the cold/hot water circuit (10) of the humidity controller (1) through the third connecting pipe (85) and the fourth connecting pipe (86), and at the same time, by connecting to the boiler (95). The remaining two pipes of the four pipes of the plurality of air conditioners (96, 96, . . . ) are connected in parallel with the second heat source circuit (82). Moreover, the second heat source circuit (82) is provided with a pump for sending water out of the second heat source circuit (82) by pressure and the shut-off valve for changing a flow path of water flowing through this second heat source circuit (82) (illustration of the pump and the shut-off valve is omitted).

As in the eleventh embodiment, the cooling-tower circuit (87) constitutes a circulation path of water by connecting to the refrigerator (90) through the cooling tower (97). The refrigerator (90) is made up of the same water-cooled chiller unit as that of the eleventh embodiment.

Similarly to the humidity controllers of the tenth and eleventh embodiments, the humidity controller (1) is made up of a ventilation-fan type humidity controller that supplies processed outdoor air (OA) to the inside of each room, and also processes room air (RA) of the inside of the each room and discharges it to the outdoors.

—Driving Operation—

A cooling and dehumidifying operation and a heating and humidifying operation of the outside air control system (80) to which the humidity controller (1) of the twelfth embodiment is applied will be described below.

(Cooling and Dehumidifying Operation)

Figure 25:
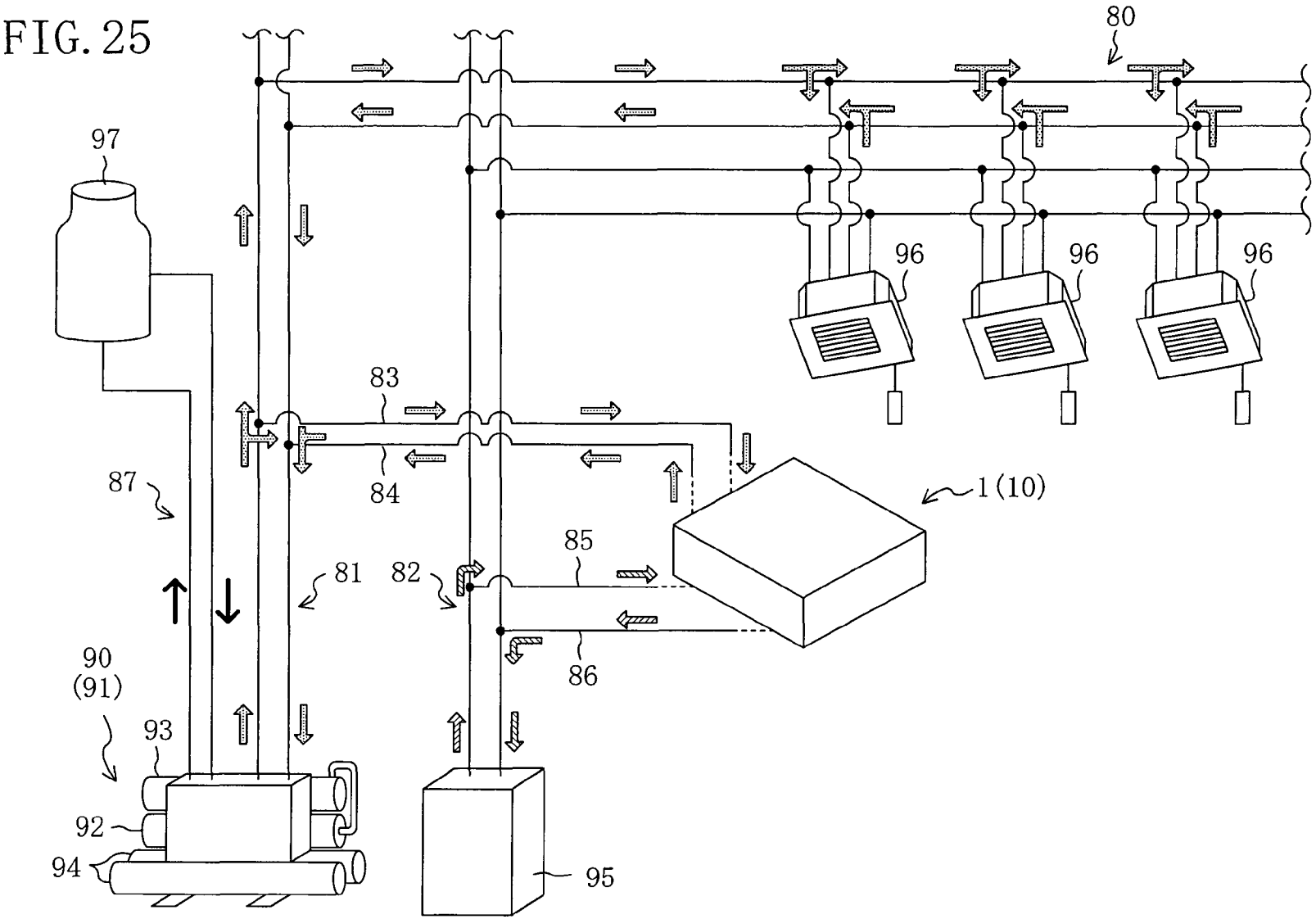
FIG. 25 is a circuit diagram showing a cooling and dehumidifying operating state of the outside air control system to which the humidity controller according to the twelfth embodiment is applied.

At the time of the cooling and dehumidifying operation, the refrigerator (90) and the boiler (95) are in an operating state. Moreover, a pump which is not shown is operated and a shut-off valve which is not shown is switched over, so that flows of water of the first and second heat source circuits (82) are changed as shown in FIG. 25. Accordingly, the first heat source circuit (81) serves as a cold heat source for supplying cold water cooled by the cooler (92) of the refrigerator (90) to the cold/hot water circuit (10). On the other hand, the second heat source circuit (82) serves as a hot heat source for supplying hot water heated by the boiler (95) to the cold/hot water circuit (10).

Specifically, when water flowing through the first heat source circuit (81) flows into the cooler (92), this water conducts heat exchange with the refrigerant of the refrigerant circuit (91). As a result, water flowing through the first heat source circuit (81) is deprived of evaporation heat of the refrigerant and thus is cooled. A part of the water (cold water) cooled by the cooler (92) is sent to the air conditioners (96, 96, . . . ). Each of the air conditioners (96, 96, . . . ) blows air cooled by cold water into the inside of each room, and the inside of the each room is cooled. The rest of the cold water cooled by the cooler (92) is supplied to the cold/hot water circuit (10) through the first connecting pipe (83).

On then other hand, when water flowing through the second heat source circuit (82) flows into the boiler (95), this water is heated by the boiler (95). The water (hot water) heated by the boiler (95) is supplied to the cold/hot water circuit (10) through the third connecting pipe (85).

Moreover, the water that circulates through the cooling-tower circuit (87) takes away heat radiated from the condenser (94) of the refrigerator (90), and flows into the cooling tower (97). In the cooling tower (97), the circulating water radiates heat into air.

In the cold/hot water circuit (10), the first operation of FIG. 4B and the second operation of FIG. 4A are conducted alternately as in the second embodiment described above. That is, the cold water supplied to the cold/hot water circuit (10) cools the adsorbent of the first adsorption heat exchanger (21) or the second adsorption heat exchanger (22), and subsequently is returned to the first heat source circuit (81) through the second connecting pipe (84). On the other hand, the hot water supplied to the cold/hot water circuit (10) heats the adsorbent of the first adsorption heat exchanger (21) or the second adsorption heat exchanger (22), and subsequently is returned to the second heat source circuit (82) through the fourth connecting pipe (86).

In this occasion, the outdoor air (OA) is dehumidified and cooled by the first adsorption heat exchanger (21) or the second adsorption heat exchanger (22), and subsequently is supplied to the inside of each room as supply air (SA). On the other hand, the room air (RA) from the inside of the each room is used to heat and recycle the adsorbent of the first adsorption heat exchanger (21) or the second adsorption heat exchanger (22) and is discharged to the outdoors as exhaust air (EA).

(Heating and Humidifying Operation)

Figure 26:
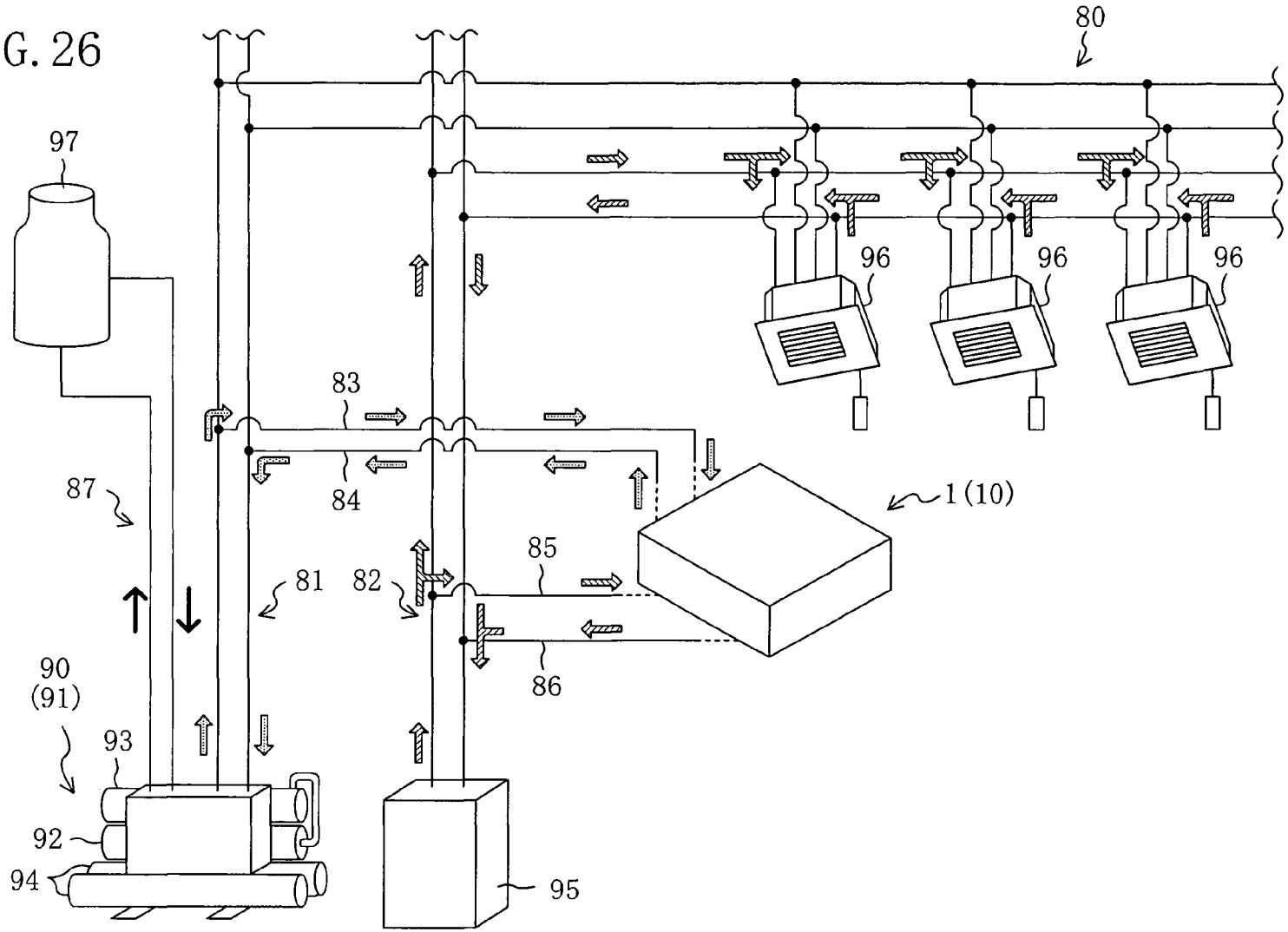
FIG. 26 is a circuit diagram showing a heating and humidifying operating state of the outside air control system to which the humidity controller according to the twelfth embodiment is applied.

At the time of heating and humidifying operation, the refrigerator (90) and the boiler (95) are in an operating state. Moreover, a pump which is not operated is operated and a shut-off valve which is not operated is switched over, so that flows of water of the first and second heat source circuits (82) are changed as shown in FIG. 26. Accordingly, the first heat source circuit (81) serves as a cold heat source for supplying cold water cooled by the cooler (92) of the refrigerator (90) to the cold/hot water circuit (10). On the other hand, the second heat source circuit (82) serves as a hot heat source for supplying hot water heated by the boiler (95) to the cold/hot water circuit (10).

Specifically, when water flowing through the first heat source circuit (81) flows into the cooler (92), this water conducts heat exchange with the refrigerant of the refrigerant circuit (91). As a result, the water flowing through the first heat source circuit (81) is deprived of evaporation heat of the refrigerant and thus is cooled. The water (cold water) cooled by the cooler (92) is supplied to the cold/hot water circuit (10) through the first connecting pipe (83).

On the other hand, when water flowing through the second heat source circuit (82) flows into the boiler (95), this water is heated by the boiler (95). A part of the water heated by the boiler (95) is sent to the air conditioners (96, 96, . . . ). Each of the air conditioners (96, 96, . . . ) blows air heated by hot water into the inside of each room, and the inside of the each room is heated. The rest of the hot water heated by the boiler (95) is sent to the cold/hot water circuit (10) through the third connecting pipe (85).

Moreover, water that circulates through the cooling-tower circuit (87) takes away heat radiated from the condenser (94) of the refrigerator (90) and flows into the cooling tower (97). In the cooling tower (97), the circulating water radiates heat into air.

In the cold/hot water circuit (10), the first operation of FIG. 3B and the second operation of FIG. 3A are conducted alternately as in the second embodiment described above. That is, cold water supplied to the cold/hot water circuit (10) cools the adsorbent of the first adsorption heat exchanger (21) or the second adsorption heat exchanger (22), and subsequently is returned to the first heat source circuit (81) through the second connecting pipe (84). On the other hand, hot water supplied to the cold/hot water circuit (10) heats the adsorbent of the first adsorption heat exchanger (21) or the second adsorption heat exchanger (22), and subsequently is returned to the second heat source circuit (82) through the fourth connecting pipe (86).

In this occasion, the outdoor air (OA) is humidified and heated by the first adsorption heat exchanger (21) or the second adsorption heat exchanger (22), and subsequently is supplied to the inside of each room as supply air (SA). On the other hand, the room air (RA) gives moisture to the adsorbent of the first adsorption heat exchanger (21) or the second adsorption heat exchanger (22), and is discharged to the outdoors as exhaust air (EA).

Also in the twelfth embodiment, since it is configured that the room air (RA) is humidified and dehumidified by the use of the adsorption heat exchangers (20) of the cold/hot water circuit (10), the configuration can be simplified and the controller can be miniaturized compared with the conventional humidity controller (1) using an adsorption element and a heat pump apparatus.

Furthermore, in the twelfth embodiment, the use of the air conditioners (96, 96, . . . ) of the four-pipe fan-coil unit type enables switching between the cooling and dehumidifying operation and the heating and humidifying operation to be performed by a comparatively simple operation.

It goes without saying that the humidity controller (1) of any other embodiment may be applied to the outside air control system (80) described in this embodiment.

Other Embodiments

The above-described embodiments of the present invention may adopt the following configurations.

For example, it is not necessary to configure the humidity controller (1) of each embodiment to be capable of dehumidification and humidification, and any humidity controller is acceptable as long as it can perform at least a humidifying operation. For this reason, the air passage (30) only needs to be able to supply air that has passed through the adsorption heat exchanger (20) to the inside of the room at the time of hot water circulation of the cold/hot water circuit (10).

In the cold/hot water circuit (10) of the embodiments described above, it is configured that the four-way selector valves (11, 12) are used to switch a flow of cold/hot water. However, as shown in FIG. 27 and FIG. 28, instead of the four-way selector valves (11, 12), it may be configured that a three-way valve (105) or two-way valves (shut-off valves) (106, 107) are used to switch the flow of cold/hot water.

Figure 27:
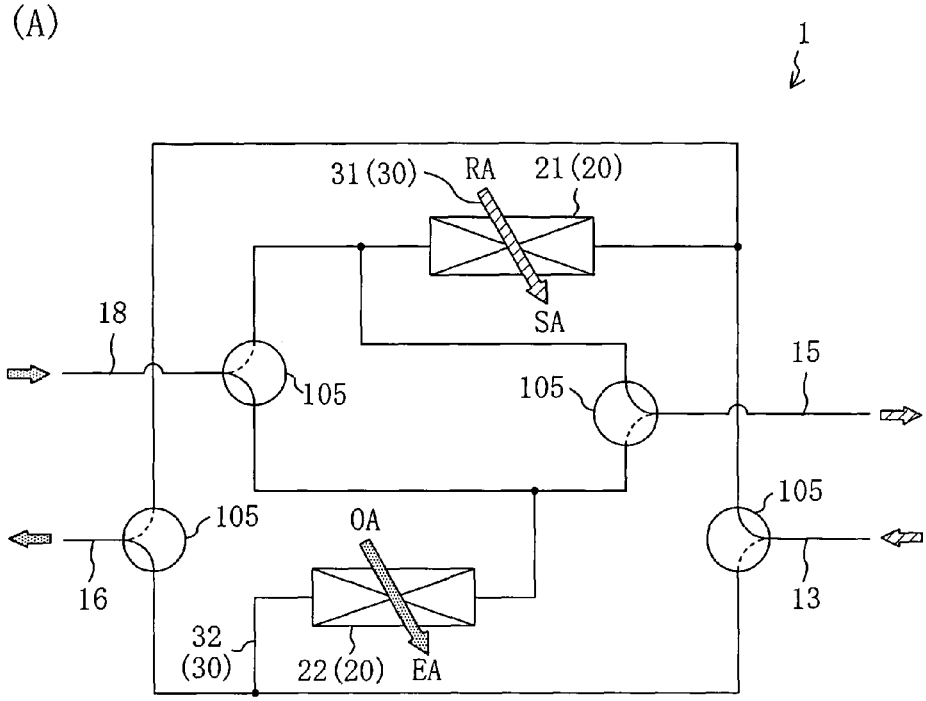
FIG. 27 is a circuit diagram showing a humidifying operating state of a humidity controller according to another first embodiment.
Figure 27:
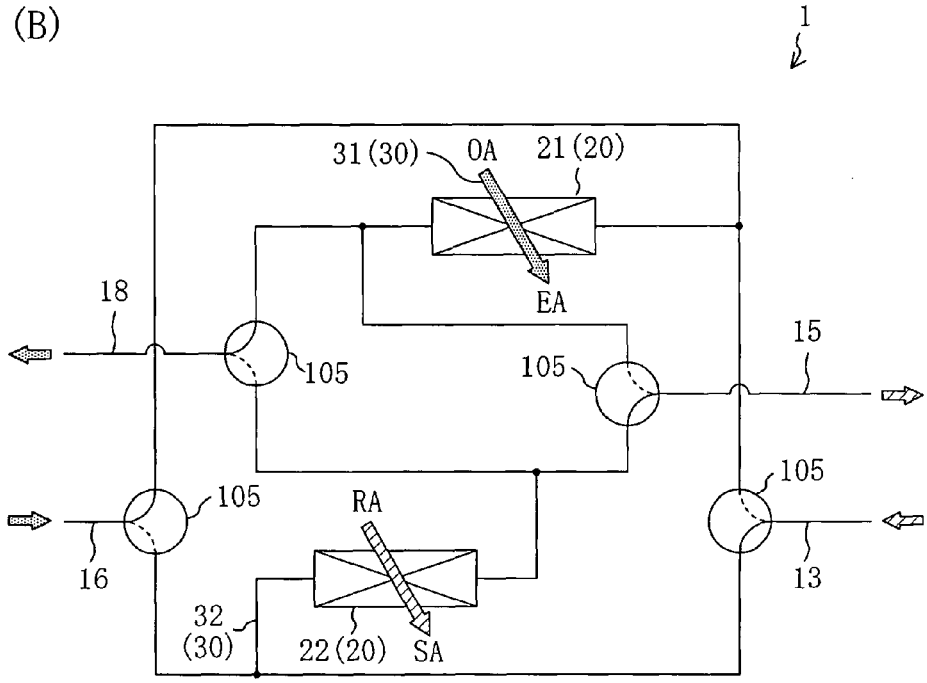

Specifically, in the example shown in FIG. 27, four three-way valves (105) are installed in the cold/hot water circuit (10), which is analogous to the second embodiment, instead of the four-way selector valves (11, 12). These three-way valves (105) enable switching between a state shown in FIG. 27A and a state shown in FIG. 27B. Then, when the three-way valve (105) is switched to the state shown in FIG. 27A, a first operation similar to that of the second embodiment is conducted. When the three-way valve (105) is switched to the state shown in FIG. 27B, a second operation similar to that of the second embodiment is conducted. It is noted that while the example of FIG. 27 exemplifies a humidifying operation of the humidity controller (1), a dehumidifying operation similar to that of the second embodiment or a humidifying operation and dehumidifying operation similar to those of other embodiments can be performed by switching of the three-way valve (105) as in this example and switching of an air flow.

Figure 28:
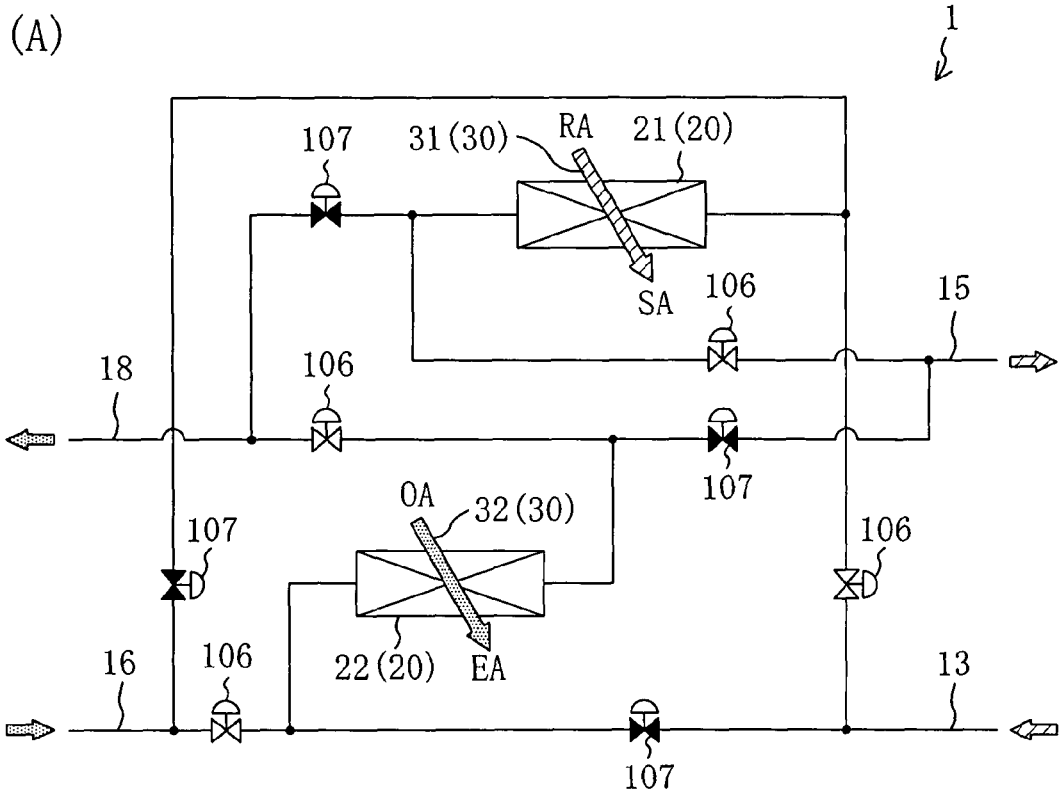
FIG. 28 is a circuit diagram showing a humidifying operating state of a humidity controller according to another second embodiment.
Figure 28:
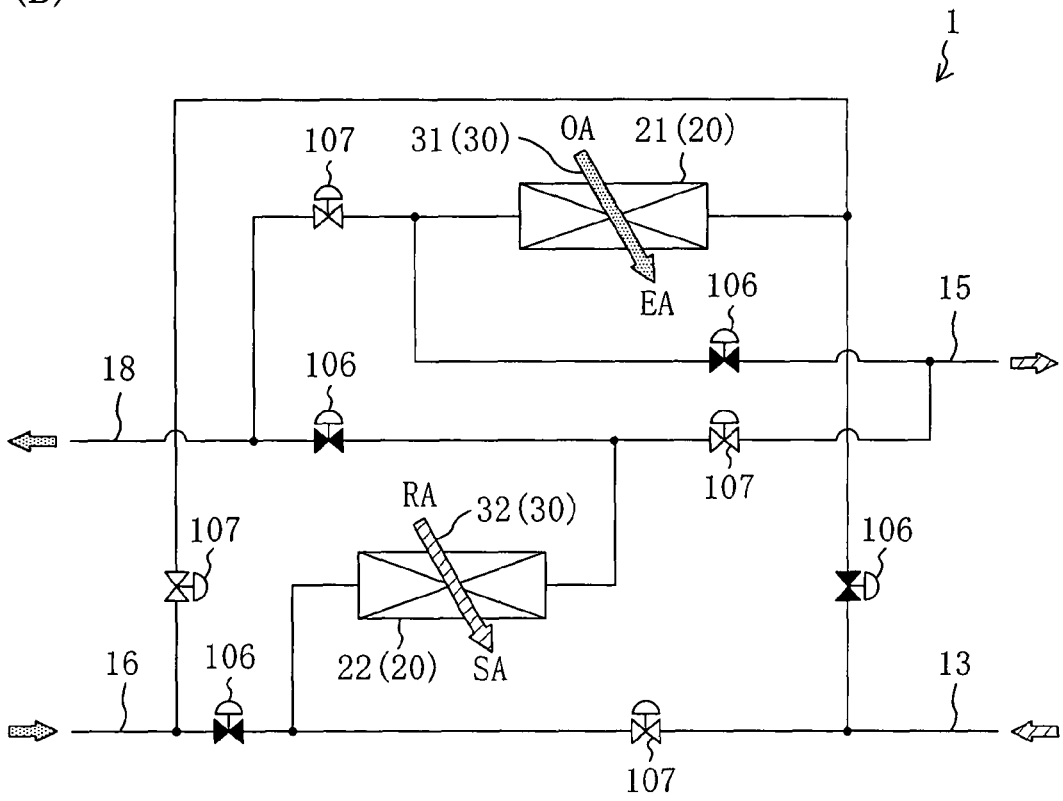

In the example shown in FIG. 28, eight two-way valves (106, 107) are installed instead of the four-way selector valves (11, 12) in a cold/hot water circuit (10), which is analogous to that of the second embodiment. These two-way valves (106, 107) enable the state shown in FIG. 28A and the state shown in FIG. 28B to be switched on and off. That is, when each two-way valve (106) turns into an open state (a state painted white in FIG. 28A) and each two-way valve (107) turns into a close state (a state painted black in the same figure), a first operation similar to that of the second embodiment is conducted. Moreover, as shown in FIG. 28B, when each two-way valve (106) turns into a close state and each two-way valve (107) turns into an open state, a second operation similar to that of the second embodiment is conducted. It is noted that while the example of FIG. 28 exemplifies a humidifying operation of the humidity controller (1), a dehumidifying operation similar to that of the second embodiment can be performed by switching of the two-way valves (106, 107) as in this example and switching of an air flow, and a humidifying operation and a dehumidifying operation similar to those of the other embodiments can be performed.

These three-way valve (105) and two-way valves (106, 107) are excellent in pressure resistance against cold/hot water compared with, for example, the four-way selector valves (11, 12). Therefore, the use of these valves can secure reliability of this humidity controller.

Moreover, in the tenth to twelfth embodiments, the refrigerator (90) and the boiler (95) are used in order to supply cold water and hot water to the cold/hot water circuit (10). However, instead of the refrigerator (90) and the boiler (95), a heat pump chiller of the cold/hot water simultaneous output type can be used. In this case, both of the cold water cooled by the cold-water side heat exchanger and hot water heated by the hot-water side heat exchanger, or either of them can be supplied to the cold/hot water circuit (10). The heat pump chiller of this kind can provide cold water and hot water with a single heat source system and can conduct an operation correspondingly to an air-conditioning load of the outside air control system (80).

Figure 29:
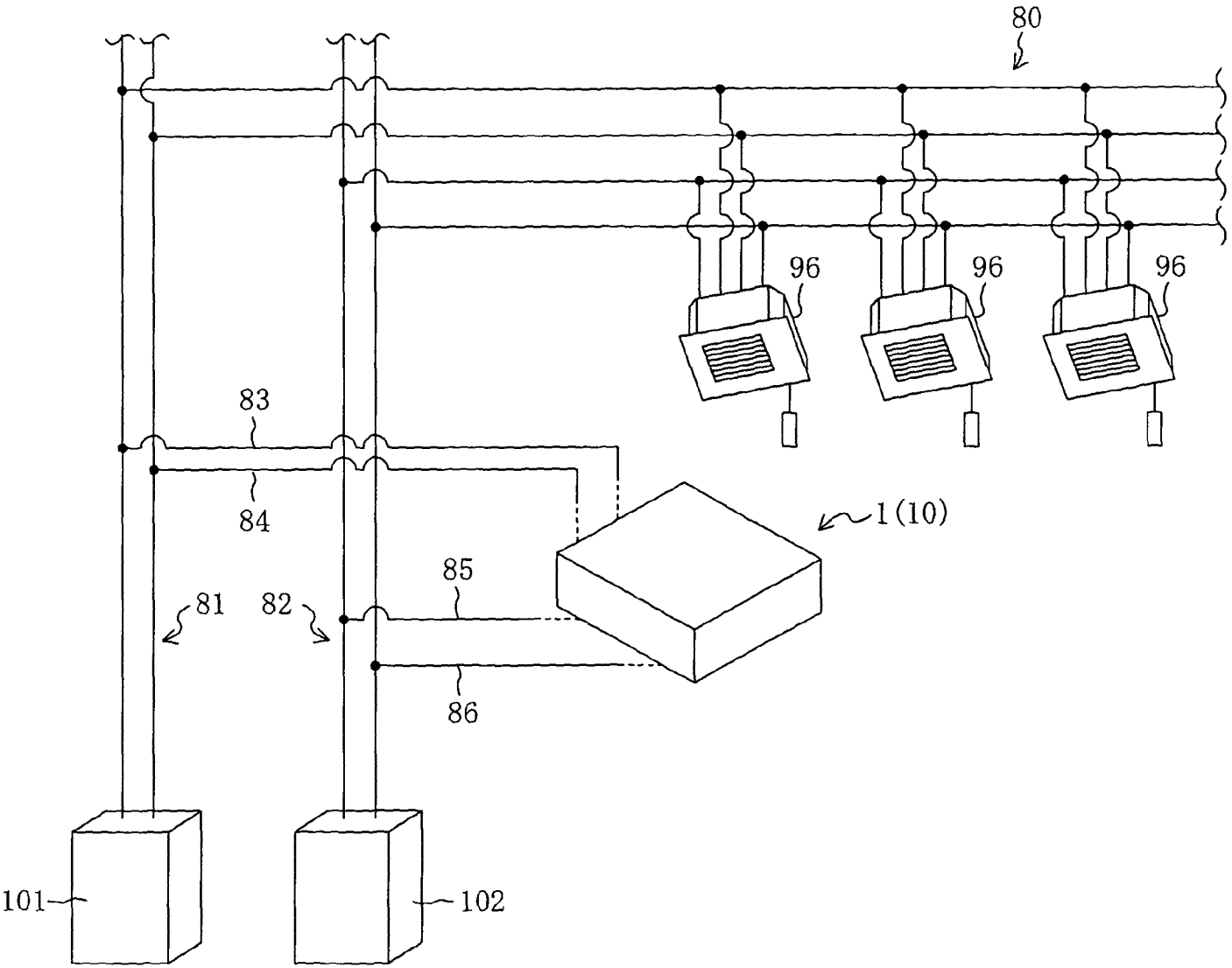
FIG. 29 is a circuit diagram of an outside air control system according to the other embodiment.

Moreover, cold water and hot water to be supplied to the cold/hot water circuit (10) can be obtained by the thermal storage devices (101, 102). For example, the example shown in FIG. 29 provides, instead of the refrigerator (90) and the boiler (95), thermal storage devices (101, 102) in the outside air control system (80) of the twelfth embodiment. The thermal storage device (101) is a thermal storage device for cooling such that cold heat is stored in a thermal storage tank in the nighttime, and water of the first heat source circuit (81) is cooled with this cold heat in the daytime. This thermal storage device (101) is made up of a sensible-heat type thermal storage device or a latent-heat type thermal storage device that may be of a static type, a dynamic type, or the like. The thermal storage device (102) stores hot heat in a thermal storage tank in the nighttime, and heats water of the second heat source circuit (82) to make it hot water in the daytime. This thermal storage device (102) is made up of a sensible-heat type thermal storage device etc. Thus, the use of the thermal storage devices (101, 102) as heat sources for cold water and hot water to the cold/hot water circuit (10) can attain a reduction in heat source capacity, and additionally a reduction in capacity of a power incoming unit and a reduction in electricity rate. It is noted that these thermal storage devices (101, 102) may be used for, not being limited to the example of FIG. 29, the other embodiments.

The above embodiments are essentially desirable exemplifications, and are not intended to limit this invention, embodiments to which this invention is applied, or the range of applications.

INDUSTRIAL APPLICABILITY

As described hereinbefore, the present invention finds applications in the humidity controller (1) that is configured to be capable of, at least, a humidifying operation.

The invention claimed is:

1. A humidity controller capable of at least a humidifying operation, comprising:

a cold-and-hot water circuit through which cold-and-hot water circulates;

an adsorption heat exchanger that is provided in the cold-and-hot water circuit and supports an adsorbent on the surface of the adsorption heat exchanger; and an air passage for supplying air that has passed through the adsorption heat exchanger to the inside of a room or outdoors selectively, wherein the adsorption heat exchanger is composed a first adsorption heat exchanger and a second adsorption heat exchanger, the cold-and-hot water circuit is configured to be switchable between a first cold-and-hot water circulating state in which hot water passes through the first adsorption heat exchanger and cold water passes through the second adsorption heat exchanger and a second cold-and-hot water circulating state in which the hot water passes through the second adsorption heat exchanger and the cold water passes through the first adsorption heat exchanger, and the air passage is configured to be switchable between a first air circulating state in which the air passage supplies air that has passed through the first adsorption heat exchanger to the inside of the room and discharges air that has passed through the second adsorption heat exchanger to the outdoors and a second air circulating state in which the air passage supplies air that has passed through the second adsorption heat exchanger to the inside of the room and discharges air that has passed through the first adsorption heat exchanger to the outdoors.

2. The humidity controller according to claim 1, wherein the air passage is configured to supply room air to the adsorption heat exchangers as air to be supplied to the inside of the room after passing through one of the first adsorption heat exchanger and the second adsorption heat exchanger and supply outdoor air to the adsorption heat exchangers as air to be discharged after passing through the other one of the first adsorption heat exchanger and the second adsorption heat exchanger.

3. The humidity controller according to claim 1, wherein the air passage is configured to supply outdoor air to the adsorption heat exchangers as air to be supplied to the inside of the room after passing through one of the first adsorption heat exchanger and the second adsorption heat exchanger and supply room air to the adsorption heat exchangers as air to be discharged to the outdoors after passing through the other one of the first adsorption heat exchanger and the second adsorption heat exchanger.

4. The humidity controller according to claim 3, wherein the air passage is configured to supply the outdoor air that has passed through one of the first adsorption heat exchanger and the second adsorption heat exchanger to the inside of the room and discharge the room air that has passed through the other one of the first adsorption heat exchanger and the second adsorption heat exchanger to the outdoors in a state in which the cold-and-hot water circuit is halted.

5. The humidity controller according to claim 1, wherein the air passage is configured to supply outdoor air to the adsorption heat exchangers as air to be supplied to the inside of the room after passing through one of the first adsorption heat exchanger and the second adsorption heat exchanger and supply outdoor air to the adsorption heat exchangers as air to be discharged to the outdoors after passing through the other one of the first adsorption heat exchanger and the second adsorption heat exchanger.

6. The humidity controller according to claim 1, wherein the cold-and-hot water circuit is configured to be capable of an operation of circulating one of cold water and hot water therethrough and halting the other one of them.

7. The humidity controller according to claim 1, wherein the cold-and-hot water circuit is equipped with a first four-way selector valve and a second four-way selector valve, the each four-way selector valve is configured to be switchable between a first state in which a first port (P1) and a second port (P2) communicate with each other and a third port (P3) and a fourth port (P4) communicate with each other and a second state in which the first port (P1) and the third port (P3) communicate with each other and the second port (P2) and the fourth port (P4) communicate with each other, a hot water inflow pipe is connected to the first port (P1) of the first four-way selector valve, a first circulating pipe that communicates with a heat transfer pipe of the first adsorption heat exchanger is connected to the second port (P2) of the first four-way selector valve and the third port (P3) of the second four-way selector valve, a hot water outflow pipe is connected to the fourth port (P4) of the second four-way selector valve, a cold water inflow pipe is connected to the first port (P1) of the second four-way selector valve, a second circulating pipe that communicates with a heat exchange pipe of the second adsorption heat exchanger is connected to the second port (P2) of the second four-way selector valve and the third port (P3) of the first four-way selector valve, and a cold water outflow pipe is connected to the fourth port (P4) of the first four-way selector valve.

8. The humidity controller according to claim 1, further comprising a first adsorption cooling element and a second adsorption cooling element, wherein each of the adsorption cooling elements has a humidity control passage capable of adsorbing and desorbing moisture in/to air and a cooling passage capable of absorbing adsorption heat produced when moisture is adsorbed in the humidity control passage with cooling air, the air passage is configured to be able to set an air passage for humidifying operation and an air passage for dehumidifying operation, the air passage for humidifying operation is configured to be switchable between: a first air circulating state in which the air passage supplies air that has passed through the cooling passage of the second adsorption cooling element, the first adsorption heat exchanger, and the humidity control passage of the first adsorption cooling element to the inside of the room and also discharges air that has passed through the second adsorption heat exchanger and the humidity control passage of the second adsorption cooling element to the outdoors; and a second air circulating state in which the air passage supplies air that has passed through the cooling passage of the first adsorption cooling element, the second adsorption heat exchanger, and the humidity control passage of the second adsorption cooling element to the inside of the room and also discharges air that has passed through the first adsorption heat exchanger and the humidity control passage of the first adsorption cooling element to the outdoors, and the air passage for dehumidifying operation is configured to be switchable between: a first air circulating state in which the air passage supplies air that has passed through the first adsorption heat exchanger and a humidity control passage of the first adsorption cooling element to the inside of the room and also discharges air that has passed through the cooling passage of the first adsorption cooling element, the second adsorption heat exchanger, and the humidity control passage of the second adsorption cooling element to the outdoors; and a second air circulating state in which that the air passage supplies air that has passed through the second adsorption heat exchanger and the humidity control passage of the second adsorption cooling element to the inside of the room and also discharges air that has passed through the cooling passage of the second adsorption cooling element, the first adsorption heat exchanger, and the humidity control passage of the first adsorption cooling element to the outdoors.

9. The humidity controller according to claim 1, further comprising a refrigerant circuit for conducting a refrigerating cycle of circulating a refrigerant, wherein a heat exchanger of the refrigerant circuit is composed of a third adsorption heat exchanger and a fourth adsorption heat exchanger that support an adsorbent on the surfaces of the third adsorption heat exchanger and the fourth adsorption heat exchanger, the refrigerant circuit is configured to be switchable between a first refrigerant circulating state in which the third adsorption heat exchanger serves as a condenser and the fourth adsorption heat exchanger serves as an evaporator and a second refrigerant circulating state in which the fourth adsorption heat exchanger serves as a condenser and the third air adsorption exchanger serves as an evaporator, and the air passage is configured to be switchable between: a first air circulating state in which the air passage supplies air that has passed through the third adsorption heat exchanger and the first adsorption heat exchanger to the inside of the room and also discharges air that has passed through the fourth adsorption heat exchanger and the second adsorption heat exchanger to the outdoors; and a second air circulating state in which the air passage supplies air that has passed through the fourth adsorption heat exchanger and the second adsorption heat exchanger to the inside of the room and also discharges air that has passed through the third adsorption heat exchanger and the first adsorption heat exchanger to the outdoors.

10. The humidity controller according to claim 1, further comprising a refrigerant circuit for conducting a refrigerating cycle of circulating a refrigerant, wherein a heat exchanger of the refrigerant circuit is composed of a first air heat exchanger and a second air heat exchanger with air therein carrying out sensible heat change with a refrigerant, the refrigerant circuit is configured to be switchable between a first refrigerant circulating state in which the first air heat exchanger serves as a condenser and the second air heat exchanger serves as an evaporator and a second refrigerant circulating state in which the second air heat exchanger serves as a condenser and the first air heat exchanger serves as an evaporator, and the air passage is configured to be switchable between: a first air circulating state in which the air passage supplies air that has passed through the first adsorption heat exchanger and the first air heat exchanger to the inside of the room and also discharges air that has passed through the second adsorption heat exchanger and the second air heat exchanger to the outdoors; and a second air circulating state in which the air passage supplies air that has passed through the second adsorption heat exchanger and the second air heat exchanger to the inside of the room and also discharges air that has passed through the first adsorption heat exchanger and the first air heat exchanger to the outdoors.

11. The humidity controller according to claim 1, further comprising an auxiliary heat exchanger, wherein the auxiliary heat exchanger is equipped with a first passage through which first air flows and a second passage through which second air flows, and is configured to let the air flowing through the first passage and the air flowing through the second passage conduct a total heat exchange or a sensible heat exchange, and the air passage is configured to be switchable between: a first air circulating state in which the air passage supplies air that has passed through the first passage of the auxiliary heat exchanger and the first adsorption heat exchanger to the inside of the room and also discharges air that has passed through the second passage of the auxiliary heat exchanger and the second adsorption heat exchanger to the outdoors; and a second air circulating state in which the air passage supplies air that has passed through the second passage of the auxiliary heat exchanger and the second adsorption heat exchanger to the inside of the room and also discharges air that has passed through the first passage of the auxiliary heat exchanger and the first adsorption heat exchanger to the outdoors.

12. The humidity controller according to claim 1, further comprising control means for setting a time interval at which switching between a cold-and-hot water circulating state of the cold-and-hot water circuit and an air circulating state of the air passage are switched according to a latent heat load of the inside of the room, wherein the control means is configured such that the setting value of the time interval is made smaller with increasing latent heat load of the inside of the room.

13. The humidity controller according to claim 1, wherein the cold-and-hot water circuit is connected to a cold heat source for supplying cold water cooled by the refrigerator.

14. The humidity controller according to claim 13, wherein the cold-and-hot water circuit is connected to a cold heat source for supplying cold water cooled by a refrigerator and a hot heat source for supplying hot water heated by heat being radiated from the refrigerator.

15. The humidity controller according to claim 1, wherein the cold-and-hot water circuit is connected to heat sources for supplying cold-and-hot water cooled/heated by a refrigerator or a boiler.

16. The humidity controller according to claim 1, wherein the cold-and-hot water circuit is connected to a cold heat source for supplying cold water cooled by cold heat being thermally stored in a thermal storage device.

17. The humidity controller according to claim 1, wherein the cold-and-hot water circuit is connected to a hot heat source for supplying hot water heated by hot heat being thermally stored in a thermal storage device.

* * * * *